US007570244B2

(12) United States Patent
Agari et al.

(10) Patent No.: US 7,570,244 B2
(45) Date of Patent: Aug. 4, 2009

(54) DISPLAY DEVICE

(75) Inventors: Masafumi Agari, Hyogo (JP); Hidetada Tokioka, Hyogo (JP); Ryuichi Hashido, Hyogo (JP); Takahiro Urakabe, Hyogo (JP); Suehiro Gotoh, Hyogo (JP); Masashi Okabe, Hyogo (JP); Mitsuo Inoue, Hyogo (JP)

(73) Assignee: Mitsubishi Denki Kabuhsiki Kaisha, Tokyo (JP)

( * ) Notice: Subject to any disclaimer, the term of this patent is extended or adjusted under 35 U.S.C. 154(b) by 427 days.

(21) Appl. No.: 10/513,755

(22) PCT Filed: Jun. 17, 2003

(86) PCT No.: PCT/JP03/07697

§ 371 (c)(1),
(2), (4) Date: Nov. 9, 2004

(87) PCT Pub. No.: WO04/001713

PCT Pub. Date: Dec. 31, 2003

(65) Prior Publication Data

US 2005/0174306 A1 Aug. 11, 2005

(30) Foreign Application Priority Data

Jun. 19, 2002 (JP) ..... 2002-177986

(51) Int. Cl.
*G09G 3/36* (2006.01)

(52) U.S. Cl. ..... 345/100

(58) Field of Classification Search ..... 345/76, 345/77, 82, 211, 99–100, 690; 315/169.3
See application file for complete search history.

(56) References Cited

U.S. PATENT DOCUMENTS 5,438,373 A * 8/1995 Cummins ..... 348/572

(Continued)

FOREIGN PATENT DOCUMENTS

JP 62-122488 8/1987

(Continued)

OTHER PUBLICATIONS

Sasaoka, Tatsuya et al. "24.4L: Late-News Paper: A 13.0-inch AM-OLED Display with Top Emitting Structure and Adaptive Current Mode Programmed Pixel Circuit (TAC)", SID 01 Digest, pp. 384-386 2001.

*Primary Examiner*—Sumati Lefkowitz
*Assistant Examiner*—William L Boddie
(74) *Attorney, Agent, or Firm*—Oblon, Spivak, McClelland, Maier & Neustadt, P.C.

(57) ABSTRACT

Signal lines for supplying signal currents to respective pixel circuits having light emitting elements are arranged. A signal line driving circuit generates, on a signal line, a signal current corresponding to the image data, by switching bit weighting currents output from bit weighting current source circuits provided for respective bits of the image data, using a switch circuit turned on/off dependent on the corresponding bit. Each current source circuit has a function of correcting the level of the bit weighting current output from itself, based on a reference current of the bit weighting current supplied from a reference current line. Therefore, even when the characteristics of TFTs forming respective current source circuits vary widely, variation in signal currents among the signal lines can be suppressed, and unevenness in emission luminance can be suppressed.

19 Claims, 35 Drawing Sheets

U.S. PATENT DOCUMENTS

| | | | | |
|---|---|---|---|---|
| 5,703,582 | A * | 12/1997 | Koyama et al. | 341/120 |
| 6,753,880 | B2 * | 6/2004 | Kudo et al. | 345/690 |
| 6,806,860 | B2 * | 10/2004 | Saito et al. | 345/99 |
| 7,015,882 | B2 * | 3/2006 | Yumoto | 345/100 |

FOREIGN PATENT DOCUMENTS

| | | |
|---|---|---|
| JP | 5-42488 | 10/1993 |
| JP | 7-36410 | 2/1995 |
| JP | 08-129359 | 5/1996 |
| JP | 9-244590 | 9/1997 |
| JP | 11-045071 | 2/1999 |
| JP | 11-212493 | 8/1999 |
| JP | 2000-81920 | 3/2000 |
| JP | 2000-293245 | 10/2000 |
| JP | 2001-147659 | 5/2001 |
| JP | 2002-152565 | 5/2002 |
| JP | 2003-150112 | 5/2003 |
| JP | 2003-195812 | 7/2003 |
| JP | 2003-223135 | 8/2003 |
| WO | 03 038793 | 5/2003 |
| WO | 03 038794 | 5/2003 |
| WO | 03 038795 | 5/2003 |

* cited by examiner

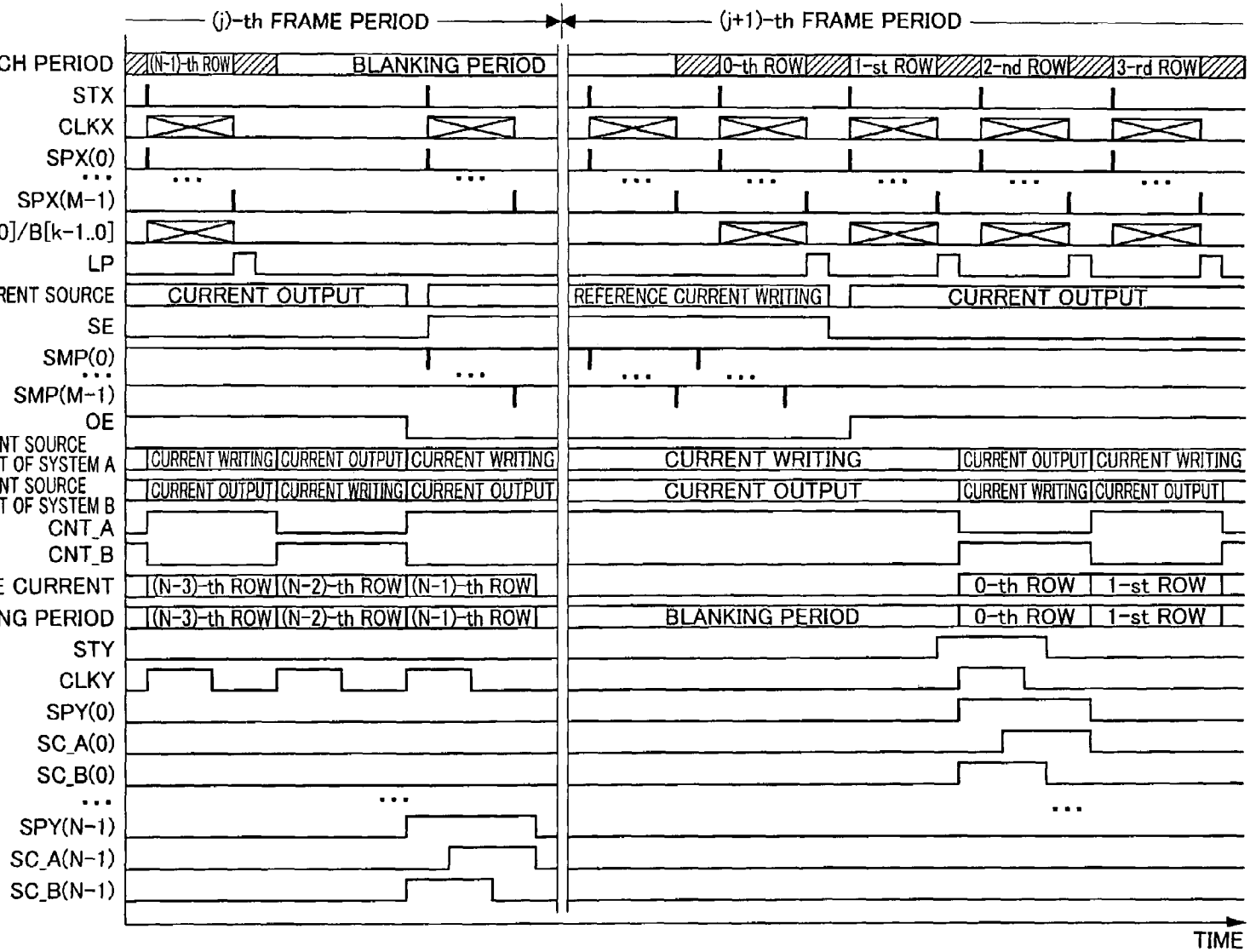
FIG.29
(j)-th FRAME PERIOD
(j+1)-th FRAME PERIOD
DATA LATCH PERIOD
STX
CLKX
SPX(0)
SPX(M-1)
R[k-1..0]/G[k-1..0]/B[k-1..0]
LP
BIT WEIGHTING CURRENT SOURCE
SE
SMP(0)
SMP(M-1)
OE
CURRENT TRANSMITTING CIRCUIT
CURRENT SOURCE CIRCUIT OF SYSTEM A
CURRENT SOURCE CIRCUIT OF SYSTEM B
CNT_A
CNT_B
SIGNAL LINE CURRENT
SCANNING PERIOD
STY
CLKY
SPY(0)
SC_A(0)
SC_B(0)
SPY(N-1)
SC_A(N-1)
SC_B(N-1)
(N-1)-th ROW
BLANKING PERIOD
0-th ROW
1-st ROW
2-nd ROW
3-rd ROW
CURRENT OUTPUT
REFERENCE CURRENT WRITING
CURRENT WRITING
(N-3)-th ROW
(N-2)-th ROW
(N-1)-th ROW
TIME

DISPLAY DEVICE

TECHNICAL FIELD

The present invention relates to a display apparatus including, for each pixel, a light emitting element of which emission luminance changes in accordance with a current, such as an organic EL (Electro-Luminescence) element.

BACKGROUND ART

Recently, display apparatus using organic ELs and the like as light emitting elements have been actively developed for portable information terminals or for television receivers. A self-emissive display apparatus including, for each pixel, a light emitting element such as an organic EL has good visibility and superior motion-image display characteristic.

An example of a conventional display apparatus using the organic ELs as light emitting elements is known, by way of example, from Japanese Patent Laying-Open No. 11-212493.

FIG. 37 is a circuit diagram representing a configuration of the conventional display apparatus described in the aforementioned laid-open application, in which four signal lines (Sm, 1~Sm, 4) and four scanning lines (Dn, 1~Dn, 4) are connected to a light emitting element (m, n) through thin film transistors TFT1~4. Further, constant current sources (Im, 1~Im, 4) are connected to the signal lines (Sm, 1~Sm, 4), and by setting current ratio thereof to 1:2:4:8, the current to the light emitting element is controlled to have 16 different values, to attain emission luminance in 16 different tones.

A so called active type display apparatus has been widely known, which uses a thin film transistor (TFT) formed on a glass substrate as a switching element of a pixel. An active type display apparatus using light emitting elements of which emission luminance varies with current such as organic ELs is particularly advantageous over a passive type one that does not use a switching element for a pixel, in that higher luminance can be attained with smaller driving current to a light emitting element, because, based on a re-written signal, a current can be kept flowing through the light emitting element until the next time of rewriting.

Of thin film transistors, a low temperature poly-silicon TFT (low temperature p-Si TFT) that can be manufactured through a low temperature process has higher electron mobility than an amorphous silicon TFT. Therefore, it is possible to form a driving circuit thereof integrally with a pixel matrix circuit on a glass substrate, and hence, it has come to be widely used for liquid crystal display apparatus and the like.

It is noted, however, that the low temperature p-Si TFT, which is generally formed by laser annealing, has Vth (threshold voltage) and μ (mobility) varied more widely than single-crystal silicon, because it is difficult to uniformly control laser irradiation intensity over the glass substrate.

In the conventional display apparatus, a plurality of constant current sources are connected to every signal line of each column. Therefore, when the constant current sources are formed in the display panel integrally with the pixel matrix on the glass substrate using TFTs, variation of TFT characteristics causes variation in the output currents from the constant current sources of respective columns and hence variation in signal line driving currents. This results in unevenness in emission luminance.

Further, it is necessary to arrange a plurality of signal lines for every column, and therefore, wiring layout becomes difficult in a display apparatus of high resolution having a narrow pixel pitch.

In a general configuration, luminance tone of each pixel is designated by digital image data. Therefore, when the number of bits of the image data increases together with the increase in colors to be displayed, voltage variation of an image data line transmitting the image data may possibly affects generation of the signal line driving current on a signal line supplying a current to a light emitting element.

DISCLOSURE OF THE INVENTION

An object of the present invention is to provide a display apparatus that can suppress unevenness in emission luminance by suppressing variation of signal line driving currents on column by column basis, even when TFT characteristic varies considerably.

Another object of the present invention is to provide a display apparatus capable of high resolution display with a narrow pixel pitch, by reducing the number of signal lines of each column.

A further object of the present invention is to improve display quality of the display apparatus, by suppressing the influence of voltage variation over the image data line transmitting the image data- to the generation of the signal line driving current on the signal line supplying a current to the light emitting element.

The present invention provides a display apparatus, including: a pixel matrix circuit formed to supply a current to a light emitting element of each pixel; a signal line for supplying a signal current in accordance with a digital image data to the pixel matrix circuit; a reference current generating unit for outputting a bit weighted reference current in correspondence with each bit of the digital image data a bit weighting current output unit provided corresponding to each bit of the digital image data, for outputting a bit weighting current in accordance with the corresponding reference current and having a function of correcting the bit weighting current to be output by writing the corresponding reference current and a switching unit provided corresponding to the bit weighting current generating unit for switching the bit weighting current output from the corresponding bit weighting current generating unit in accordance with data level of the corresponding bit; wherein currents each switched by the switching unit are added to be output as the signal current to the signal line.

In such a display apparatus, the bit weighting current generating unit outputting the bit weighting current is corrected by writing a common reference current, and the bit weighting currents output from the bit weighting current generating unit are switched in accordance with the bit data of the digital image corresponding to respective bits and added to be output to the signal line. Therefore, even when the TFT characteristic varies widely, variation of the signal line driving current for each column can be suppressed, and therefore, unevenness in emission luminance can be suppressed.

Preferably, the bit weighting current generating unit includes a first field effect transistor outputting a current, a second field effect transistor connecting the gate and drain of the first field effect transistor when the reference current is written, and a capacitance element connected to the gate of the first field effect transistor; and when the reference current is written, the second field effect transistor is rendered conductive so that a gate voltage corresponding to a current flowing through the first field effect transistor is held in the capacitance element, and when the bit weighting current is output, the second field effect transistor is shut off and the first field effect transistor outputs a current corresponding to the gate voltage held by the capacitance element.

The display apparatus is configured such that, at the time of writing the reference current, the gate and the drain of the first field effect transistor for outputting the bit weighting current are connected by the second field effect transistor, and a gate voltage corresponding to the current flowing through the first field effect transistor is kept held by the capacitance element connected to the gate, while at the time of outputting the bit weighting current, the second field effect transistor is shut off, and the first field effect transistor outputs a current corresponding to the gate voltage held by the capacitance element. Therefore, the reference current written to the first field effect transistor at the time of writing the reference current can be reproduced and output at the time of outputting the bit weighting current. Consequently, even when the transistor characteristic varies widely, variation of the signal line driving current for each column can be suppressed, and therefore, unevenness in emission luminance can be suppressed.

Further, preferably, the bit weighting current generating unit further includes a dummy load electrically connected to a node to which the bit weighting current is output, and when a current is not supplied from the corresponding switching unit to the signal line, a current is supplied to the dummy load.

The display apparatus is adapted such that when the current is not supplied by the switching unit to the signal line, the current is supplied to the dummy load provided at the output of the bit weighting current output unit. Therefore, leakage of the charges held by the capacitance element connected to the gate of the first field effect transistor can be suppressed. Therefore, lowering of the signal line driving current, resulting from the lowering of gate potential of the first field effect transistor, can be suppressed.

Further, more preferably, the bit weighting current generating unit further includes a third field effect transistor cascade-connected to drain side of the first field effect transistor, and a prescribed voltage is applied to the gate of the third field effect transistor so that the third field effect transistor operates in a saturation region.

The display apparatus includes the third field effect transistor cascade-connected to the drain side of the first field effect transistor, and to the gate of the third field effect transistor, a prescribed voltage causing the transistor to operate in the saturation region is applied. Therefore, variation of Vds (source-drain voltage) of the first field effect transistor can be shielded by the third field effect transistor. Thus, even when the signal line voltage varies together with the variation in the signal current supplied to the signal line, the variation of the signal line current driven by the first field effect transistor can be suppressed.

Alternatively, or more preferably, the bit weighting current generating unit further includes a fourth field effect transistor cascade-connected to drain side of the first field effect transistor, and when a current is not output from the corresponding switching unit to the signal line in the bit weighting current output operation, the fourth field effect transistor is shut off.

The display apparatus includes the fourth field effect transistor cascade-connected to the drain side of the first field effect transistor, and when any current is not output from the switching unit to the signal line during the current output operation of the bit weighting current generating unit, the fourth field effect transistor is shut off. Therefore, a leakage path of the charges held by the capacitance element connected to the gate of the first field effect transistor can be shut off. Therefore, the gate potential of the first field effect transistor does not decrease, and hence, even when the image data attains to "1" and a current is to be output to the signal line, a prescribed current can surely be supplied.

Particularly and preferably, when a current is not output from the switching unit to the signal line in the bit weighting current output operation by the weighting current generating unit, or when the reference current is not written to the first field effect transistor in a reference current writing operation, the fourth field effect transistor is shut off.

In the display apparatus, when any current is not output from the switching unit to the signal line during the current output operation of the bit weighting current generating unit or when the reference current is not written to the first field effect transistor during the reference current writing operation, the fourth field effect transistor is shut off, and further, leakage path of the charges held by the capacitance element connected to the gate of the field effect transistor can be shut off when the reference current is not written. Therefore, the gate potential of the first field effect transistor does not decrease, and hence, even when the image data attains to "1" and a current is to be output to the signal line, a prescribed current can surely be supplied.

More preferably, the bit weighting current generating unit further includes a capacitance element connected to the drain of the fourth field effect transistor for holding a voltage of the drain.

The display apparatus includes the capacitance element connected to the drain of the fourth field effect transistor and holding the drain voltage. Therefore, it becomes possible to prevent decrease of the drain potential of the fourth field effect transistor to be lower than the gate potential of the first field effect transistor, and to prevent leakage of charges held by the capacitance element connected to the gate of the first field effect transistor. Therefore, the gate potential of the first field effect transistor does not decrease, and hence, even when the image data attains to "1" and a current is to be output to the signal line, a prescribed current can surely be supplied.

Preferably, the bit weighting current generating unit further includes a capacitance element connected to the drain of the first field effect transistor for holding a voltage of the drain.

The display apparatus includes the capacitance element connected to the drain of the first field effect transistor and holding the drain voltage. Therefore, it becomes possible to prevent decrease of the drain potential of the first field effect transistor to be lower than the gate potential, and to prevent leakage of charges held by the capacitance element connected to the gate of the first field effect transistor. Therefore, the gate potential of the first field effect transistor does not decrease, and hence, even when the image data attains to "1" and a current is to be output to the signal line, a prescribed current can surely be supplied.

Preferably, the display apparatus further includes: a latch unit for latching the input digital image data of one display line successively in response to a latch pulse and a latch pulse generating unit for successively generating the latch pulse; wherein even in a blanking period in a data latch period in which digital images of one frame are latched by the latching unit and in a blanking period of a period in which the bit weighting current generating unit supplies a current to the signal line, the latch pulse generating unit operates to generate the latch pulse, and the bit weighting current generating unit writes the corresponding reference current for correcting the bit weighting current, based on the generated latch pulse.

In the display apparatus, in a period that belongs both to the blanking period of the data latch period in which the unit latches digital images of one frame and the blanking period of the period in which the bit weighting current generating unit supplies a current to the signal line, the latch pulse generating unit is operated to generate a latch pulse, and based on the latch pulse, the reference current is written to the bit weighting current generating unit. Therefore, the reference current writing operation and the current output operation in the bit weighting current generating unit of each column can be separated from each other, and the reference current can be written easily. Further, it is unnecessary to provide a new pulse generating unit for writing the reference current in the bit weighting current generating unit, and therefore, the circuit configuration is simplified and the circuit size (dimension) can be reduced.

More preferably, at a time of activation such as power on, the latch pulse generating unit operates, and based on the generated latch pulse, the bit weighting current generating unit writes the corresponding reference current and, thereafter, the latch unit successively latches the digital data to provide a display.

In such a display apparatus, at the time of activation such as power-on, the latch pulse generating unit is operated, the reference current is written to the bit weighting current generating unit based on the latch pulse, and the digital images are successively latched by the latch unit for display. Therefore, correction of the bit weighting current generating unit by writing the reference current is possible almost entirely over the operation period. Therefore, as compared with the operation using the blanking period only, the time for charging line capacitances and the capacitance element for holding to attain the prescribed gate voltage of the driving transistor can be reduced, and hence, smooth transition to image display becomes possible.

Alternatively or preferably, the display apparatus further includes: a voltage varying unit for generating a variable reference voltage; and a constant current source converting the reference voltage to a current; wherein the reference current generating unit includes a current source circuit generating the reference current from the current output from the constant current source.

In the display apparatus, the reference voltage is generated, the reference voltage is converted to a current, and the reference current is generated based thereon. Therefore, by adjusting the reference voltage using a controller, it becomes possible to adjust the ratio and magnitude of RGB reference currents, and to control white balance adjustment and luminance adjustment of display.

More preferably, the current source circuit includes a current mirror circuit for converting the current output from the constant current source to the reference current corresponding to each bit of the image data, and the current mirror circuit has a plurality of field effect transistors of which size ratio is made different in accordance with the bit weighting.

In the display apparatus, the original current obtained by converting the reference voltage is converted to a plurality of bit weighted reference currents using a current mirror circuit including a plurality of field effect transistors with different size ratio. Accordingly, the bit weighted reference currents can be obtained by a simple structure.

Preferably, the bit weighting current generating unit includes two systems of bit weighting current sources, and the display apparatus further includes control unit for controlling each of the two systems of bit weighting current sources, such that a writing operation of reference current and an output operation of bit weighting current are repeated alternately in a complementary manner.

In the display apparatus, the bit weighting current generating unit includes two such bit weighting current generating units, and the two bit weighting current generating units are controlled such that the reference current writing operation and the current output operation are repeated alternately and complementarily. Therefore, a sufficient time period can be allotted to the reference current writing operation, a stable bit weighing current can be output, and the variation of signal driving current can further be suppressed.

Alternatively or preferably, the display apparatus further includes a staircase wave current source generating a staircase wave current having weighted reference current values as current values of respective steps of the staircase; wherein the reference current generating unit includes a current source to which the current of a corresponding step of the staircase wave current is written and which reproduces the written current and outputs the reproduced current as the reference current.

In the display apparatus, the staircase wave current is generated in which bit weighted reference current values constitute stair step current values, the current of the corresponding step of the staircase wave current is written, and the written current is reproduced to be used as the reference current. Therefore, exact reference currents corresponding to the number of bits can be obtained from one staircase wave current.

Preferably, the reference current generating unit supplies the reference current as a staircase wave current having bit weighted current values; and to the bit weighting current generating unit, the staircase wave current is written as a reference current at a timing for each corresponding bit of the digital image data.

In the display apparatus, the reference current is supplied as a staircase wave current that assumes various bit weighted current values, and the bit weighting current generating unit writes the staircase wave current at a timing corresponding to each bit. Therefore, the number of reference current lines, which is a current supply line that must have wide line width to ensure low impedance, can be reduced to one for each color. Further, the reference current generating circuit can also be simplified to have one output for each color. Therefore, the dimension (size) of the driving circuit can be reduced.

According to another aspect, the present invention provides a display apparatus, including: a pixel matrix circuit formed to supply a current to a light emitting element of each pixel; a plurality of first signal lines for supplying a signal current in accordance with a digital image data to the pixel matrix circuit; an image data line transmitting the digital image data; and a signal line driving portion generating the signal current corresponding to the digital image data over the plurality of first signal lines; wherein the signal line driving portion includes a plurality of second signal lines provided corresponding to and independent from the plurality of first signal lines, a plurality of current converting circuits provided corresponding to the plurality of second signal lines, each generating a current corresponding to the image signal received by the image data line to the corresponding second signal line, and a plurality of current transmitting circuits provided between the plurality of first and second signal lines, respectively; each of the plurality of current transmitting circuits generates, on the corresponding first signal line, a current obtained by reproducing a current passing through the corresponding second signal line as the signal current; and the image data line is arranged avoiding a region crossing the first signal lines.

Preferably, each of the plurality of current converting circuits includes a plurality of current converting units provided corresponding to a plurality of bits forming the digital image data; each of the plurality of current converting units includes a first latch circuit taking and holding data of a corresponding bit among the plurality of bits, at a first prescribed timing determined for each of the plurality of current converting circuits from the image data line, a second latch circuit receiving from the first latch circuit the data of the corresponding bit held by the first latch circuit and holding the data, at a second prescribed timing later than the first prescribed timing, determined common to the plurality of current converting circuits, and a current source circuit for generating, on the corresponding second signal line, corresponding one of the plurality of bit weighting currents set corresponding to the plurality of bits; and the current source circuit executes or stops generation of the corresponding bit weighting current, in accordance with the data of the corresponding bit held by the second latch circuit.

In the display apparatus, the first signal line arranged to supply a signal current to the pixel circuit does not directly cross the image data line. Therefore, the signal current can be written to the pixel circuit, while transmission of the image data does not affect the potential of the first signal line. Further, as the first signal line does not directly cross the image data line, line capacitance of the first signal line is reduced. As a result, the settling time for the signal line potential to attain a desired value corresponding to the signal current level in accordance with the image data can be reduced. Therefore, the signal current in accordance with the image data can be generated quickly, suppressing edge blur, so that the display quality can be improved.

More preferably, each of the plurality of current converting circuits includes a plurality of current converting units provided corresponding to a plurality of bits forming the digital image data; each of the plurality of current converting units includes a latch circuit taking and holding data of a corresponding bit among the plurality of bits, at a first prescribed timing determined for each of the plurality of current converting circuits from the image data line, and a current source circuit for generating, on the corresponding second signal line, corresponding one of a plurality of bit weighting currents set in correspondence with the plurality of bits; the current source circuit has a reset circuit executing or stopping generation of the corresponding bit weighting current in accordance with the data of the corresponding bit held in the latch circuit, and forcefully stopping generation of the bit weighting current until a second prescribed timing determined common to the plurality of current converting portions; and the second prescribed timing is set later than the first prescribed timing, in a same horizontal period.

In the display apparatus, as the reset circuit is provided in the current source circuit, the operation of latching the digital image data of one row from the image data line, and the operation of supplying the signal line current of one row in parallel can be executed. Therefore, the digital data can be provided line-sequentially without the necessity of providing two stages of latch circuits, and hence, the circuit scale of the signal line driving circuit can be reduced. The effect of reducing the circuit scale is particularly advantageous, as it is necessary to provide the latch circuit corresponding in number to the bit number of digital image data, for every first signal line.

Preferably, the display apparatus further includes a reference current generating circuit generating a plurality of reference currents representing reference levels of a plurality of bit weighting currents set corresponding to the plurality of bits, respectively; wherein each of the plurality of current converting circuits includes a plurality of current source circuits provided corresponding to the plurality of bits forming the digital image data; and each of the plurality of current source circuits includes a bit weighting current source capable of executing a reference current writing operation of receiving the corresponding reference current from the reference current generating circuit and holding an electrical state dependent on the corresponding reference current, and a current output operation of generating the bit weighting current source in accordance with the electrical state held in the reference current writing operation, and a switch circuit switching, in accordance with a corresponding bit among the plurality of bits, transmission of the bit weighting current to the corresponding second signal line from the bit weighting current source, in the current output operation by the bit weighting current source.

More preferably, the bit weighting current source includes a first field effect transistor having its source and drain connected to a prescribed voltage and to a first node, respectively, a second field effect transistor provided between a node to which the reference current is supplied and the first node, turned on in the reference current writing operation and turned off in the current output operation, a third field effect transistor connecting the gate and drain of the first field effect transistor in the reference current writing operation, and a capacitance element connected to hold a gate-to-source voltage of the first field effect transistor; and the switch circuit includes a fourth field effect transistor provided between the corresponding second signal line and the first node and turned on or off dependent on the corresponding bit in the current output operation.

In the display apparatus, the bit weighing currents output from the plurality of current source circuits can be corrected based on the reference current. Therefore, even when the TFTs forming the current source circuit has considerable characteristic variation, variation in the signal current can be suppressed, and unevenness of emission luminance can be suppressed.

Particularly, the bit weighting current source further includes a dummy load, and a fifth field effect transistor turned on in a complementary manner when the fourth field effect transistor is turned off in the current output operation, for forming a current path including the dummy load, the first node and the first field effect transistor.

In the display apparatus, even when the bit weighting current is not output from the bit weighting current source, the current path including the first field effect transistor to which the current is to be output is formed by the dummy load. Therefore, variation in the gate voltage of the first field effect transistor held during the operation of writing reference current can be prevented, and the bit weighting current can be output with high accuracy.

Preferably, each of the plurality of current transmission circuits has first and second current source circuits; and each of the first and second current source circuits alternately execute a current writing operation in which an electrical state corresponding to a current flowing through the corresponding second signal line is held, and a current output operation supplying a current corresponding to the electrical state held in the current writing operation to the corresponding first signal line.

More preferably, each of the first and second current source circuits includes a first field effect transistor having its source and drain connected to a prescribed voltage and to a first node, respectively, and its gate connected to a second node, a second field effect transistor connecting the gate and drain of the first field effect transistor in the current writing operation, and a capacitance element connected to the second node to hold source-to-drain voltage of the first field effect transistor; and each of the plurality of current transmitting circuits includes an input switch circuit connecting the corresponding second signal line to the first node of one of the first and second current source circuits that performs the current writing operation, and an output switch circuit connecting the corresponding first signal line to the first node of the other one of the first and second current source circuits that performs the current output operation.

In the display apparatus, two current source circuits alternately execute the current writing operation in which a current is written from the corresponding second signal line and the current output operation in which the current written in the current writing operation is supplied to the corresponding first signal line, and thus, an efficient current transmitting circuit can be formed.

BRIEF DESCRIPTION OF THE DRAWINGS

FIG. 29 is a waveform diagram representing an operation sequence of the display apparatus in accordance with the tenth embodiment of the present invention.

BEST MODES FOR CARRYING OUT THE INVENTION

In the following, the display apparatus in accordance with embodiments of the present invention will be described in detail with reference to the figures.

First Embodiment

Figure 1:
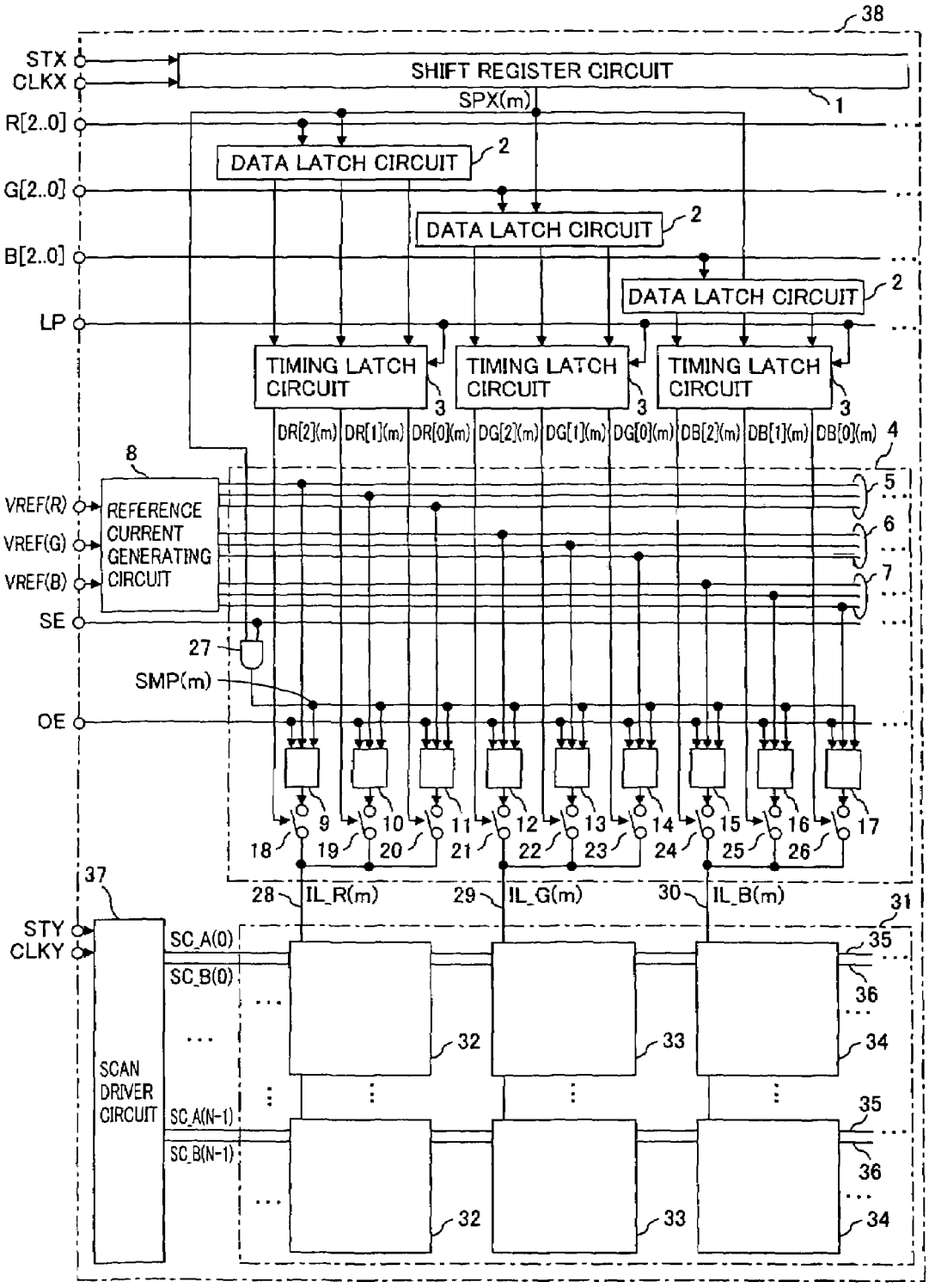
FIG. 1 is a block diagram representing a configuration of the display apparatus in accordance with a first embodiment of the present invention.

FIG. 1 is a block diagram representing a configuration of the display apparatus in accordance with a first embodiment. Here, an example will be described in which 512 colors are displayed by image data of 3-bits each for R (red), G (green) and B (Blue). The figure shows a configuration of one column (m-th column) of each of R, G and B, and the suffix m represents that the component corresponds to m-th RGB column (set of RGB columns) from the left.

Referring to FIG. 1, an organic EL panel 38 shown as a representative example of a display apparatus in accordance with the first embodiment includes a shift register circuit 1, data latch circuits 2, timing latch circuits 3, a signal line driving circuit 4, a reference current generating circuit 8, a pixel matrix 31 and a scan driver circuit 37.

Data latch circuits 2 latch input image data R[2..0], G[2..0] and B[2..0] in response to a shift pulse output from shift register circuit 1. Timing latch circuits 3 latch the image data latched by data latch circuits 2 in response to a latch pulse LP, to obtain line sequential image data. Signal line driving circuit 4 drives signal lines of pixel matrix circuit 31.

Signal line driving circuit 4 includes a reference current line 5 for supplying a bit weighted reference current for R, a reference current line 6 for supplying a bit weighted reference current for G, and a reference current line 7 for supplying a bit weighted reference current for B. As each color corresponds to 3 bits in this example, the reference current lines 5 to 7 corresponding to respective colors each include three lines. Reference current generating circuit 8 generates reference currents for R, G and B mentioned above, which currents are supplied to reference current lines 5 to 7.

Signal line driving circuit 4 further includes bit weighting current source circuits 9 to 11 for R generating most significant to least significant bit weighting currents for R, bit weighting current source circuits 12 to 14 for G generating most significant to least significant bit weighting currents for G, and bit weighting current source circuits 15 to 17 for B generating most significant to least significant bit weighting currents for B. Signal line driving circuit 4 further includes switch circuits 18 to 20 provided corresponding to bit weighting current source circuits 9 to 11 for R, switch circuits 21 to 23 provided corresponding to bit weighting current source circuits 12 to 14 for G, and switch circuits 24 to 26 provided corresponding to bit weighting current source circuits 15 to 17 for B, and an AND circuit 27.

Switch circuits 18 to 20 switch output currents of bit weighting current source circuits 9 to 11 for R, in accordance with output image data DR[2](m) to DR[0](m). Switch circuits 21 to 23 switch output currents of bit weighting current source circuits 12 to 14 for G, in accordance with output image data DG[2](m) to DG[0](m). Switch circuits 24 to 26 switch output currents of bit weighting current source circuits 15 to 17 for B, in accordance with output image data DB[2](m) to DB[0](m). AND circuit 27 generates a sampling signal SMP(m) instructing sampling (writing) of a reference current to the bit weighting current source circuits, based on a sampling enable signal SE and a shift pulse SPX(m).

Pixel matrix circuit 31 includes signal lines 28 to 30 for supplying signal currents IL_R(m), IL_G(m) and IL_B(m) of respective colors output from signal line driving circuit 4 to pixel matrix circuit 31, an R pixel circuit 32, a G pixel circuit 33, a B pixel circuit 34, and first and second scan lines 35 and 36 for scanning respective pixels corresponding to one row. The first and second scan lines 35 and 36 are provided for each row of pixels. Various circuits described above forming organic EL panel 38 are assumed to be implemented by low temperature polysilicon TFTs (low temperature p-Si TFTs) formed on a glass substrate.

The operation of organic EL panel 38 will be described in the following.

First, shift register circuit 1 outputs, in response to a start pulse STX and a shift clock CLKX, input from an external control circuit (not shown), shift pulses SPX(0)m SPX(1), . . . , SPX(m), . . . successively. To data latch circuits 2, RGB image data R[2..0], G[2..0] and B[2..0] are input from the external control circuit (not shown), and successively latched starting from the leftmost data, in response to the shift pulses mentioned above.

FIG. 1 shows as a representative the configuration of an m-th RGB column from the left end, and therefore, the RGB image data of the m-th RGB set are latched at a prescribed timing in response to the shift pulse SPX(m). After the RGB image data of one row are latched by data latch circuits 2, output data from respective data latch circuits 2 are latched by timing latch circuits 3 in response to a common latch pulse LP, and input as line sequential image data to signal line driving circuit 4. FIG. 1 shows, as representative examples, image data corresponding to the m-th RGB set, that is, DR[2](m), DR[1](m), DR[0](m), DG[2](m), DG[1](m), DG[0](m), and DB[2](m), DB[1](m), DB[0](m), among the line sequential image data provided by timing latch circuits 3.

Signal line driving circuit 4 successively supplies the bit weighted reference current for R to bit weighting current source circuits 9 to 11 for R, through reference current line 5 for R provided common to respective R columns. Similarly, bit weighted reference currents for G and B are successively supplied to bit weighting current source circuits 12 to 14 for G and bit weighting current source circuits 15 to 17 for B, through reference current line 6 for G and reference current line 7 for B, respectively.

Figure 2:
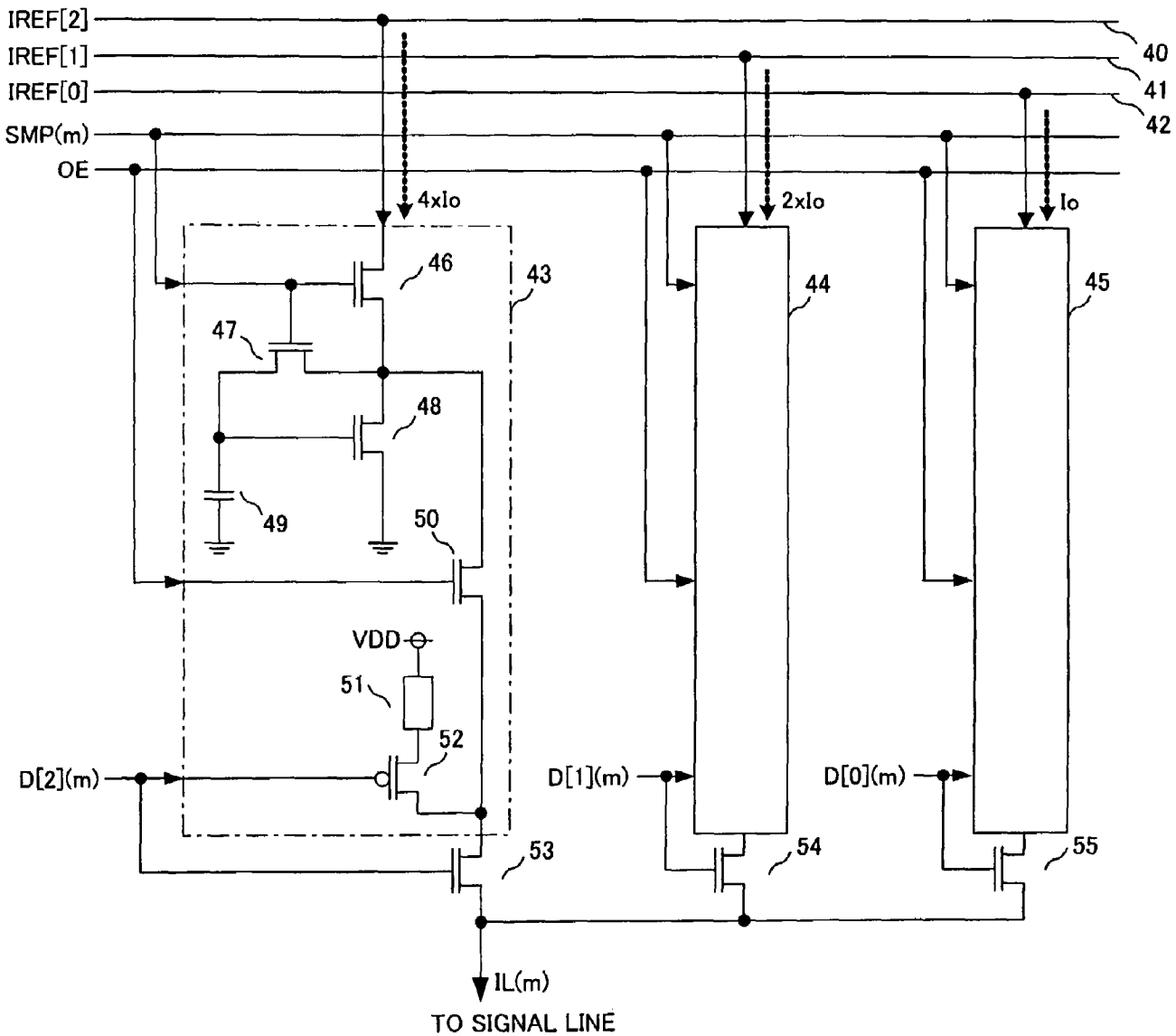
FIG. 2 is a circuit diagram representing a configuration of a bit weighting current source of the display apparatus in accordance with the first embodiment of the present invention.

FIG. 2 shows the configuration of each of bit weighting current source circuits 9 to 11, 12 to 14 and 15 to 17. For general description for each color, suffixes R, G and B are omitted in FIG. 2.

Reference current lines 40 to 42 shown in FIG. 2 supply weighted reference currents to most significant to least significant bits, respectively. Specifically, reference current lines 40 to 42 correspond to reference current lines 5 to 7 for R, G and B shown in FIG. 1. Bit weighting current source circuits 43 to 45 correspond to the most significant to least significant bits, respectively. Specifically, bit weighting current source circuits 43 to 45 correspond to respective ones of bit weighting current source circuits 9 to 11, bit weighting current source circuits 12 to 14 and bit weighting current source circuits 15 to 17. Though the configuration of bit weighting current source circuit 43 of the most significant bit only is shown as a representative in FIG. 2, the bit weighting current source circuits have the same configuration. Each bit weighting current source circuit includes n-type TFTs 46 to 48, 50, a capacitor (capacitance element) 49, a dummy load 51 and a p-type TFT 52.

As shown in FIG. 2, n-type TFTs 46 of bit weighting current source circuits 43 to 45 have their drains connected to reference current lines 40 to 42, respectively, and have their sources connected to the drains of n-type TFTs 47, 48 and to the source of n-type TFT 50. To the source of n-type TFT 47, the gate of n-type TFT 48 and one end of capacitor 49 for holding the gate voltage thereof are connected. The other end of capacitor 49 is grounded. The source of n-type TFT 48 is grounded. Further, the drain of n-type TFT 50 is connected to the drain of p-type TFT 52 and to the source of n-type TFT 53, and between the source of p-type TFT 52 and a power supply voltage VDD, dummy load 51 is connected.

Sampling signal SMP(m) is input to the gates of n-type TFTs 46 and 47, and is controlled such that n-type TFTs 46 and 47 are conducted when the signal is active. Therefore, when the sampling signal SMP(m) is active, from reference current lines 40 to 42 to bit weighting current source circuits 43 to 45, corresponding bit weighting reference currents IREF[2], IREF[1] and IREF[0] are supplied, respectively through n-type TFT 46. In this manner, n-type TFTs 46 and 47 operate as switches that control writing of the reference current to the bit weighting current source circuit in response to the sampling signal SMP(m).

Output enable signal OE is input to the gate of n-type TFT 50, and is controlled such that n-type TFT 50 is rendered conductive when the signal is active. Therefore, when the output enable signal OE is active, a current pulling path is formed by n-type TFT 48. In this manner, n-type TFT 50 operates to control the output of the bit weighting current source circuit.

Further, sources of n-type TFTs 53 to 55 are connected to output ends of bit weighting current source circuits 43 to 45, respectively. Further, drains of n-type TFTs 53 to 55 are connected together, and the node thereof is connected to the signal line. Corresponding bits D[2](m), D[1](m) and D[0](m) are input to the gates of n-type TFTs 53 to 55.

Bit weighting current source circuits 43 to 45 alternately repeat a reference current writing operation and a bit weighting current output operation. First, at the time of reference current writing operation, the sampling signal SMP(m) is at the active level ("H" level), and in the bit weighting current source circuit 43 for the most significant bit, for example, n-type TFTs 46 and 47 are rendered conductive, and a bit weighting reference current 4×Io (four times the prescribed current Io) corresponding to the most significant bit supplied from reference current line 40 is caused to flow through n-type TFT 46 to n-type TFT 48. At this time, as the n-type TFT 47 is conductive, n-type TFT 48 is diode-connected, and the gate voltage when the reference current flows through n-type TFT 48 is held by capacitor 49. In the reference current writing operation, the output enable signal OE is at an inactive level ("L" level), and n-type TFT 50 is shut off.

Similarly, in bit weighting current source circuit 44 for the second bit and bit weighting current source circuit 45 for the least significant bit, corresponding bit weighting reference currents 2×Io (two times the prescribed current Io) and Io are written through reference current lines 41 and 42, respectively.

In the bit weighting current output operation, the sampling signal SMP(m) is at the inactive level ("L" level), and n-type TFTs 46 and 47 are shut off. The output enable signal OE is at the active level ("H" level), and n-type TFT 50 is rendered conductive. At this time, n-type TFT 48 causes a current corresponding to the gate voltage held by capacitor 49 in the reference current writing operation to flow through the drain-source. Specifically, n-type TFT 48 tends to pull in a constant current 4×Io1 (four times the current Io1), which is approximately equal to the reference current written in the reference current writing operation, from the drain. At this time point, when the corresponding bit D[2](m) of the image data from timing latch circuit 32 is "1", n-type TFT 53 is rendered conductive, and n-type TFT 48 pulls the bit weighting current 4×Io1 from the corresponding signal line, through n-type TFTs 50, 53.

When the corresponding bit D[2](m) of the image data is "0", n-type TFT 53 is shut off and no current is pulled from the corresponding signal line. At this time, when the pulling current path of n-type TFT 48 is shut off, the drain potential of n-type TFT 48 lowers, and the charges held by capacitor 49 leak through n-type TFTs 47 and 48. This means that the gate voltage of n-type TFT 48 lowers gradually and the pulling current (drain-source current) lowers. Thus, it follows that the signal line driving current pulled in from the corresponding signal line decreases gradually, resulting in unevenness of display.

Therefore, in each bit weighting current source circuit, p-type TFT 52 and dummy load 51 are provided. The source of p-type TFT 52 is connected through dummy load 51 to power supply VDD. Because of this configuration, as the drain of n-type TFT 48 is connected through n-type TFTs 50, 52 and dummy load 51 to power supply VDD even when the bit D[2](m) of the image data is "0", current flows through n-type TFT 48, and pulling current path is not shut off. As a result, gradual decrease of the gate potential of n-type TFT 48 caused by leakage of charges from capacitor 49 can be prevented.

Similarly, in the bit weighting current output operation, in bit weighting current source circuit 44 for the second bit and the bit weighting current source circuit 45 for the least significant bit, bit weighting currents 2×Io1 and Io1 are pulled from the signal line, through n-type TFTs 54 and 55, when the corresponding bits D[1](m) and D[0](m) of the image data are "1", respectively.

In this manner, the reference current written by the reference current common to respective RGB columns comes to be reproduced by n-type TFT 48, in the bit weighting current output operation. The n-type TFT 48 is a driving TFT that drives a signal line connected to the succeeding stage thereof.

Here, one end (source) of n-type TFTs 53 to 55 is connected to output ends of bit weighting current source circuits 43 to 45. The n-type TFTs 53 to 55 have the other end (drains) connected together, and the common connection node is connected to the signal line. Specifically, n-type TFTs 53 to 55 add bit weighting currents 4×Io1, 2×Io1 and Io1 of respective bit weighting current sources, by switching and outputting the same, corresponding to the bit of the image data, to generate the signal line driving current.

Here, the signal line driving current IL(m) generally representing the signal currents IL_R(m), IL_G(m) and IL_B(m) of respective colors can be represented as IL(m)={2^(bn−1)×D[bn−1](m)+2^(bn−2)×D[bn−2](m)+ . . . +2×D[1](m)+D[0](m)}×Io1.

In the equation above, bn represents the number of bits of the image data. In the first embodiment, an example of 3 bits is described, and therefore, bn=3, and, the signal line driving current converted to an analogue signal of 8 levels can be obtained for each color.

The n-type TFTs 53 to 55 shown in FIG. 2 respectively correspond to switch circuits 18 to 20 connected in the succeeding stage (output end) of bit weighting current source circuits 9 to 11 for R, switch circuits 21 to 23 connected in the succeeding stage (output end) of bit weighting current source circuits 12 to 14 for G and switch circuits 24 to 26 connected in the succeeding stage (output end) of bit weighting current source circuits 15 to 17 for B.

Next, R, G and B pixel circuits 32, 33 and 34 will be described. A pixel circuit of a display apparatus using the organic EL as a light emitting element has been known, for example, from "A 13.0-inch AM-OLED Display with Top Emitting Structure and Adaptive Current Mode Programmed Pixel Circuit (TAC), Tatsuya Sasaoka et al., SID 01 DIGEST pp. 384-386." A similar pixel circuit may be used in the first embodiment.

Figure 3A:
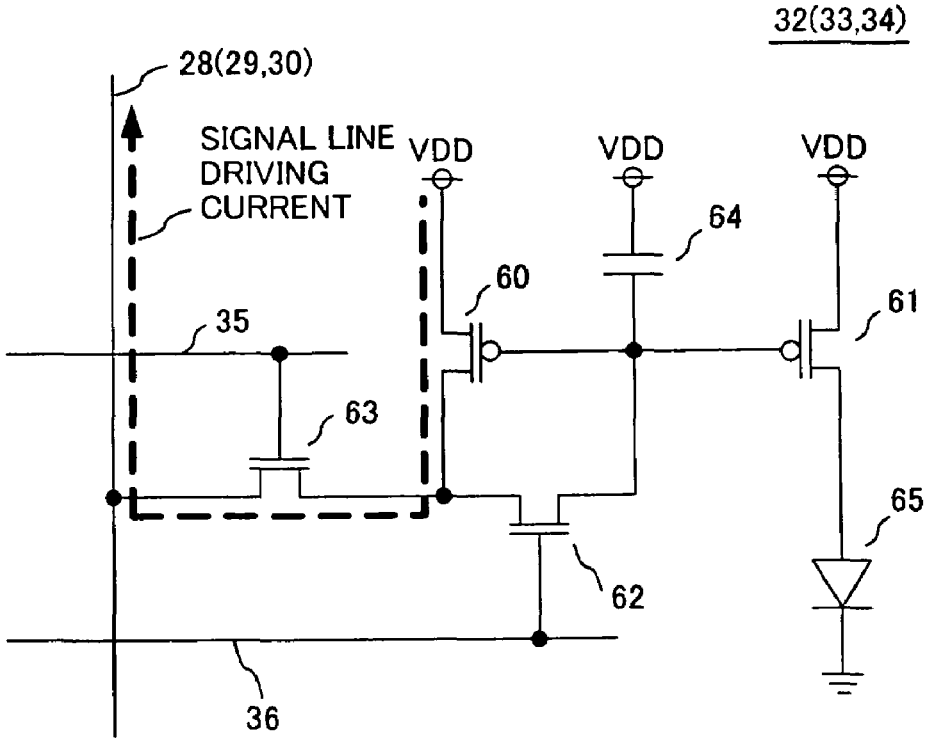
FIGS. 3A and 3B are circuit diagrams representing exemplary configurations of the pixel circuit of the display apparatus in accordance with the first embodiment of the present invention.

FIG. 3A is a circuit diagram representing an exemplary configuration of pixel circuits 32 to 34. Referring to FIG. 3A, each of the pixel circuits 32 to 34 includes p-type TFTs 60, 61, n-type TFTs 62, 63, a capacitor 64, and an organic EL light emitting diode (OLED: Organic Light Emitting Diode) 65. In a writing operation through corresponding signal lines 28 to 30, when the second scan line 36 is at the "H" level, the first scan line 35 attains to the "H" level, and through the corresponding signal line, the signal line driving current is pulled by signal line driving circuit 4. The gate potential corresponding to the signal line driving current flowing through p-type TFT 60 at this time is held by capacitor 64.

In an operation of driving the organic EL light emitting diode, when the second scan line 36 attains to the "L" level and thereafter the first scan line 35 attains to the "L" level, p-type TFTs 60 and 61 form a current mirror circuit as they have their gates connected to each other, and the current corresponding to the gate potential held by capacitor 64 flows between the source-drain of p-type TFT 61. As the drain of p-type TFT 61 is connected to the anode of organic EL light emitting diode 65, the source-drain current of p-type TFT 61 serves as the driving current of organic EL light emitting diode 65. Thus, organic EL light emitting diode 65 emits light with the intensity corresponding to the driving current.

As the gate voltage of p-type TFT 61 is held by capacitor 64, the same driving current continuously flows through organic EL light emitting diode 65 until the first and second scan lines 35 and 36 are scanned again in the next frame period, and organic EL light emitting diode 65 emits light as driven by the driving current.

By setting only the second scan line 36 to the "H" level, emission of organic EL light emitting diode 65 can be stopped. The reason is as follows. When only the second scan line 36 is set to the "H" level, charges that have been held by capacitor 64 leak through n-type TFT 62 and p-type TFT 60, whereby the gate potential of TFT 61 increases and p-type TFT 61 is shut off, and hence supply of the driving current to organic EL light emitting diode 65 is stopped.

Figure 3B:
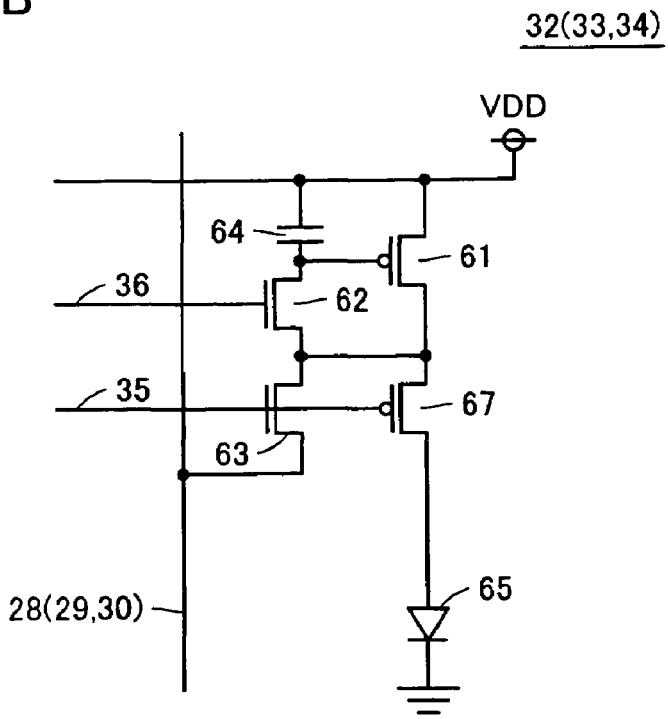

FIG. 3B is a circuit diagram representing another exemplary configuration of pixel circuits 32 to 34. Referring to FIG. 3B, each of the pixel circuits 32 to 34 includes p-type TFTs 61, 67, n-type TFTs 62, 63, a capacitor 64 and an organic EL light emitting diode 65. The p-type TFT 67 is connected between the drain of p-type TFT 61 and the anode of organic EL light emitting diode 65. The n-type TFTs 62 and 63 are connected in series between the gate of p-type TFT 61 and the corresponding signal lines 28 to 30. A connection node between n-type TFTs 62 and 63 and a connection node between p-type TFTs 61 and 67 are connected to each other.

Similar to the pixel circuit shown in FIG. 3A, the gates of n-type TFTs 62 and 63 are connected to the first and second scan lines 35 and 36, respectively, and capacitor 64 is connected between the gate of p-type TFT 61 and the power supply VDD. Further, similar to the gate of n-type TFT 63, the gate of p-type TFT 67 is connected to the first scan line 35.

In a writing operation through corresponding signal lines 28 to 30, when the first and second scan lines 35 and 36 are both at the "H" level, the signal driving current is pulled by signal line driving circuit 4, through the corresponding signal line. The signal line driving current passes through p-type TFT 61 that comes to be diode-connected by the conduction of n-type TFT 62, and the gate potential of p-type TFT 61 at this time is held by capacitor 64.

In the operation of driving the organic EL light emitting diode, the first scan line 35 attains to the "L" level, the current corresponding to the gate potential held by capacitor 64 flows between the source-drain of p-type TFT 61, and this current serves as the driving current of organic EL light emitting diode 65.

As the gate voltage of p-type TFT 61 is held by capacitor 64, as in the pixel circuit shown in FIG. 3A, the same driving current continuously flows through organic EL light emitting diode 65 until the first and second scan lines 35 and 36 are scanned again in the next frame period, and organic EL light emitting diode 65 emits light as driven by the driving current.

Returning to FIG. 1, description of the operation of the display apparatus (organic EL panel 38) as a whole will be continued. As described above, signal line driving circuit 4 pulls currents from pixel circuits 32 to 34 through signal lines 28 to 30 as analog currents, which are obtained by D/A conversion (digital-analog conversion) of the image data corresponding to the pixels of the row as the object of scanning.

In the present embodiment, the direction of the signal line driving current is the direction of pulling with respect to signal line driving circuit 4. Application of the present invention, however, is not limited to such an example. Specifically, the operation of signal line driving circuit 4 may be described as driving the signal line to supply the signal current through the signal line to the pixel circuit, without limiting the direction of the current.

To scan driver circuit 37, a start pulse STY and a shift clock CLKY are input. Scan driver circuit 37 generates the shift pulse from the start pulse STY and the shift clock CLKY, and based on the shift pulse, generates driving pulses SC_A(0), . . . SC_A(N−1) for driving the first scan line 35 and driving pulses SC_B(0), . . . SC_B(N−1) for driving the second scan line 36, of each row, so as to successively scan the pixel circuits of each row.

Figure 4:
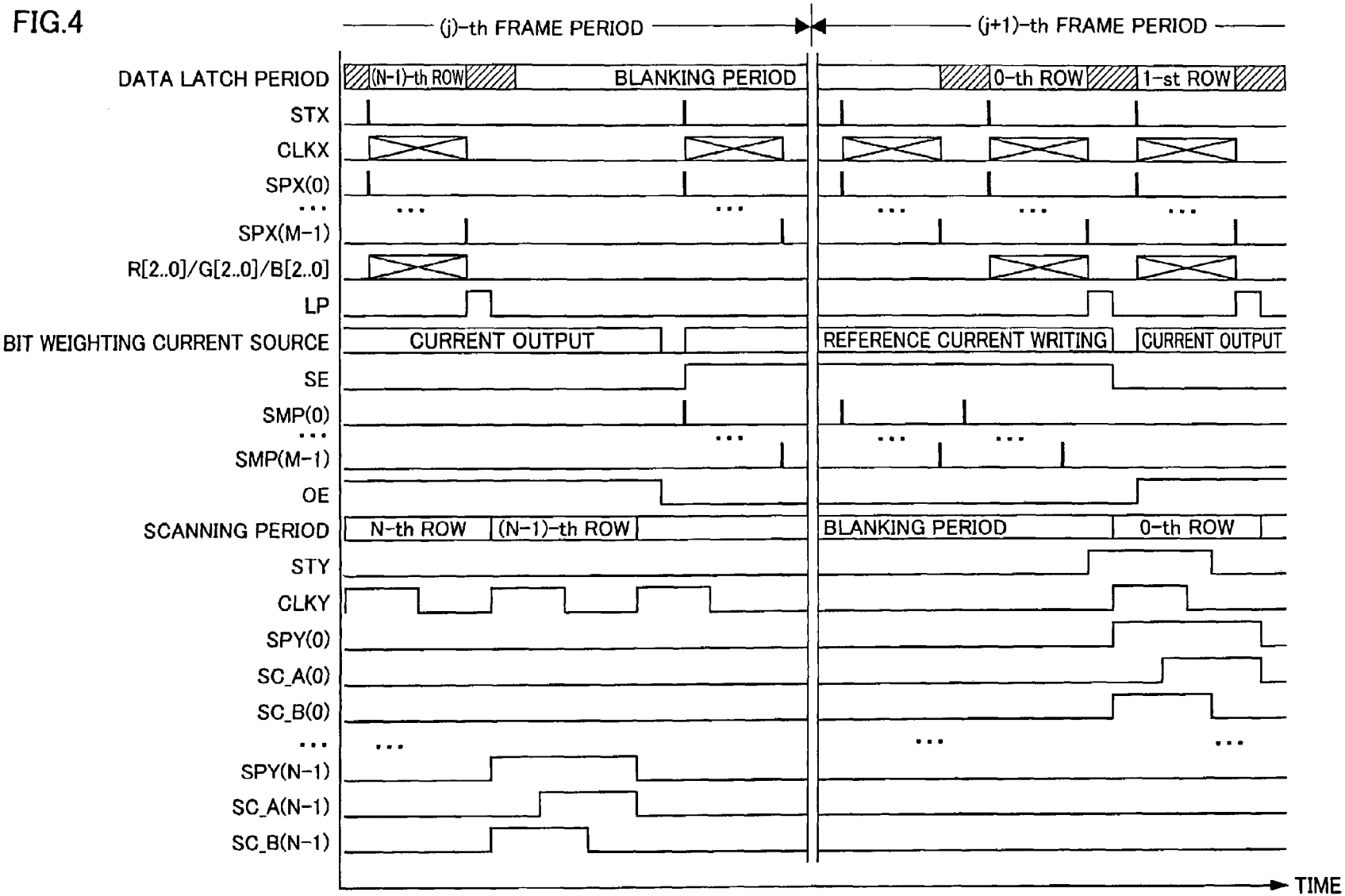
FIG. 4 is a waveform diagram representing an operation sequence of the display apparatus in accordance with the first embodiment of the present invention.

The driving sequence in accordance with the first embodiment will be described with reference to FIG. 4. FIG. 4 represents an operation from a latter part of a j-th frame period to a former part of a (j+1)-th frame period. It is assumed that the number of rows of the pixel matrix is N, and the number of columns is 3×M (M columns for each of R, G and B).

First, in the j-th frame period, to shift register circuit 1, the start pulse STX is input from the controller at the start of the data latch period of the 0-th row (staring row) to the (N−1)-th row (last row). Further, the shift clock CLKY is input from the controller to the shift register circuit 1 in the entire latch period of respective rows, and shift pulses SPY(0), SPX(1), SPX(2), . . . SPX(M−1) are successively output from shift register circuit 1.

Meanwhile, RGB image data R[2..0], G[2..0] and B[2..0] of the column of interest are input from the controller to be latched by data latch circuits 2 in response to the shift pulse SPX (generally denoting shift pulses SPX(0) to SPX(M−1)). After the image data of all columns×one row have been latched in the data latch period of each row, the latch pulse LP is input to timing latch circuits 3, and line-sequential image data of one row corresponding to respective columns are output from timing latch circuits 3.

The line-sequential image data are converted to analog current by signal line driving circuit 4, and supplied as the signal line driving current to the pixel circuit through the signal line. As the so-called line sequential driving takes place as described above, there is a lag of one horizontal period between the data latch period and the scanning period. In the period including the scanning period of the 0-th row (starting row) to the (N−1)-th row, the output enable signal OE is set to the "H" level (active level), so that the bit weighting current source circuit of signal line driving circuit 4 performs the operation of outputting the bit weighting current.

To scan driver circuit 37, the start pulse STY is input near the scanning period of the 0-th row, and in the entire scanning period, the shift clock CLKY is input. Based on the start pulse STY and the shift clock CLKY, shift pulses SPY(0), SPY(1), . . . , SPY(N−1) are successively generated in scan driver circuit 37 in respective scanning periods. Based on the shift pulse SPY (generally denoting shift pulses SPY(0) to SPY (N−1)) generated in this manner, driving pulses SC_A(0), SC_B(0), . . . SC_A(N−1), SC_B(N−1) for the first and second scan lines 35 and 36 are successively generated, and the first and second scan lines 35 and 36 of each row of the pixel matrix are scanned at the prescribed timing. In this manner, the signal line driving current, that is the analog current obtained by converting the image data supplied to the signal lines of respective columns by signal driving circuit 4, is successively written to each pixel circuit. As described above, in the pixel circuit, the signal current based on the current supplied from the signal line flows through organic EL light emitting diode 65, so that light is emitted.

There is a scan blanking period between the scanning period of each frame, and as shown in FIG. 4, after the end of scanning of the (N−1)-th row (last row), the sampling enable signal SE is rendered active ("H" level). In response, an AND (logical product) of the corresponding shift pulse SPX and the sampling enable signal SE is obtained for each column by AND circuit 27, and the sampling signal SMP of the corresponding column is rendered active ("H" level). Consequently, in signal line driving circuit 4, the reference current is written from reference current lines 5 to 7 to the bit weighting current source circuit of the corresponding column. In this manner, the sampling signal SMP is rendered active successively on the basis of RGB column unit, and the reference current is written.

Here, in a prescribed period in the scanning blanking period, the shift pulse SPX is generated by shift register circuit 1, and the sampling enable signal SE is rendered active, so that the reference current is supplied a prescribed number of times, that is, several to several tens of times, to the bit weighting current source circuit for each column of R, G and B, whereby the bit weighting current output from the bit weighting current source circuit is corrected. In this manner, shift register circuit is operated even in the scanning blanking period, and the sampling signal for writing the reference current to the bit weighting current source circuit is generated based on the shift pulse.

It is noted that when the reference current, particularly of a lower bit, is small, the reference current may be consumed for charging the line capacitance and the capacitor 49, and it takes long time until the reference current of a prescribed value flows through the n-type TFT 48. Therefore, the present embodiment is adapted such that the reference current is written a prescribed number of times, for each column of R, G and B. If it is the case that the reference current of every bit can be written to n-type TFT 48 by one sampling, it is unnecessary to perform sampling a plurality of times.

Further, for the operation of writing the reference current, shift register circuit 1 is operated at the same timing as the scanning period and the sampling signal SMP is generated. It is noted, however, that the start pulse STX and the shift clock CLKX may be set at arbitrary timings in the operation of writing the reference current. By way of example, when the reference current of a lower bit is small and a period of generation of the shift pulse SPX longer than usual is desired, the start pulse STX and the shift clock CLKX may be input such that the period of generation of the shift pulse SPX is made longer, at the operation of writing the reference current.

Figure 5:
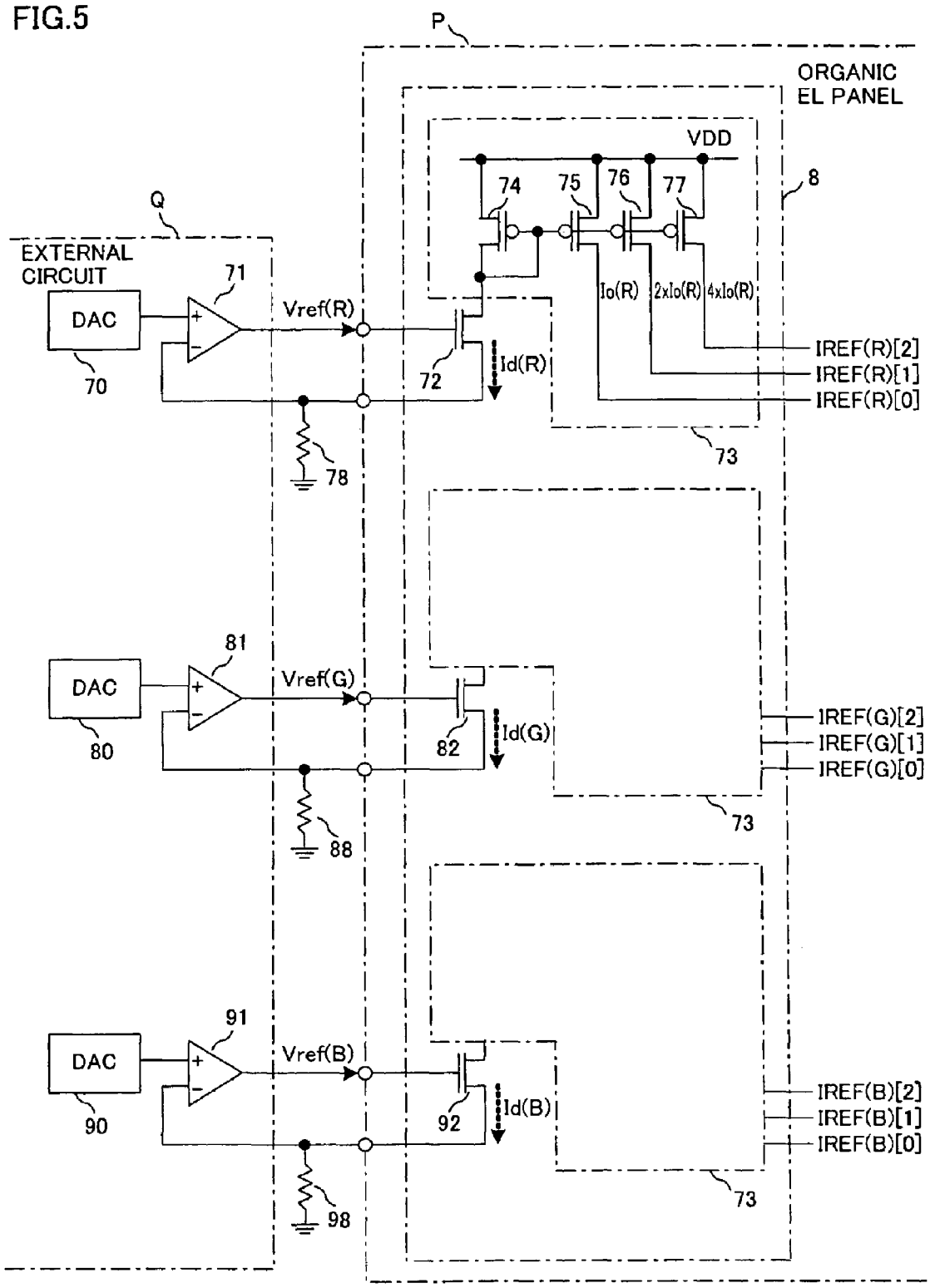
FIG. 5 is a circuit diagram representing configurations of a reference current generating circuit and an external circuit for generating the reference current, in the display apparatus in accordance with the first embodiment of the present invention.

Next, reference current generating circuit 8 will be described. FIG. 5 is a circuit diagram representing configurations of reference current generating circuit 8 and the external circuit for generating a reference current. The reference character P on the right side of FIG. 5 represents the side of the organic EL panel, and the reference character Q on the left side represents the side of the external circuit.

By way of example, bit weighting reference currents IREF (R) [0] to IREF(R) [2] for R are generated in the following manner. A D/A converting circuit (DAC:D/A converter) 70 provided outside the organic EL panel is controlled by a controller, and generates a prescribed voltage Vref (R). The reference voltage Vref (R) generated by D/A converting circuit 70 is input to a non-inversion input of a differential amplifier 71. An output of differential amplifier 71 is input to the organic EL panel, and input to the gate of n-type TFT 72. The source of n-type TFT 72 is grounded through a current setting resistance 78 provided outside the organic EL panel. Further, the source of n-type TFT 72 is also connected to an inversion input of differential amplifier 71. By this arrangement, differential amplifier 71, n-type TFT 72 and current setting resistance 78 form a constant current source.

The drain current Id(R) of n-type TFT 72 is given by the equation Id(R)=Vref (R)/Rext(R), where Rext(R) represents resistance value of current setting resistance 78.

The drain current Id(R) of n-type TFT 72 becomes the original current of bit weighting reference currents IREF(R) [0] to IREF(R) [2], converted by a current mirror circuit 73 formed by p-type TFTs 74 to 77, and output (pushed out) as bit weighting reference currents IREF(R) [0] to IREF(R) [2] having the magnitude of 4×Io(R), 2×Io(R) and Io(R), respectively. The current ratio of current mirror circuit 73 is set, by way of example, by making constant the gate length L and by setting the gate width W of p-type TFTs 74 to 77. Specifically, the current ratio can be set by determining the ratio of transistor size (W/L) of p-type TFTs 74 to 77.

The bit weighting reference currents IREF(G) [0] to IREF (G) [2] for G and IREF(B) [0] to IREF(B) [2] for B can also be obtained in the similar manner, by converting, using current mirror circuit 73, the original currents Id(G) and Id(B) generated from the constant current source formed by differential amplifiers 81, 91, n-type TFTs 82, 92, and current setting resistances 88, 99, respectively.

Though current mirror circuits 73 having the same configuration are used for R, G and B here, the current-emission characteristic of the organic EL light emitting element may differ color by color. Therefore, the W ratio of p-type TFTs 74 to 77 forming the current mirror circuit 73 may desirably be adjusted color by color, so as to output the bit weighting reference current reflecting the different characteristic. Further, as in a general semiconductor circuit, a TFT or TFTs may appropriately be added to improve characteristic of the constant current.

Though the magnitude of reference current is set by external current setting resistances 78, 88 and 98, the reference current may be a small current of a few μA or smaller dependent on the characteristic of the organic EL light emitting element, and therefore, it tends to be influenced by external noise, as high-impedance line from the organic EL panel becomes long. Therefore, in order to lower the line impedance, the ratio of gate width W of p-type TFTs 74 to 77 should desirably be set such that the original current is made larger than the reference current.

In this manner, by independently adjusting output voltages Vref (R), Vref (G) and Vref (B) of D/A converting circuits 70, 80 and 90, the ratio and magnitude of reference currents for R, G and B can be adjusted. Thus, white balance adjustment and luminance adjustment of the display can be controlled by the controller.

Next, the operation at the time of power-on and activation of organic EL panel 38 will be described.

In the bit weighting current source circuit described with reference to FIG. 2, at the time of activation such as power-on, the line capacitance and holding capacitor 49 are not at all charged, and therefore, at the time of activation, the line capacitance and capacitor 49 must be charged from this state, by writing the bit weighting reference current. Therefore, particularly in the bit weighting current source circuit of a lower bit, of which bit weighting reference current is small, it takes time for the gate voltage of n-type TFT 48 for driving to attain a prescribed level corresponding to the desired bit weighting reference current.

If a display is given in this transitional time period at power-on, it would take much time until a prescribed current flows through the organic EL light emitting element and the image is displayed at a prescribed luminance. Thus, in an extreme case, an image appears slowly and gradually.

In view of the foregoing, the operation is adapted such that when the power of organic EL panel 38 is turned on, after a prescribed wait time until the power supply becomes stable and the output current of reference current generating circuit 8 becomes stable, once an operation for raising the bit weighting current source is started.

In the operation for raising the bit weighting current source, the start pulse STX and shift clock CLKY are input, shift register circuit 1 is operated, and shift pulses PSX(0) to SPX(M−1) are obtained. Then, the sampling enable signal SE is rendered active, and the bit weighting reference current is successively supplied to the bit weighting current source of each column, to perform correction. The correcting operation is repeated a prescribed number of times, until the gate voltage of driving TFT 48 attains to a prescribed value. During this period, the data latch and scanning operations are not performed, and the image display is prohibited.

In this manner, in the operation of raising the bit weighting current source, it is possible to perform the correcting operation by writing the reference current to the bit weighting current source circuit, approximately over the entire operation period. Therefore, as compared with an example in which the blanking period only is used, the line capacitance and holding capacitor 49 can be charged quickly, and therefore, the time until the gate voltage of n-type TFT 48 for driving attains to the prescribed value can be reduced. Thus, smooth transition to image display is realized.

Figure 6:
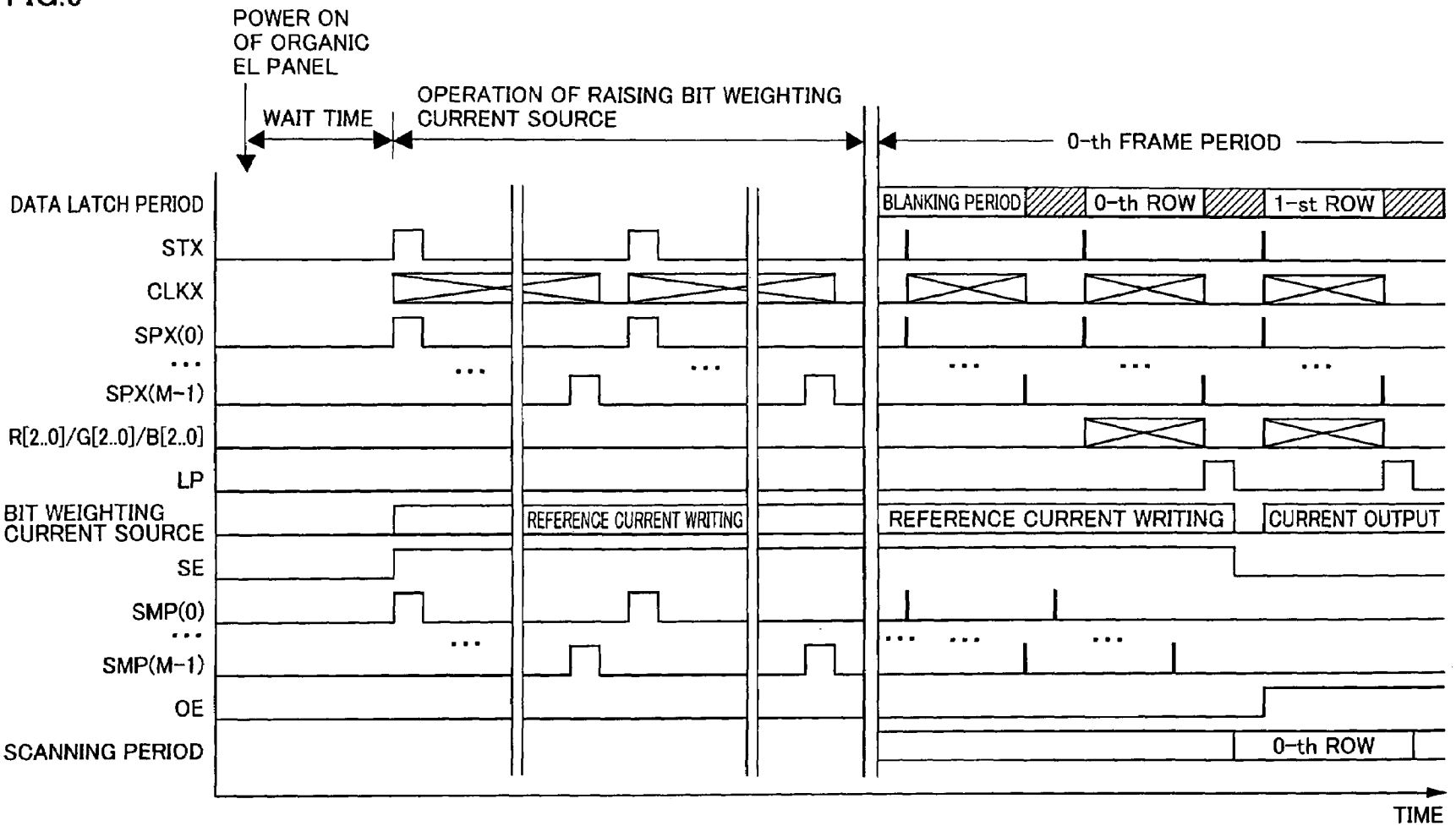
FIG. 6 is a waveform diagram representing an operation sequence at the time of activation of the display apparatus in accordance with the first embodiment of the present invention.

Further, as shown in FIG. 6, shift register circuit 1 is operated at a lower speed than in a usual display operation, so that the sampling time (time of writing the reference current) to each bit weighting current source circuit is set larger. At the time of actual sampling, not the entire active period of the sampling signal SMP can be used for writing the reference current, because of an influence of on-time of the TFT and the like. Accordingly, more effective writing of the reference current becomes possible by making longer one sampling time.

Though the reference current is written several times to each bit weighting current source at the time of raising the bit weighting current source in this example, it is unnecessary to repeat writing if one writing is sufficient to have the gate voltage of n-type TFT 48 for driving to attain the prescribed value.

As described above, in the first embodiment of the present invention, the output current of a bit weighting current source circuit is corrected by writing a bit weighted reference current, and the bit weighting currents output from the bit weighting current source circuit are switched and added in accordance with the bit data of the digital image, to be supplied to the signal line. Consequently, even when TFT characteristics vary widely, variation in the signal line driving current among columns (signal lines) can be suppressed, and therefore, unevenness in emission luminance can be suppressed.

Further, the number of signal lines can be reduced to one per one column, and therefore, application to a high resolution display with narrow pixel pitch becomes possible.

Second Embodiment

Figure 7:
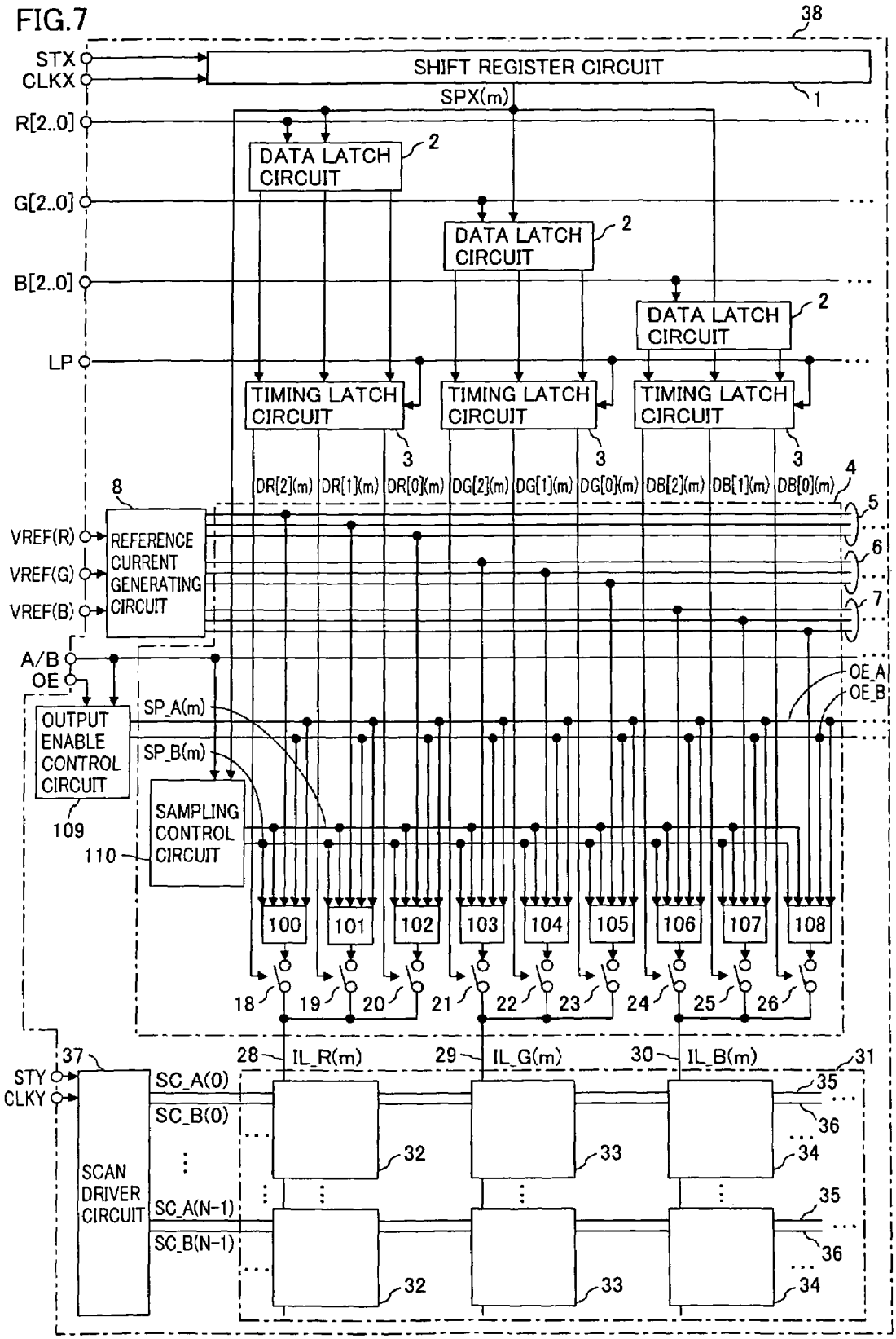
FIG. 7 is a block diagram representing a configuration of the display apparatus in accordance with a second embodiment of the present invention.

FIG. 7 is a block diagram representing a configuration of a display apparatus in accordance with a second embodiment of the present invention.

In the second embodiment, two bit weighting current source systems (system A/system B) are provided, and the operation of writing reference current and the operation of outputting the bit weighting current are performed in a complementary manner.

Referring to FIG. 7, in the second embodiment, a signal line driving circuit 4 includes, in place of bit weighting current source circuits 9 to 17 shown in FIG. 1, bit weighting current source circuits 100 to 108, each including two systems (system A/system B) of current sources. Bit weighting current source circuits 100 to 102 for R are provided in place of bit weighting current source circuits 9 to 11 for R shown in FIG. 1, bit weighting current source circuits 103 to 105 for G are provided in place of bit weighting current source circuits 12 to 14 for G shown in FIG. 1, and bit weighting current source circuits 106 to 108 for B are provided in place of bit weighting current source circuits 15 to 17 for B shown in FIG. 1.

In the second embodiment, an output enable control circuit 109 and a sampling control circuit 110 are further provided. Output enable control circuit 109 generates output enable signals OE_A and OE_B of the two systems (system A/system B), respectively, in response to the output enable signal OE and an operation mode identifying signal A/B. The operation mode identifying signal A/B is for alternately selecting system A or system B.

Sampling control circuit 110 is provided in signal line driving circuit 4, and generates sampling signals SP_A(m) and SP_B(m) of the two systems (system A/system B), respectively, in response to the operation mode identifying signal A/B and the shift pulse SPX(m). In FIG. 7, the same portions as in FIG. 1 are denoted by the same reference characters and description thereof will not be repeated.

Figure 8:
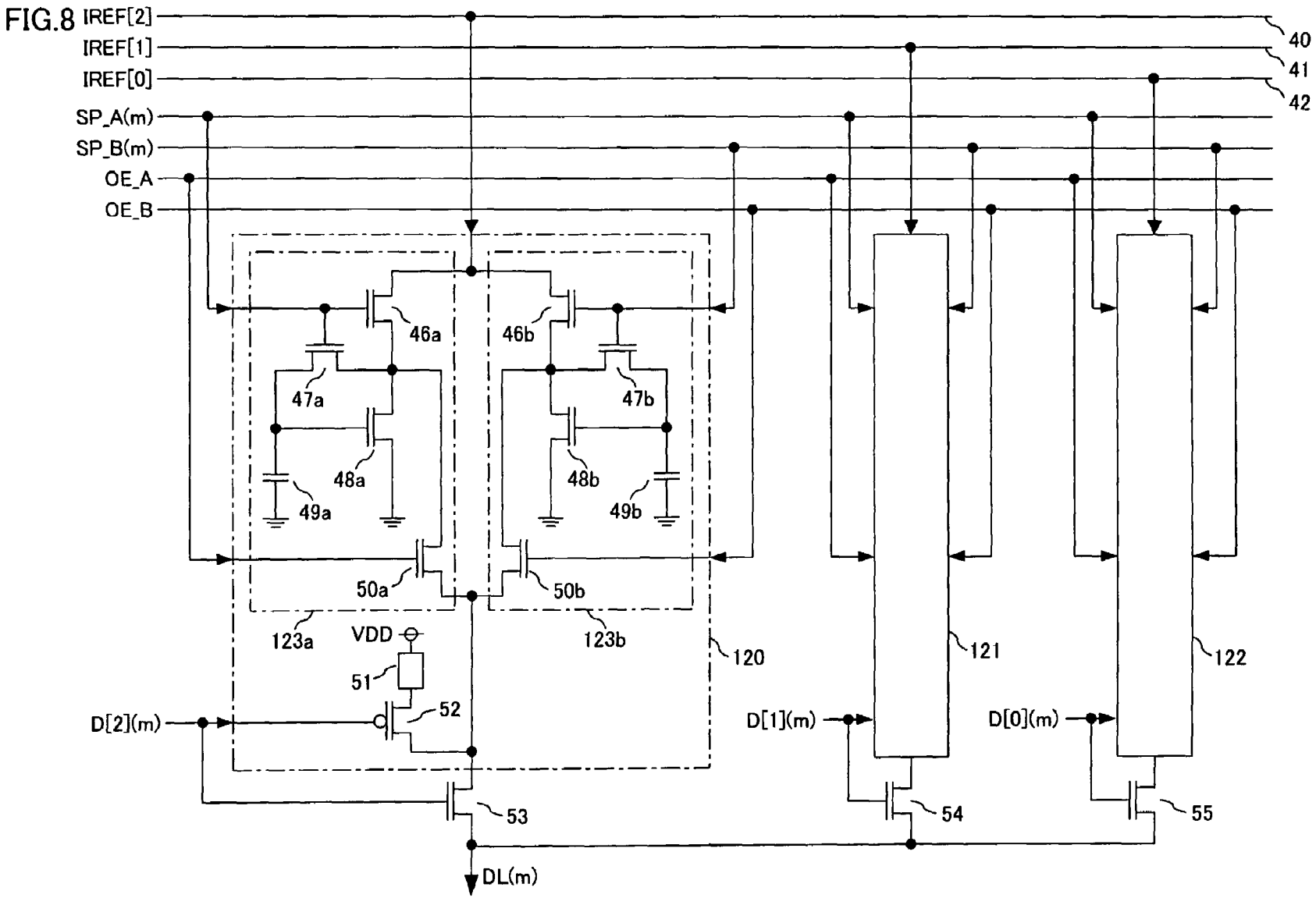
FIG. 8 is a circuit diagram representing a configuration of the bit weighting current source of the display apparatus in accordance with the second embodiment of the present invention.

FIG. 8 is a circuit diagram representing a configuration of bit weighting current source circuits 120 to 122 in accordance with the second embodiment. Referring to FIG. 8, bit weighting current source circuit 120 corresponds to bit weighting current source circuits 100, 103 and 106 for the most significant bit, among the bit weighting current source circuits for R, G and B shown in FIG. 7. Similarly, bit weighting current source circuit 121 corresponds to bit weighting current source circuits 101, 104 and 107 for the second bit shown in FIG. 7, and bit weighting current source circuit 122 corresponds to bit weighting current source circuits 102, 105 and 108 for the least significant bit shown in FIG. 7.

In FIG. 8, though only the bit weighting current source circuit 120 is shown as a representative, as in FIG. 2, the bit weighting current source circuits have the same configuration. Bit weighting current source circuit 120 includes a bit weighting current source 123*a* for system A, a bit weighting current source 123*b* for system B, a dummy load 51 and a p-type TFT 52. Bit weighting current source 123*a* for system A has n-type TFTs 46*a* to 48*a*, 50*a* and a capacitor 49*a*. Bit weighting current source 123*b* for system B has n-type TFTs 46*b* to 48*b*, 50*b* and a capacitor 49*b*.

In each of bit weighting current source circuits 120 to 122, the drain of n-type TFT 46*a* in bit weighting current source 123*a* for system A and the drain of n-type TFT 46*b* in bit weighting current source 123*b* for system B are commonly connected to corresponding reference current lines 40 to 42, respectively.

To the gates of n-type TFTs 46*a* and 47*a* used for controlling writing of reference current to bit weighting current source 123*a* for system A, the sampling signal SP_A(m) is applied. To the gates of n-type TFTs 46*b* and 47*b* used for controlling writing of reference current to bit weighting current source 123*b* for system B, the sampling signal SP_B (m) is applied.

Further, to the gate of n-type TFT 50*a* used for controlling output of bit weighting current source 123*a*, the output enable signal OE_A is applied, and to the gate of n-type TFT 50*b* used for controlling output of bit weighting current source 123*b*, the output enable signal OE_B is applied. The drains of n-type TFTs 50*a* and 50*b* are connected to the source of n-type TFT 53 and to dummy load 51 through p-type TFT 52. Other configurations of bit weighting current source circuits 120 to 122 are the same as those of 43 to 45 described with reference to the first embodiment, and therefore, detailed description thereof will not be repeated.

Bit weighting current source 123*a* for system A and bit weighting current source 123*b* for system B alternately repeat the operation of writing reference current and the operation of outputting bit weighting current similar to those of the first embodiment in a complementary manner, such that when one system performs the operation of writing reference current, the other system performs the operation of outputting the current.

When bit weighting current source circuit 123*a* for system A is performing the operation of writing the reference current, the sampling signal SP_A(m) is at the active level ("H" level), in the bit weighting current source circuits 100, 103 and 106 for the most significant bit, for example, n-type TFTs 46*a* and 47*a* are rendered conductive as in the first embodiment, and the bit weighting reference current 4×Io for the most significant bit supplied from reference current line 40 for that bit flows to n-type TFT 48*a* through n-type TFT 46*a*. At this time, as n-type TFT 47*a* is conductive, n-type TFT 48*a* comes to be diode-connected, and the gate voltage when the reference current flows to n-type TFT 48*a* is held by capacitor 49*a*. Further, the output enable signal OE_A is at the inactive level ("L" level), and n-type TFT 50*a* is shut off.

Similarly, when bit weighting current source circuit 123*b* for system B is performing the operation of writing the reference current, the sampling signal SP_B(m) is at the active level ("H" level), and in the bit weighting current source circuits 100, 103 and 106 for the most significant bit, for example, the bit weighting reference current 4×Io for the most significant bit supplied from reference current line 40 for that bit flows to n-type TFT 48*b* through n-type TFT 46*b*. Further, the output enable signal OE_B is at the inactive level ("L" level), and n-type TFT 50*b* is shut off.

In this manner, the bit weighting reference current 4×Io for the most significant bit is written to either one of bit weighting current source 123*a* for system A and bit weighting current source 123*b* for system B.

Similarly, in bit weighting current source circuit 121 for the second bit and bit weighting current source circuit 122 for the least significant bit, the bit weighting reference currents 2×Io and Io for the second bit and the least significant bit are written to either one of bit weighting current source 123*a* for system A and bit weighting current source 123*b* for system B.

When bit weighting current source 123*a* for system A is performing the operation of outputting the bit weighting reference current, the sampling signal SP_A(m) is at the inactive level ("L" level), and n-type TFTs 46*a* and 47*a* are shut off. On the other hand, output enable signal OE_A is at the active level ("H" level), and n-type TFT 50*a* is rendered conductive. At this time, as in the first embodiment, n-type TFT 48*a* causes a current corresponding to the gate voltage held by capacitor 49*a* during the operation of writing the reference current to flow between the drain and the source. Specifically, a constant current 4×Io1 that is approximately the same as the reference current written in the reference current writing operation is to be pulled in through the drain. At this time, if the bit D[2] (m) of the corresponding image data from data latch circuit 2 is "1", n-type TFT 53 is rendered conductive, and n-type TFT 48*a* pulls in the bit weighting current 4×Io1 from the signal line, through n-type TFTs 50*a* and 53.

Similarly, when bit weighting current source 123*b* for system B is performing the operation of outputting the bit weighting reference current, the sampling signal SP_B(m) is at the inactive level ("L" level), and n-type TFTs 46*b* and 47*b* are shut off. On the other hand, output enable signal OE_B is at the active level ("H" level), and n-type TFT 50*b* is rendered conductive. At this time, n-type TFT 48*b* causes a current corresponding to the gate voltage held by capacitor 49*b* during the operation of writing the reference current to flow between the drain and the source. Specifically, a constant current 4×Io1 that is approximately the same as the reference current written in the reference current writing operation is to be pulled through the drain. At this time, if the bit D[2] (m) of the corresponding image data from data latch circuit 2 is "1", n-type TFT 53 is rendered conductive, and n-type TFT 48*b* pulls the bit weighting current 4×Io1 from the signal line, through n-type TFTs 50*b* and 53.

When the bit D[2] (m) of the corresponding image data is "0", n-type TFT 53 is shut off, and no current is pulled in from the signal line even in the bit weighting current output operation. At this time, from the same reason as described with reference to the first embodiment, charges that have been held by capacitors 49*a* and 49*b* leak through n-type TFTs 47*a*, 47*b* and 48*a*, 48*b*, respectively. As the gate voltage of n-type TFTs 48*a*, 48*b* decreases gradually by such a phenomenon, the pulling current (source-drain current) decreases, as already described. In other words, the signal line driving current pulled from the signal line gradually decreases, eventually resulting in unevenness in display.

Therefore, as in the first embodiment, each of the bit weighting current source circuits 120 to 122 is provided with a dummy load 51 and a p-type TFT 52. The source of p-type TFT 52 is connected through dummy load 51 to the power supply VDD. Consequently, even when the bit D[2](m) of the image data is "0", the drains of n-type TFTs 48*a* and 48*b* are connected to p-type TFT 52 through n-type TFTs 50*a*, 50*b*, respectively, and connected further to the power supply VDD through p-type TFT 52 and dummy load 51. Therefore, a current flows through n-type TFTs 48*a*, 48*b*, and the pulling current path is not shut off. Accordingly, gradual decrease of the gate potential of n-type TFTs 48*a* and 48*b* resulting from the leakage of charges from capacitors 49*a* and 49*b* can be prevented.

Similarly, in the bit weighting current output operation, in the bit weighting current source circuit 121 for the second bit and the bit weighting current source circuit 122 for the least significant bit, the bit weighting currents 2×Io1 and Io1 are pulled from the signal line through n-type TFTs 54 and 55, respectively, when the corresponding bits D[1](m) and D[0](m) are "1".

In this manner, the reference current written by the reference current writing operation common to the columns of R, G and B is reproduced in the bit weighting current output operation, either by the bit weighting current source 123*a* for system A or the bit weighting current source 123*b* for system B. Specifically, n-type TFTs 48*a* and 48*b* correspond to the TFT for driving that drives the signal line connected to the succeeding stage.

Here, to the output ends of bit weighting current source circuits 120 to 122, n-type TFTs 53 to 55 are connected, respectively, at one end (source). N-type TFTs 53 to 55 are connected, at the other end (drain), together to the signal line. Specifically, n-type TFTs 53 to 55 switch and output the bit weighting currents 4×Io1, 2×Io1 and Io1 from the corresponding bit weighting current source circuits, in accordance with the bit of the image data. As the bit weighting currents are added in this manner, a signal driving current that is converted to an analog signal having 8 different levels for each color can be obtained.

The n-type TFTs 53 to 55 shown in FIG. 8 correspond to each of the switch circuits 18 to 20 connected to the succeeding stage (output ends) of bit weighting current source circuits 100 to 102 for R, switch circuits 21 to 23 connected to the succeeding stage (output ends) of bit weighting current source circuits 103 to 105 for G, and switch circuits 24 to 26 connected to the succeeding stage (output ends) of bit weighting current source circuits 106 to 108 for B.

R, G and B pixel circuits 32, 33 and 34 have the same configuration as that shown, for example, in FIG. 3A. Specifically, at the time of writing through the signal line, when the second scan line 36 is at the "H" level, the first scan line 35 attains to the "H" level and the signal line driving current is pulled through the signal line from signal line driving circuit 4. At this time, the gate potential corresponding to the signal line driving current flowing through p-type TFT 60 (FIG. 3A) is held by capacitor 64.

At the time of driving the organic EL light emitting element, when the second scan line 36 attains to the "L" level and the first scan line 35 attains to the "L" level thereafter, p-type TFTs 60 and 61 form a current mirror circuit, and the current corresponding to the gate potential held by the capacitor flows between the source and drain of the p-type TFT 61. As the drain of p-type TFT 61 is connected to the anode of organic EL light emitting diode 65, the source-drain current of p-type TFT 61 serves as a driving current for the organic EL light emitting diode.

Returning to FIG. 7, the operation of the display apparatus (organic EL panel) as a whole will be continued. As described above, as in the first embodiment, signal line driving circuit 4 pulls in the current from pixel circuits 32 to 34 through signal lines 28 to 30, as analog currents that are obtained by D/A conversion (digital-analog conversion) of image data corresponding to the pixel of the row as the object of scanning. Specifically, signal line driving circuit 4 drives the signal line such that the signal current is supplied to the pixel circuit through the signal line, as in the first embodiment.

Further, as in the first embodiment, the start pulse STY and the shift clock CLKY are input to scan driver circuit 37, and scan driver circuit 37 generates shift pulses from the start pulse STY and the shift clock CLKY. Based on the shift pulses, driving pulses SC_A(0), SC_B(0), . . . , SC_A(N−1), SC_B(N−1) are generated, and the pixel circuits of respective rows are scanned successively.

Figure 9:
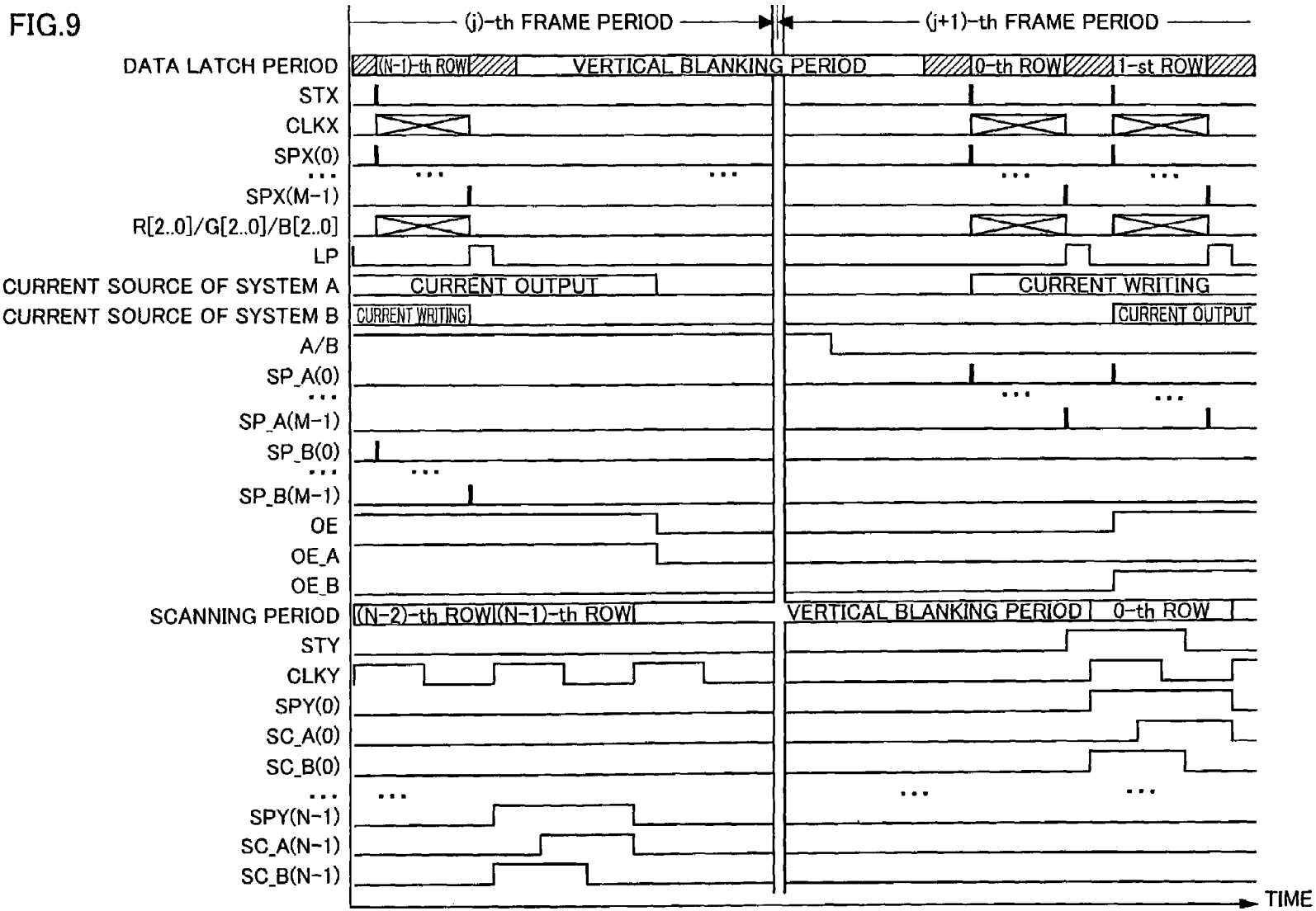
FIG. 9 is a waveform diagram representing an operation sequence of the display apparatus in accordance with the second embodiment of the present invention.

The driving sequence in accordance with the second embodiment will be described with reference to FIG. 9. FIG. 9 shows the latter part of the j-th frame period to the former part of the (j+1)-th frame period. It is assumed that the pixel matrix has N rows and 3×M columns (M columns for each of R, G and B).

First, in the j-th frame period, as in the first embodiment, a latch pulse LP is input to timing latch circuit 3, and line-sequential image data of one row corresponding to each column are output.

The line-sequential image data are converted to an analog current by signal line driving circuit 4, and supplied as the signal line driving current, to the pixel circuit through the signal line. As the so-called line-sequential drive takes place in the second embodiment also, there is a lag of one horizontal period between the data latch period and the scanning period.

The operation mode identifying signal A/B is toggled between the "H" level and the "L" level, at a prescribed timing in a period belonging to both the data latch/blanking period and the scanning blanking period. Here, when the operation mode identifying signal A/B is at the "H" level, the bit weighting current source of system A is set to the bit weighting current output mode, and the bit weighting current source of system B is set to the reference current writing mode, and when the operation mode identifying signal is at the "L" level, the bit weighting current source of system A is set to the reference current writing mode and the bit weighting current source of system B is set to the bit weighting current output mode.

Figure 10A:
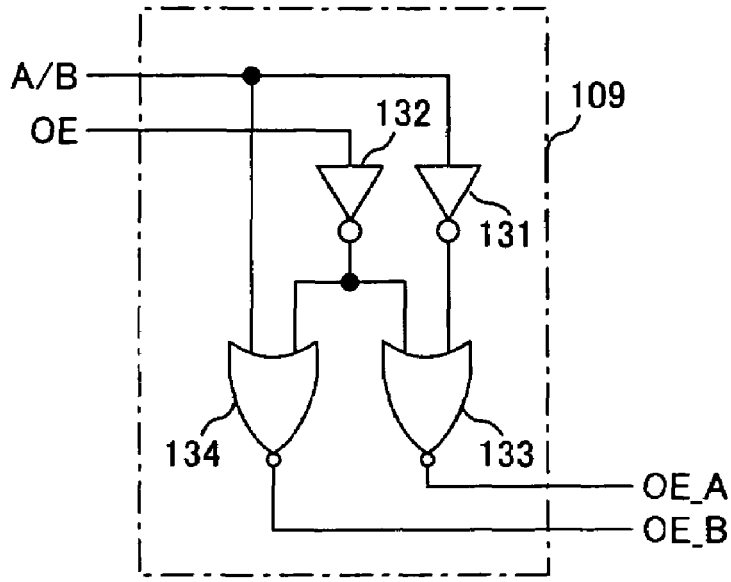
FIGS. 10A and 10B are circuit diagrams representing configurations of an output enable circuit and a sampling control circuit in the display apparatus in accordance with the second embodiment of the present invention.

Here, output enable control circuit 109 and sampling control circuit 110 will be described. By way of example, output enable control circuit 109 is formed of inverter circuits 131, 132 and NOR circuits 133, 134, as shown in FIG. 10A. By masking the output enable signal OE by the operation mode identifying signal A/B and an inverted signal thereof, an output enable signal OE_A for the bit weighting current source of system A and an output enable signal OE_B for the bit weighting current source of system B are obtained, which signals are rendered active alternately in every other frame, corresponding to the scanning period. Accordingly, outputs of bit weighting current sources 123*a* and 123*b* for systems A and B are switched by n-type TFTs 50*a* and 50*b*.

Figure 10B:
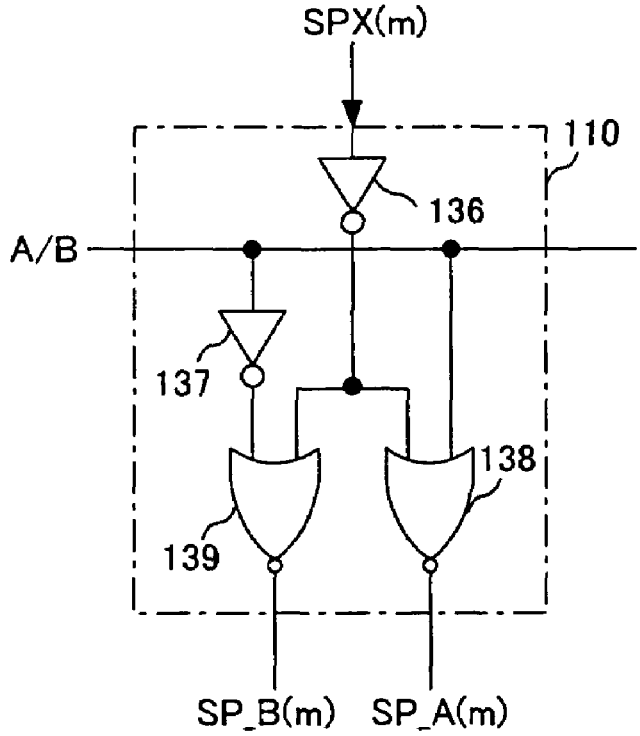

Sampling control circuit 110 is formed, for example, of inverter circuits 136, 137 and NOR circuits 138, 139, as shown in FIG. 10B. By masking the shift pulse SPX(m) output from shift register circuit 1 by the operation mode identifying signal A/B, sampling signals SP_A(0), . . . , SP_A (M−1) for the bit weighting current source of system A and sampling signals SP_B(0), . . . , SP_B(M−1) for the bit weighting current source of system B are obtained, which signals are rendered active alternately in every other frame, corresponding to the scanning period. By these sampling signals, sampling (writing) of the reference current by the bit weighting current sources 123*a* and 123*b* for systems A and B is controlled.

Scan driver circuit 37 operates in the similar manner as in the first embodiment, and shift pulses SPY(0), SPY(1), . . . , SPY(N−1) are successively generated in scan driver circuit 37. Based on the generated shift pulses SPY, driving pulses SC_A(0), SC_B(0), SC_A(N−1), SC_B(N−1) corresponding to respective rows are successively generated, and the first and second scan lines 35 and 36 of each row of the pixel matrix are scanned at prescribed timings, respectively. In this manner, the signal line driving current, which is the analog current obtained by conversion of the image data, supplied to the signal line of each column by signal line driving circuit 4 is successively written to each pixel circuit. In the pixel circuit, the current derived from the current supplied by the signal line flows to the organic EL light emitting element, and light is emitted. As the configuration and operation of reference current generating circuit 8 are the same as in the first embodiment, detailed description will not be repeated.

As described above, in the second embodiment, as in the first embodiment, the output current of a bit weighting current source is corrected by writing a bit weighted reference current, and the bit weighting current output from the bit weighting current source circuit is switched and added in accordance with the bit data of the digital image, to be supplied to the signal line. Consequently, even when TFT characteristics vary widely, variation in the signal line driving current among columns can be suppressed, and therefore, unevenness in emission luminance can be suppressed. Further, the number of signal lines can be reduced to one per one column, and therefore, application to a high resolution display with narrow pixel pitch becomes possible.

In addition, in the second embodiment, two systems of bit weighting current sources are used to alternately repeat the reference current writing operation and the current output operation in a complementary manner. Therefore, sufficient time can be allotted to the reference current writing operation, a stable bit weighting current can be output, and the variation of signal line driving current can further be suppressed.

Third Embodiment

In the configurations of the first and second embodiments, the reference current is generated from the original current, using a current mirror circuit. In the third embodiment, a configuration will be described in which the original current is provided as a staircase wave current having steps corresponding to the number of bits, the current of each step is sampled and separated by reference current generating circuit 8, and the result is output as the reference current to the reference current line.

Figure 11:
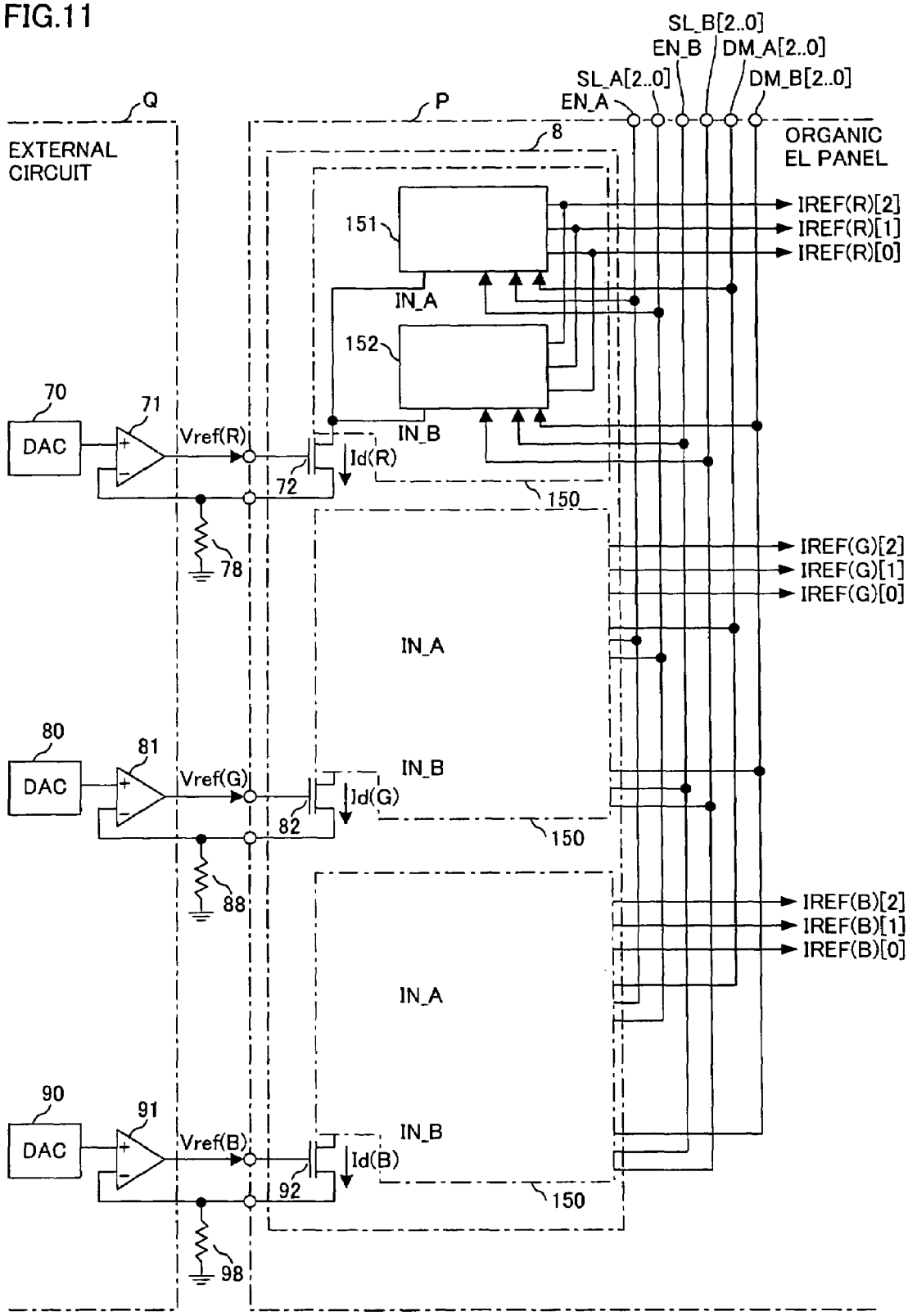
FIG. 11 is a circuit diagram representing configurations of a reference current generating circuit and an external circuit for generating the reference current, in the display apparatus in accordance with a third embodiment of the present invention.

FIG. 11 is a circuit diagram representing configurations of reference current generating circuit 8 and an external circuit for generating a reference current, in accordance with the third embodiment of the present invention.

According to the third embodiment, the bit weighting reference currents IREF(R)[2] to IREF(R)[0] for R, by way of example, are generated in the following manner. A D/A converting circuit (DAC) 70 provided outside the organic EL panel is controlled by a controller and generates a staircase wave reference voltage Vref(R), with each step having a prescribed voltage. The staircase wave reference voltage Vref (R) generated by D/A converting circuit 70 is input to a non-inversion input of differential amplifier 71. The output of differential amplifier 71 is input to the organic EL panel, and input to the gate of n-type TFT 72. The source of n-type TFT 72 is grounded through a current setting resistance 78 provided outside the organic EL panel. Further, the source of n-type TFT 72 is also connected to an inversion input of differential amplifier 71. By such an arrangement, differential amplifier 71, n-type TFT 72 and current setting resistance 78 form a constant current source. The drain current Id(R) of n-type TFT 72 is given by $$Id(R)=Vref(R)/Rext(R).$$

The output current Id(R) of the constant current source is input to a current source circuit 150 having two systems (system A/system B) of current sources 151 and 152.

Figure 12:
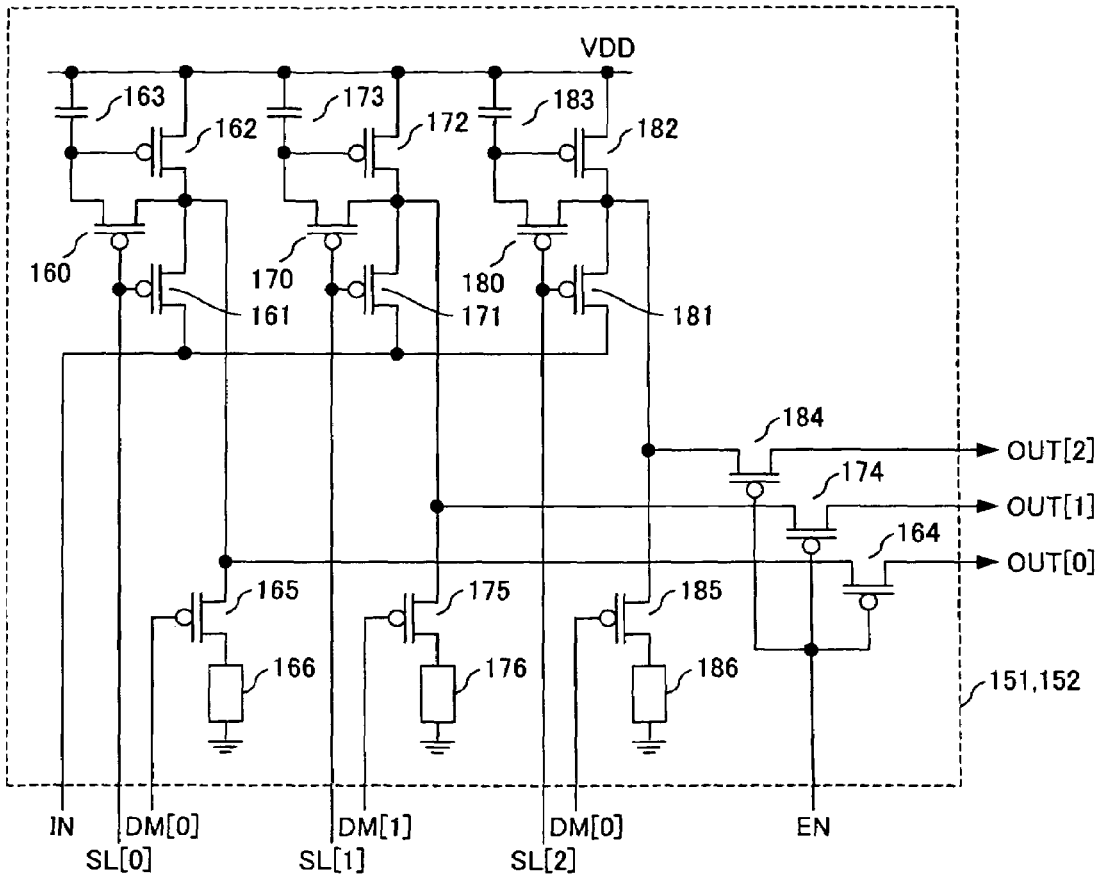
FIG. 12 is a circuit diagram representing a configuration of a current source of the reference current generating circuit in the display apparatus in accordance with the third embodiment of the present invention.

The two systems (system A/system B) of current sources 151 an 152 are formed as shown in FIG. 12. As the current sources 151 and 152 have the same configuration, names of signals are generally denoted, omitting suffixes A and B, in FIG. 12.

Each of the current sources 151 and 152 includes p-type TFTs 160 to 162 and a capacitor 163, p-type TFTs 170 to 172 and a capacitor 173, and p-type TFTs 180 to 182 and a capacitor 183. The p-type TFTs 160 to 162 and capacitor 163 operate as a current source for outputting the bit weighting reference current for the least significant bit. Similarly, p-type TFTs 170 to 172 and capacitor 173 operate as a current source for outputting the bit weighting reference current for the second bit, and p-type TFTs 180 to 182 and capacitor 183 operate as a current source for outputting the bit weighting reference current for the most significant bit.

Input ends IN of current sources 151 and 152 are connected to the drains of p-type TFTs 161, 171 and 181, respectively, and select signals SL[0], SL[1] and SL[2] are applied to the gates of p-type TFTs 160 and 161, gates of p-type TFTs 170 and 171, and to the gates of p-type TFTs 180 and 181, respectively.

Further, drains of p-type TFTs 162, 172 and 182 used for outputting the reference current are connected to the sources of p-type TFTs 161, 171 and 181, respectively. The drains of p-type TFTs 162, 172 and 182 are further connected to the drains of p-type TFTs 160, 170 and 180, respectively.

The gates of p-type TFTs 162, 172 and 182 are connected to the sources of p-type TFTs 160, 170 and 180, and further to one end of holding capacitors 163, 173 and 183, respectively. The sources of p-type TFTs 162, 172 and 182 are connected to the power supply VDD. Capacitors 163, 173 and 183 are also connected at the other end to the power supply VDD.

Each of the current sources 151 and 152 further includes p-type TFTs 164, 165, 174, 175, 184, 185 and dummy loads 166, 176 and 186. The p-type TFTs 164, 174 and 184 are provided to shut off the outputs of the current sources outputting the bit weighting reference currents, respectively.

Figure 13:
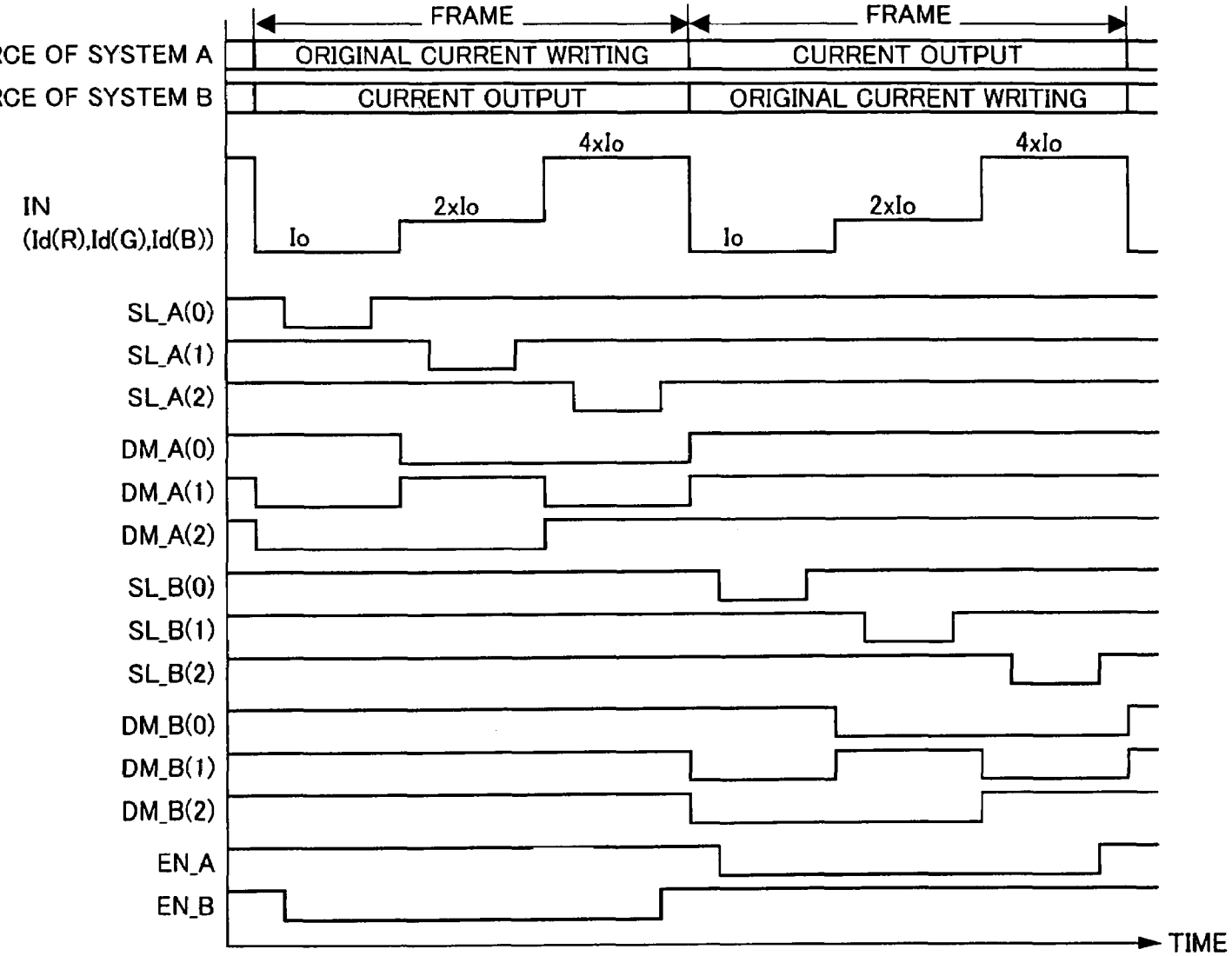
FIG. 13 is a waveform diagram representing an operation sequence of a reference current generating circuit of the display apparatus in accordance with the third embodiment of the present invention.

An operation sequence of generating the reference current in accordance with the third embodiment is shown in FIG. 13.

By way of example, current source 151 of system A and current source 152 of system B repeat the original current writing operation and the current output operation alternately for every one frame. By controlling the D/A control circuit (DAC) 70 by a controller, the original current Id(R) comes to be a staircase wave current having three steps corresponding to the bit weighting currents Io, 2×Io and 4×Io, respectively, and input as an input current IN to the current sources 151 and 152 of systems A and B.

In correspondence with respective step periods of the input current IN, select signals SL_A(0), SL_A(1) and SL_A(2) successively attain to the active state ("L" level).

First, when the select signal SL_A(0) attains to the active state, p-type TFTs 160 and 161 shown in FIG. 12 are rendered conductive, p-type TFT 162 is diode-connected, and the input current IN flows between the source and drain of p-type TFT 162. The gate voltage at this time is held by capacitor 163. Thereafter, when the select signal SL_A(1) attains to the active state, p-type TFTs 170 and 171 are rendered conductive, p-type TFT 172 is diode-connected, and the input current IN flows between the source and drain of p-type TFT 172. The gate voltage at this time is held by capacitor 173. Thereafter, when the select signal SL_A(2) attains to the active state, p-type TFTs 180 and 181 are rendered conductive, p-type TFT 182 is diode-connected, and the input current IN flows between the source and drain of p-type TFT 182. The gate voltage at this time is held by capacitor 183.

In the next frame, the select signals SL_A(0), SL_A(1) and SL_A(2) attain to the inactive state ("H" level), and p-type TFTs 160, 161, 170, 171, 180 and 181 are each shut off (rendered non-conductive). Further, the output enable signal EN_A attains to the active state ("L" level), and p-type TFTs 164, 174 and 184 are rendered conductive. Consequently, currents corresponding to the gate voltages held by capacitors 163, 173 and 183 flow between the source and drain of TFTs 162, 172 and 182, and the currents OUT[0] to OUT[2] are output through p-type TFTs 164, 174 and 184 to reference current lines 5 to 7, respectively. The currents OUT[0] to OUT[2] correspond to the reference currents IREF[0] to IREF[2] of each color. Here, the reference current IREF[0], for example, generally represents the reference currents IREF(R)[0], IREF(G)[0] and IREF(B)[0].

When the select signals SL_A(0), SL_A(1) and SL_A(2) attain to the inactive state during the operation of writing original current of a certain frame, dummy load control signals DM_A(0), DM_A(1) and DM_A(2) attain to the active state ("L" level) correspondingly, so that dummy loads 166, 176 and 186 are respectively connected through p-type TFTs 165, 175 and 185 to the drains of p-type TFTs 162, 172 and 182. As dummy loads 166, 176 and 186 are each grounded at the other end, it is possible to prevent leakage of charges held by capacitors 163, 173 and 183, by causing currents to flow to p-type TFTs 162, 172 and 182 through the dummy loads to lower the drain potentials thereof, even when the corresponding select signals are in the inactive state. Therefore, lowering of the output currents OUT[1] to OUT[3] can be prevented even at the transition to the reference current output operation, and in addition, the time necessary for charging the capacitors in the next original current writing operation can be reduced.

Current source 152 of system B operates in the similar manner, and repeats the original current writing operation and the reference current output operation frame by frame. In this manner, the reference currents IREF[0] to IREF[2] of each color are supplied by either one of current source 151 of system A and current source 152 of system B.

As described above, according to the third embodiment, a staircase wave current having respective bit weighted reference current values as stair step current values is generated. Further, the current of the corresponding step of the staircase wave current is written, and the written current is reproduced and used as the reference current. Therefore, it becomes possible to obtain exact reference currents corresponding to the number of bits, from one staircase wave current.

Further, by adjusting each step voltage of the staircase wave reference voltage by a controller, it becomes possible to adjust the ratio and magnitude of RGB reference currents, and therefore, it becomes possible to control white balance adjustment and luminance adjustment of the display.

Further, it is possible to generate the reference currents corresponding to the number of bits by inputting one reference voltage to the organic EL panel, and therefore, the number of terminals of the panel can be reduced.

Though operation of current source 151 of system A and current source 152 of system B is switched frame by frame in the example of FIG. 13, the period of switching may be set arbitrarily.

The steps of the staircase wave current are adapted to have the same period. It is noted, however, that the current for a lower bit may be small, and the original current may be consumed for charging the line capacitance and the holding capacitor. Therefore, the time until the prescribed current begins to flow through the driving TFT may become long. In such a case, the step period may be made longer for the reference current of a lower bit, so as to facilitate writing of the original current.

Fourth Embodiment

In the first to third embodiments, the weighting reference currents corresponding to the number of bits for respective colors are supplied through reference current lines corresponding to the number of bits for respective colors. In the fourth embodiment of the present invention, the reference current is provided as a staircase wave current having each bit weighting reference current as each step, through one reference current line for each color.

Figure 14:
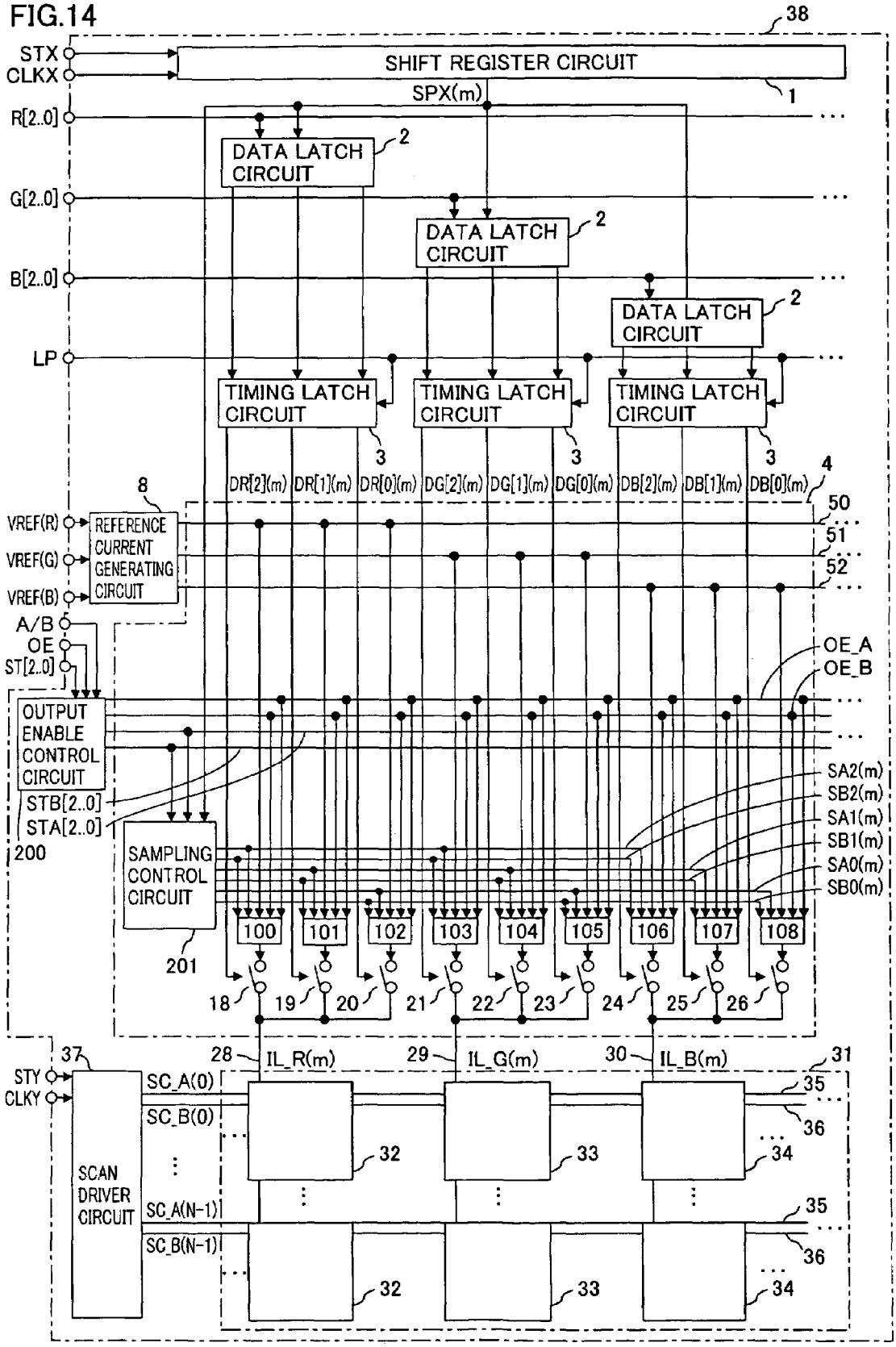
FIG. 14 is a block diagram representing a configuration of the display apparatus in accordance with a fourth embodiment of the present invention.

FIG. 14 is a block diagram representing a configuration of the display apparatus in accordance with the fourth embodiment of the present invention. The display apparatus in accordance with the fourth embodiment includes an output enable control circuit 200 and a sampling control circuit 201. Further, in place of reference current lines 5 to 7 including a plurality of lines (corresponding to the number of image data bits) for each color shown in FIG. 1, reference current lines 50 to 52, that is, one line for one color, are arranged. In FIG. 14, the same components as those of the first to third embodiments are denoted by the same reference characters, and detailed description will not be repeated.

Figure 15:
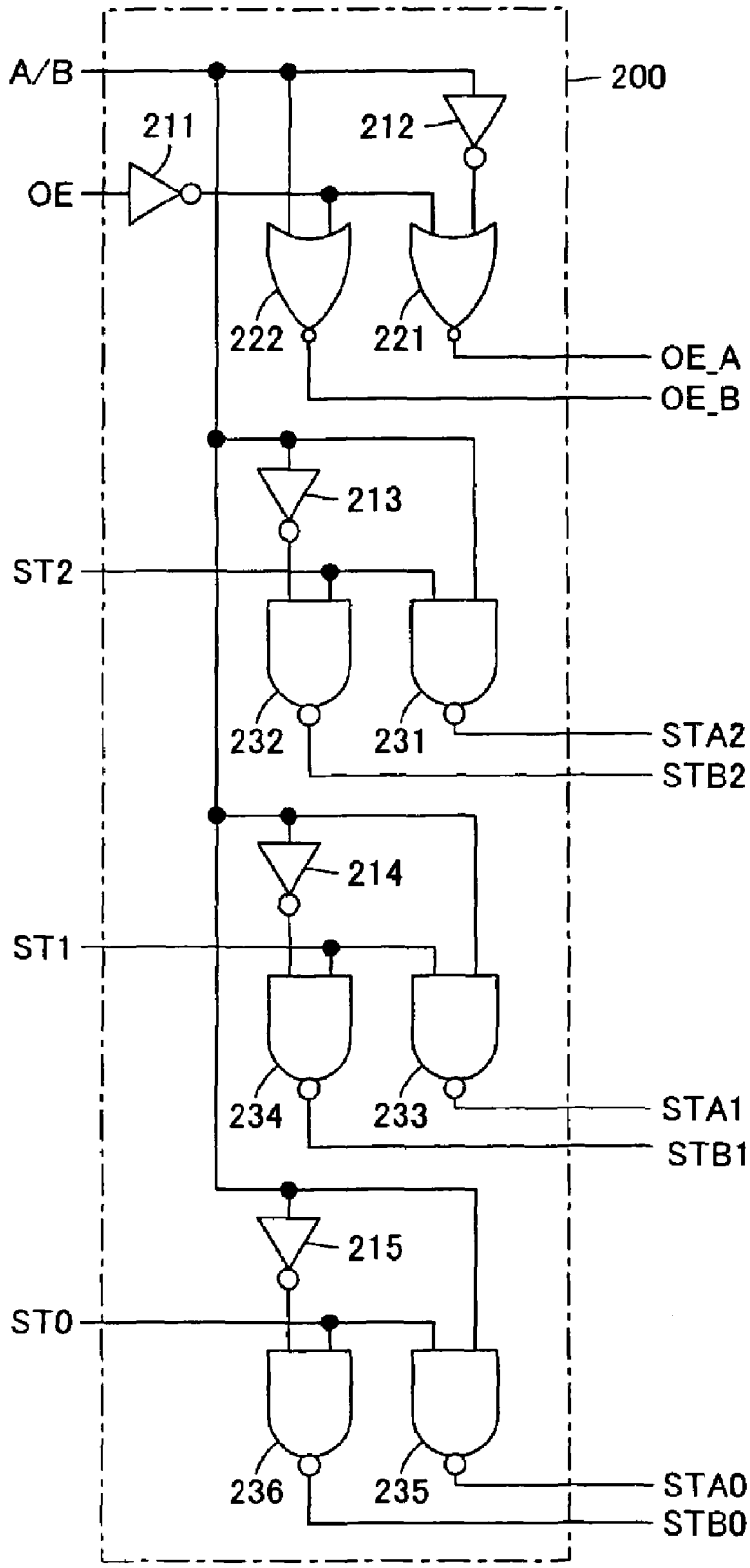
FIG. 15 is a circuit diagram representing a configuration of an output enable circuit of the display apparatus in accordance with the fourth embodiment of the present invention.

To output enable control circuit 200, the operation mode identifying signal A/B, output enable signal OE, and sampling reference signals ST(2), ST(1) and ST(0) are input. Output enable control circuit 200 is configured, by way of example, as shown in FIG. 15, and includes inverter circuits 211 to 215, NOR circuits 221 and 222, and NAND circuits 231 to 236.

By such a configuration, the output enable signal OE is masked by the operation mode identifying signal A/B. As a result, output enable signals OE_A and OE_B that attain alternately to the active state ("H" level) frame by frame are generated and transmitted to the bit weighting current source circuit.

Figure 16:
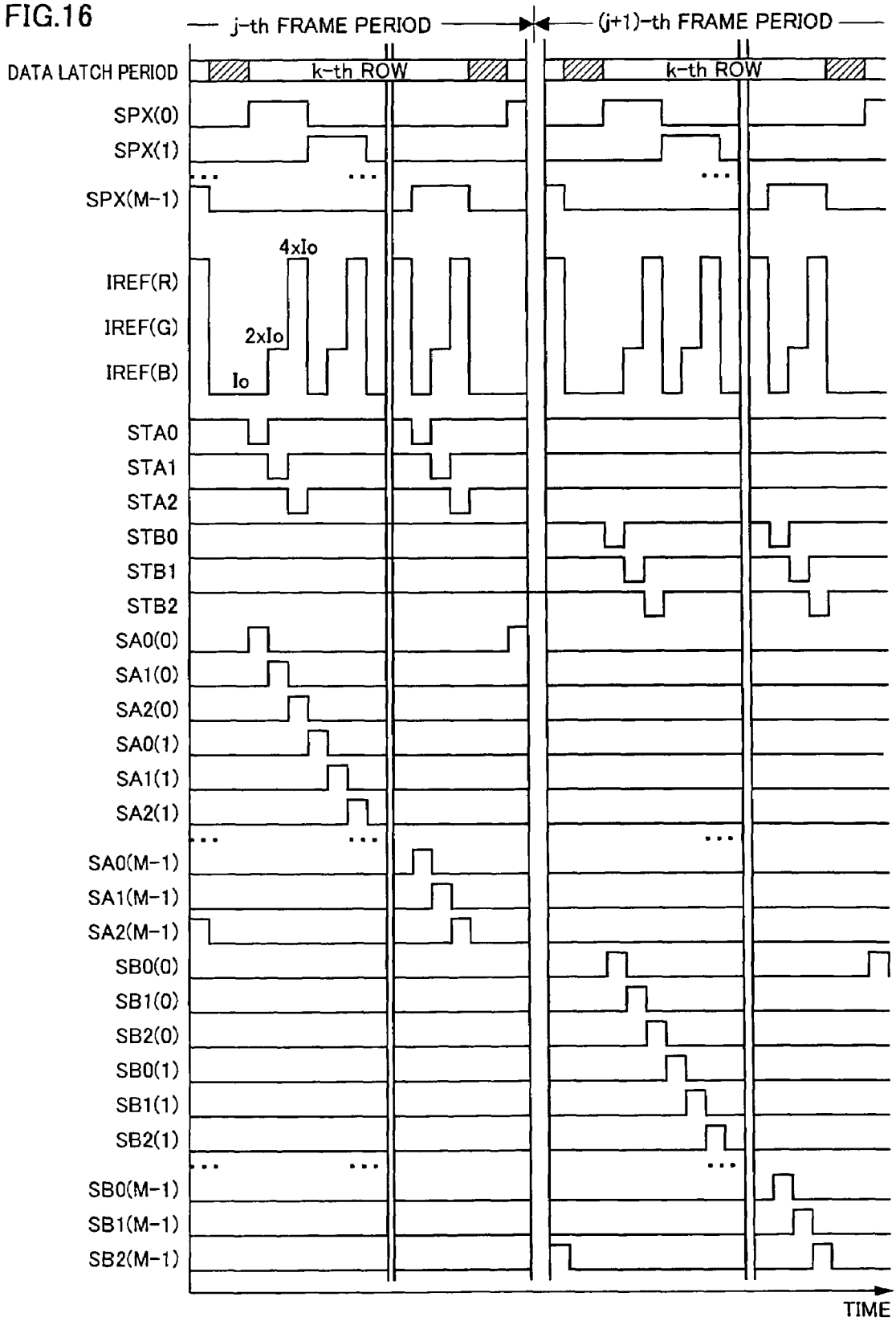
FIG. 16 is a waveform diagram representing an operation sequence of the display apparatus in accordance with the fourth embodiment of the present invention.

Further, the sampling reference signals ST(2), ST(1) and ST(0) are masked by the operation mode identifying signal A/B. As a result, the output enable control circuit 200 generates sampling reference signals STA2, STA1, STA0 and STB2, STB1 and STB0, which attain alternately to the active state ("L" level) frame by frame, as shown in FIG. 16. These sampling reference signals are transmitted to sampling control circuit 201 of signal line driving circuit 4, for each column of R, G and B.

Figure 17:
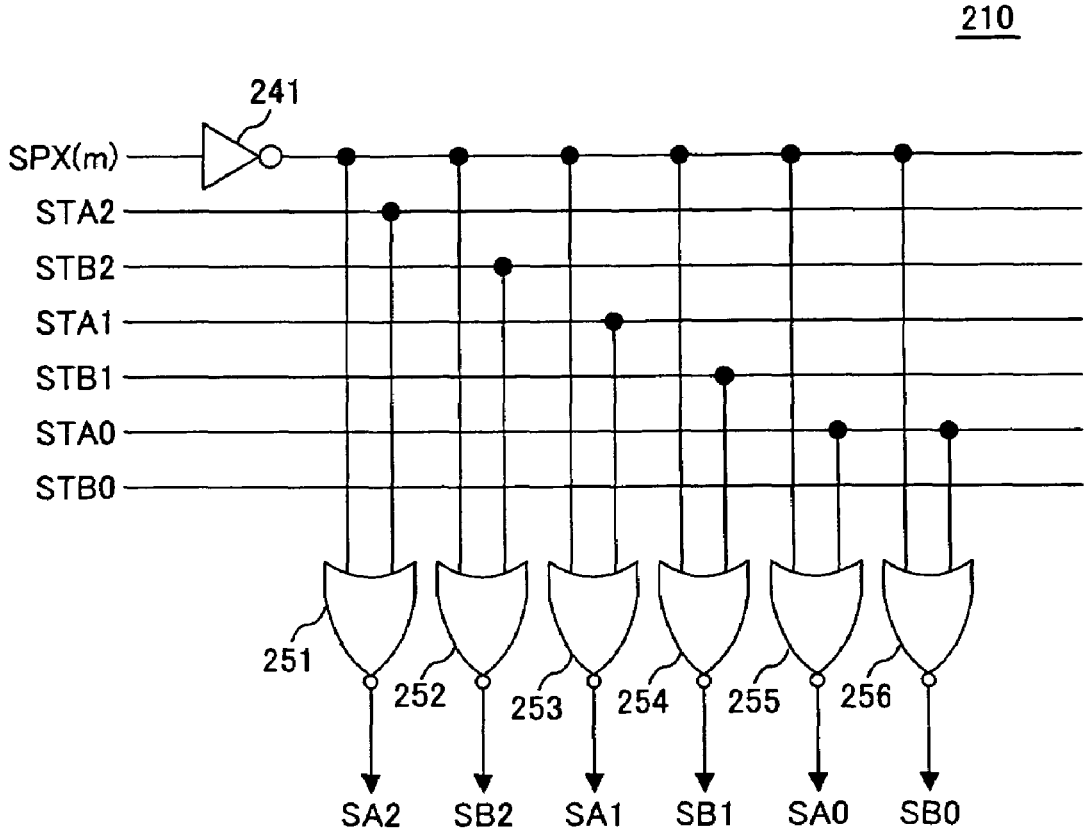
FIG. 17 is a circuit diagram representing a configuration of a sampling control circuit in the display apparatus in accordance with the fourth embodiment of the present invention.

Sampling control circuit 201 of each column of R, G and B is formed, by way of example, of an inverter circuit 241 and six NOR circuits 251 to 256, as shown in FIG. 17. Sampling control circuit 201 masks the sampling reference signals STA2, STA1, STA0 and STB2, STB1 and STB0 from output enable control circuit 200 by the shift pulse SPX(m) of each column, and generates sampling pulses SA0(0), SA1(0), SA2(0), . . . , SA0(M−1), SA1(M−1), SA2(M−1) for controlling writing of the reference current to the current source of system A and sampling pulses SB0(0), SB1(0), SB2(0), . . . , SB0(M−1), SB1(M−1) and SB2(M−1) for controlling writing of the reference current to the current source of system B. These sampling pulses are set to the active state ("H" level) at every other frame at a timing corresponding to the current of each step of reference currents IREF(R), IREF(G) and IREF(B), in every data latch period of each row, as shown in FIG. 16, and output to the corresponding bit weighting current source of each column.

As described above, in each data latch period of each row, the reference currents IREF(R), IREF(G) and IREF(B) are staircase waves having each bit weighting reference current as a step (as the number of bits here is 3, there are three steps). The staircase wave current is written alternately to system A/system B frame by frame, based on the sampling pulses SA0(0), SA1(0), SA2(0), . . . , SA0(M−1), SA1(M−1), SA2(M−1) or SB0(0), SB1(0), SB2(0), . . . , SB0(M−1), SB1(M−1), SB2(M−1). Writing of the bit weighting reference current starts from the bit weighting current source of a lower bit, in each column.

Figure 18:
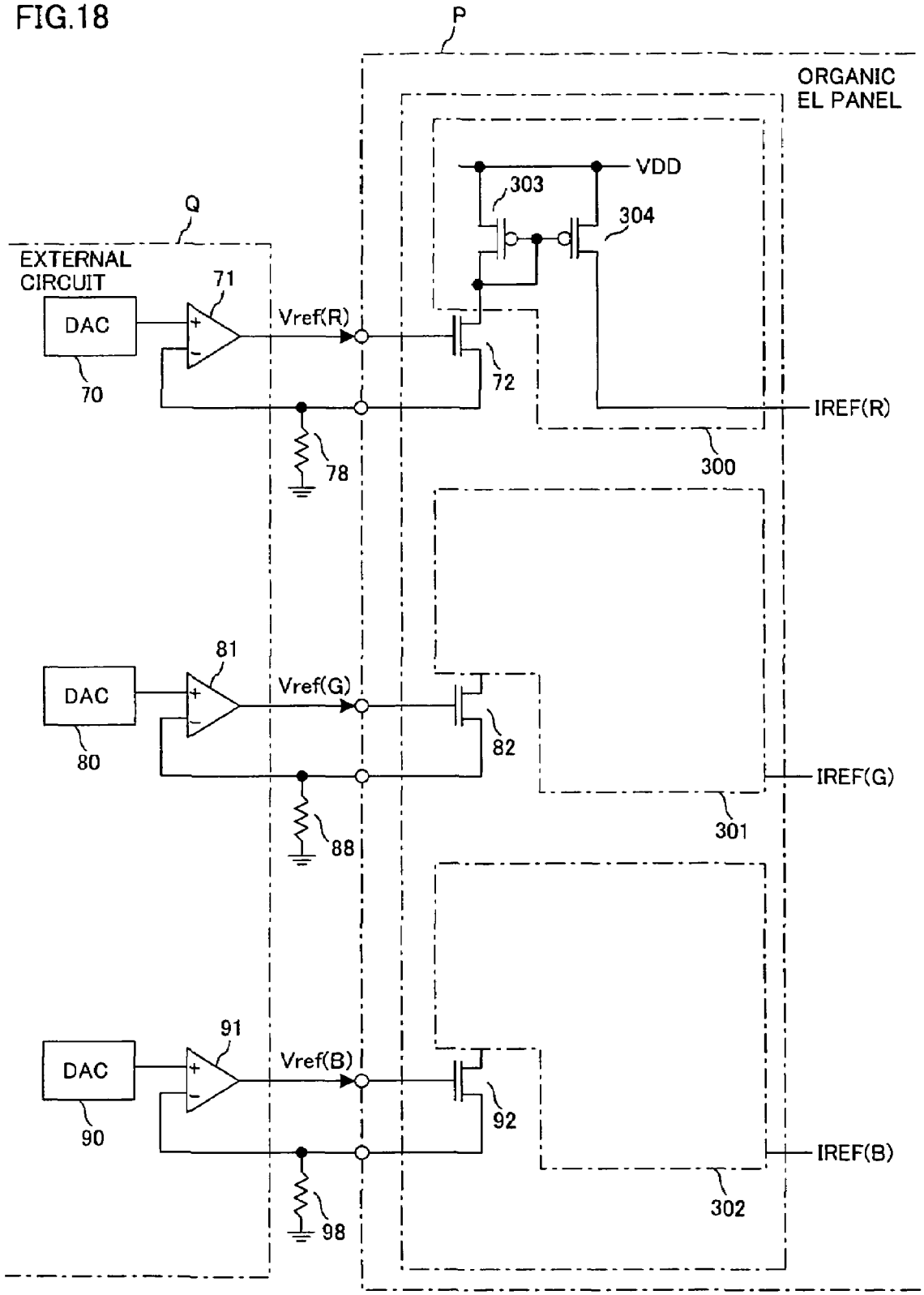
FIG. 18 is a circuit diagram representing a configuration of a reference current generating circuit in the display apparatus in accordance with the fourth embodiment of the present invention.

FIG. 18 is a circuit diagram representing a configuration of reference current generating circuit 8 in accordance with the fourth embodiment of the present invention. Though it is similar to the configuration of the first embodiment shown in FIG. 5, here, the reference currents IREF(R), IREF(G) and IREF(B) for R, G and B, respectively, are output by current mirror circuits 300 to 302, in accordance with the original current and a prescribed current ratio, as the reference currents IREF(R), IREF(G) and IREF(B) are each supplied as the staircase wave current to the bit weighting current source circuit through one reference current line for each color. Each of current mirror circuits 300 to 302 includes current-mirror connected p-type TFTs 303 and 304. In the reference current generating circuit shown in FIG. 18, the same components as in FIG. 5 are denoted by the same reference characters.

In the fourth embodiment also, it is preferred that the original current is set to be larger than the reference current, in order to lower line impedance, as in the first embodiment. Further, by independently adjusting the output voltages Vref(R) Vref(G) and Vref(B) of D/A converting circuits 70, 80 and 90 by a controller, it is possible to adjust the ratio and magnitude of reference currents of R, G and B, and hence, it becomes possible to control white balance adjustment and luminance adjustment by the controller.

As described above, in the fourth embodiment, as in the first embodiment, the output current of a bit weighting current source circuit is corrected by writing a bit weighted reference current, and the bit weighting current output from the bit weighting current source circuit is switched and added in accordance with the bit data of the digital image, to be supplied to the signal line. Consequently, even when TFT characteristics vary widely, variation in the signal line driving current among columns can be suppressed, and therefore, unevenness in emission luminance can be suppressed. Further, the number of signal lines can be reduced to one per one column, and therefore, application to a high resolution display with narrow pixel pitch becomes possible.

In addition, in the fourth embodiment, the reference current is provided as a staircase wave current, and in each bit weighting current source circuit, the staircase wave reference current is written at a timing corresponding to respective bits. Therefore, the number of reference current lines of which line width must be wide to attain low impedance as current supply lines can be reduced to one for each color, and in addition, the reference current generating circuit can be simplified to provide only one output for each color. Therefore, the dimension (size) of the driving circuit can be reduced.

Fifth Embodiment

In the fifth embodiment of the present invention, a configuration will be described in which a TFT is added to the drain side of the TFT for driving the bit weighting current in the bit weighting current circuits in accordance with the first to fourth embodiments, in order to improve constant current characteristic of the driving TFT during the weighting current output operation.

Figure 19:
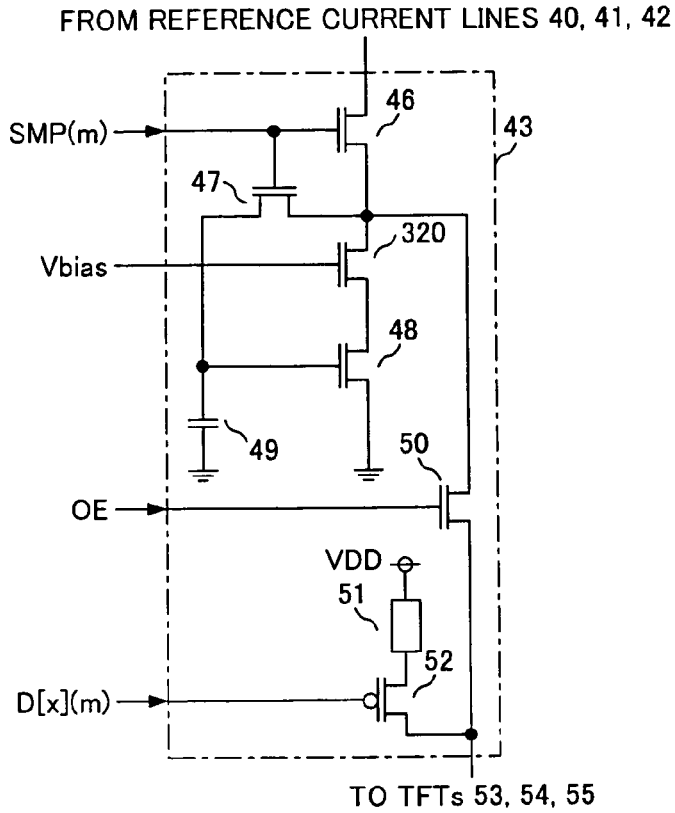
FIG. 19 is a circuit diagram representing a configuration of a bit weighting current source in the display apparatus in accordance with a fifth embodiment of the present invention.

FIG. 19 is a circuit diagram representing a configuration of the bit weighting current source circuit in accordance with the fifth embodiment of the present invention. The same components as in the bit weighting current source circuit shown in FIG. 2 are denoted by the same reference characters, and detailed description thereof will not be repeated.

In the bit weighting current source circuit 43 in accordance with the fifth embodiment, in addition to the configuration of the bit weighting current source circuit (FIG. 2) in accordance with the first embodiment, an n-type TFT 320 is provided. The n-type TFT 320 is cascade-connected to the drain side of TFT 48 for driving the bit weighting current, and has its drain connected to the source of n-type TFT 46 and to the drain of n-type TFT 47.

It is generally known that Vds (drain-source voltage)—Id (drain current) characteristic in a saturation region of a low temperature p-Si TFT has significant Id variation resulting from Vds variation, as compared with single crystal silicon.

In the pixel circuit shown, for example, in FIG. 3A, when a signal is to be written through a signal line, the gate-source voltage of p-type TFT 60 diode-connected by TFT 62 varies dependent on the signal line driving current. This means that Vds of driving TFT 48 in the bit weighting current source circuit in the first embodiment varies dependent on the signal current. Therefore, even when the driving TFT 48 is operated in the saturation region, the magnitude of the output (pulled) bit weighting current may possibly vary, dependent on the magnitude of Vds.

In the fifth embodiment, by adding TFT 320 on the drain side of driving TFT 48, the variation in the drain voltage of driving TFT 48, that is Vds variation, is shielded. Here, to the gate of TFT 320, a bias voltage Vbias that makes TFT 320 operate in the saturation region is supplied.

In this manner, the variation in Vds of driving TFT 48 can be shielded by TFT 320, and therefore, even when the signal line voltage varies along with the variation of the signal line driving current supplied to the signal line, the variation of the signal line driving current driven by driving TFT 48 can be suppressed.

Figure 20:
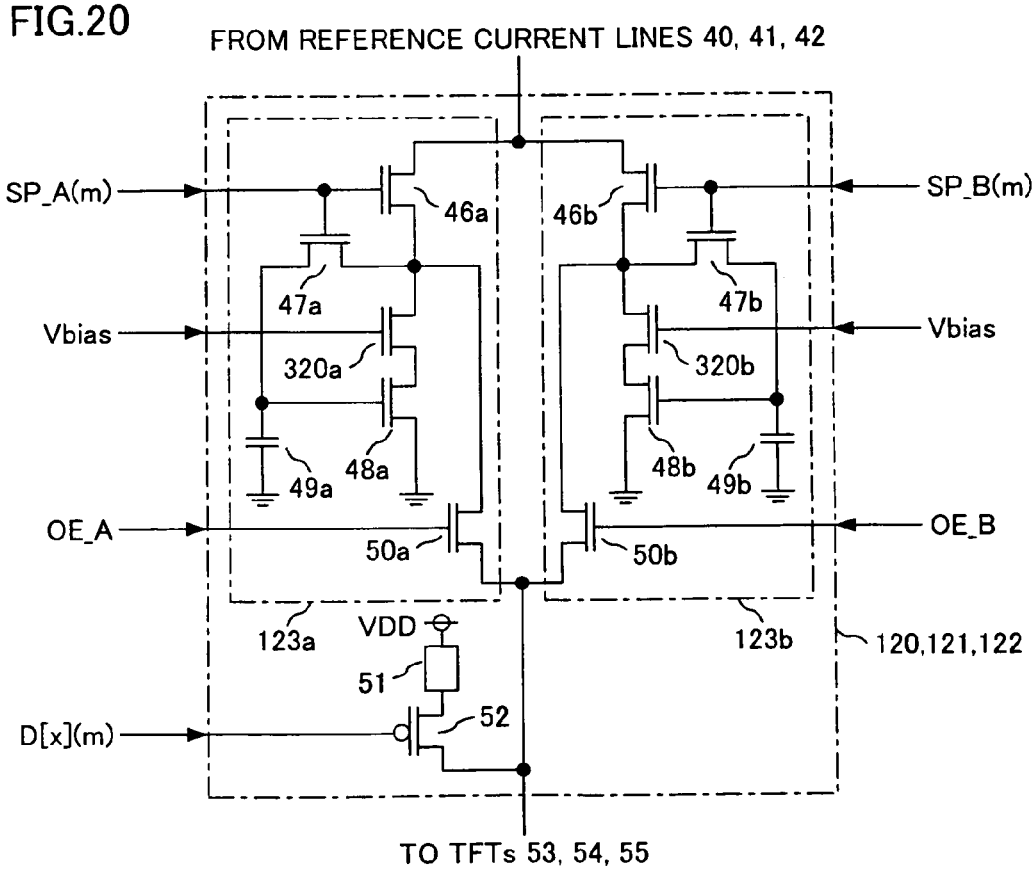
FIG. 20 is a circuit diagram representing another configuration of a bit weighting current source in the display apparatus in accordance with the fifth embodiment of the present invention.

Similarly, FIG. 20 shows a configuration in which TFTs 320*a* and 320*b* for shielding the Vds variation are added to the side of the drains of driving TFTs 48*a* and 48*b* of bit weighting current sources 123*a* and 123*b* in accordance with the second embodiment shown in FIG. 8. In FIG. 20, same components as in FIG. 8 are denoted by the same reference characters, and detailed description thereof will not be repeated.

Sixth Embodiment

In the bit weighting current source circuits in accordance with the first to fifth embodiments described above, even when the corresponding bit of the image data is "0", the drain of the driving TFT is connected to the power supply VDD through the dummy load to cause a current to flow through the driving TFT, so as to prevent leakage of charges from the capacitor holding the gate potential of the driving TFT. In the sixth and seventh embodiments below, configurations of the bit weighting current source circuits adapted to shut off the leakage path of the charges from the capacitor by cascade-connecting (series connecting) a TFT on the side of the drain of the driving TFT, in order to attain similar effects will be described.

Figure 21:
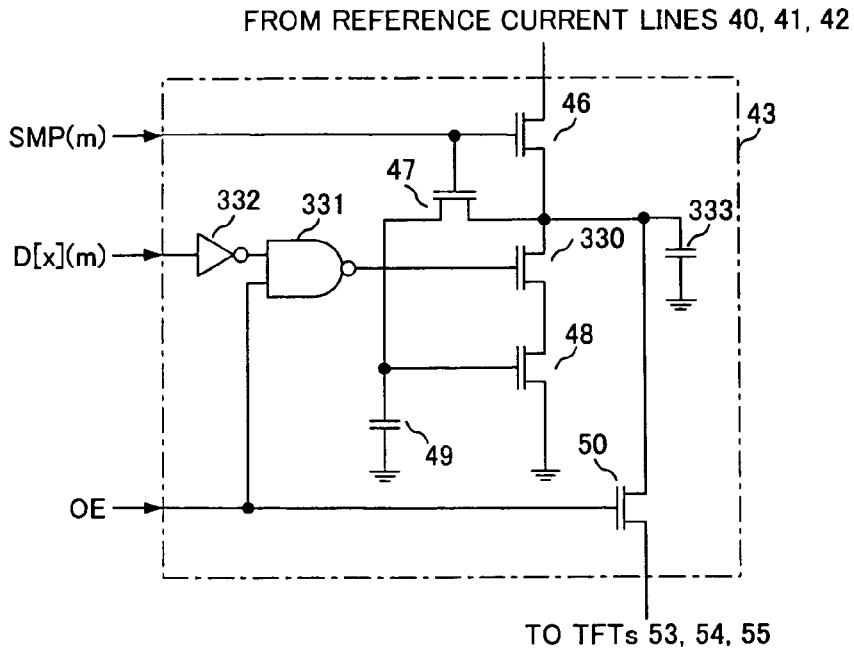
FIG. 21 is a circuit diagram representing a configuration of a bit weighting current source in the display apparatus in accordance with a sixth embodiment of the present invention.

FIG. 21 is a circuit diagram representing a configuration of the bit weighting current source circuit in accordance with the sixth embodiment of the present invention.

Referring to FIG. 21, a bit weighting current source circuit 43 in accordance with the sixth embodiment includes, in addition to the components of the bit weighting current source circuit (FIG. 2) in accordance with the first embodiment, an n-type TFT 330, aNAND gate 331, an inverter (NOT gate) 332 and a capacitor 333. The n-type TFT 330 has its source connected to the drain of driving TFT 48 and its drain connected to the drain of n-type TFT 47, to the source of n-type TFT 46 and to the source of n-type TFT 50. In FIG. 21 also, the same components as those of the bit weighting current source circuit shown in FIG. 2 are denoted by the same reference characters, and detailed description thereof will not be repeated.

The operation will be described in the following. In the bit weighting current source circuit in accordance with the sixth embodiment, even when the corresponding bit D[x](m) of the image data is "0", output enable signal OE attains to the active state ("H" level) and the current output path is shut off during the bit weighting current output operation, the output of NAND gate 331 attains to the "L" level and n-type TFT 330 is rendered non-conductive, and therefore, the leakage path of the charges held by capacitor 49 through n-type TFT 47 and driving TFT 48 can be shut off.

Therefore, the gate potential of driving TFT 48 does not decrease, and therefore, when the corresponding bit D[x](m) of the image data attains to "1" and the current is to be output to the signal line, a prescribed current can be supplied.

Further, as capacitor 333 has one end connected to the drain of n-type TFT 330 and the other end grounded, it holds the drain potential of n-type TFT 330. Accordingly, decrease of the drain potential of n-type TFT 330 to be lower than the gate potential of driving TFT 48 can be prevented, and leakage of charges held by capacitor 49 can be prevented. If leakage of charges from capacitor 49 can sufficiently be prevented by shutting off n-type TFT 330, provision of capacitor 333 is unnecessary.

Further, in the bit weighting current source circuit in accordance with the first embodiment in which n-type TFT 330, NAND gate 331 and inverter 332 are not provided, a capacitor similar to capacitor 333 shown in FIG. 21 may be added to the drain of driving TFT 48. By this configuration, decrease of the drain potential of driving TFT 48 to be lower than the gate potential can be prevented, and leakage of charges held by capacitor 49 can be prevented.

Seventh Embodiment

Figure 22:
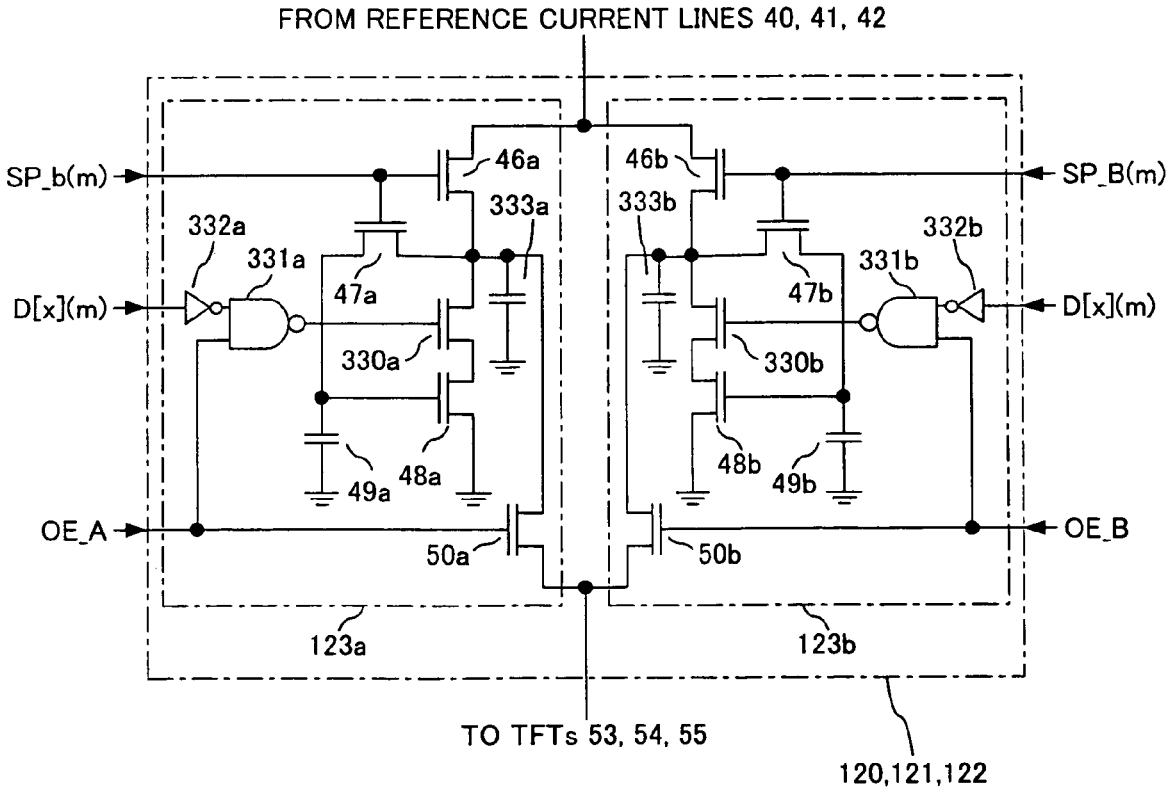
FIG. 22 is a circuit diagram representing a configuration of a bit weighting current source in the display apparatus in accordance with a seventh embodiment of the present invention.

FIG. 22 is a circuit diagram representing a configuration of the bit weighting current source circuit in accordance with the seventh embodiment of the present invention.

Referring to FIG. 22, bit weighting current source circuits 120 to 122 in accordance with the seventh embodiment include, in addition to the configuration of bit weighting current source (FIG. 8) in accordance with the second embodiment, n-type TFTs 330*a* 330*b*, NAND gates 331*a*, 331*b*, inverters (NOT gates) 332*a*, 332*b*, and capacitors 333*a* and 333*b*. The n-type TFTs 330*a* and 330*b* have their sources connected to the drains of driving TFTs 48*a* and 48*b*, respectively. Further, n-type TFT 330*a* has its drain connected to the drain of n-type TFT 47*a* and to the sources of n-type TFTs 46*a* and 50*a*, while n-type TFT 330*b* has its drain connected to the drain of n-type TFT 47*b* and to the sources of n-type TFTs 46*b* and 50*b*.

The operation will be described in the following. In the bit weighting current source circuit in accordance with the seventh embodiment, even when the corresponding bit D[x](m) of the image data is "0", output enable signal OE attains to the active state ("H" level) and the current output path is shut off during the bit weighting current output operation, the output of NAND gate 331*a* attains to the "L" level and n-type TFT 330*a* is rendered non-conductive, and therefore, the leakage path of the charges held by capacitor 49*a* through n-type TFT 47*a* and driving TFT 48a can be shut off. Similarly, the output of NAND gate 331*b* attains to the "L" level and n-type TFT 330*b* is rendered non-conductive, and therefore, the leakage path of the charges held by capacitor 49*b* through n-type TFT 47*b* and driving TFT 48*b* can be shut off.

Therefore, the gate potentials of driving TFTs 48*a* and 48*b* do not decrease, and therefore, when the corresponding bit D[x](m) of the image data attains to "1" and the current is to be output to the signal line, a prescribed current can be supplied.

Further, as capacitor 333*a* has one end connected to the drain of n-type TFT 330*a* and the other end grounded, it holds the drain potential of n-type TFT 330*a*. Similarly, as capacitor 333*b* has one end connected to the drain of n-type TFT 330*b* and the other end grounded, it holds the drain potential of n-type TFT 330*b*.

Accordingly, decrease of the drain potential of n-type TFTs 330*a* and 330*b* to be lower than the gate potentials of driving TFTs 48*a* and 48*b* can be prevented, and leakage of charges held by capacitors 49*a* and 49*b* can be prevented. If leakage of charges from capacitors 49*a* and 49*b* can sufficiently be prevented by shutting off n-type TFTs 330*a* and 330*b*, provision of capacitors 333*a* and 330*b* is unnecessary.

Further, in the bit weighting current source circuits 120 to 122 in accordance with the second embodiment in which n-type TFTs 330*a* and 330*b*, NAND gates 331*a* and 331*b* and inverters 332*a* and 332*b* are not provided, capacitors similar to capacitors 333*a* and 333*b* shown in FIG. 22 may be added to the drain of driving TFT 48*a*,48*b*. By this configuration, decrease of the drain potential of driving TFTs 48*a* and 48*b* to be lower than the gate potential can be prevented, and leakage of charges held by capacitors 49*a* and 49*b* can be prevented.

Eighth Embodiment

In the sixth and seventh embodiments, configurations of the bit weighting current source circuit aimed at holding charges in a capacitor for holding the gate voltage of the driving TFT during the bit weighting current output operation have been described. In the eighth and ninth embodiments below, configurations of bit weighting current source circuits will be described, which can prevent leakage of charges held by the capacitor also in the reference current writing operation, even when the sampling of the bit weighting current source circuit is not selected, that is, when the corresponding sampling signal SMP(m) is inactive, by rendering non-conductive the TFT cascade-connected (series connected) to the driving TFT.

Figure 23:
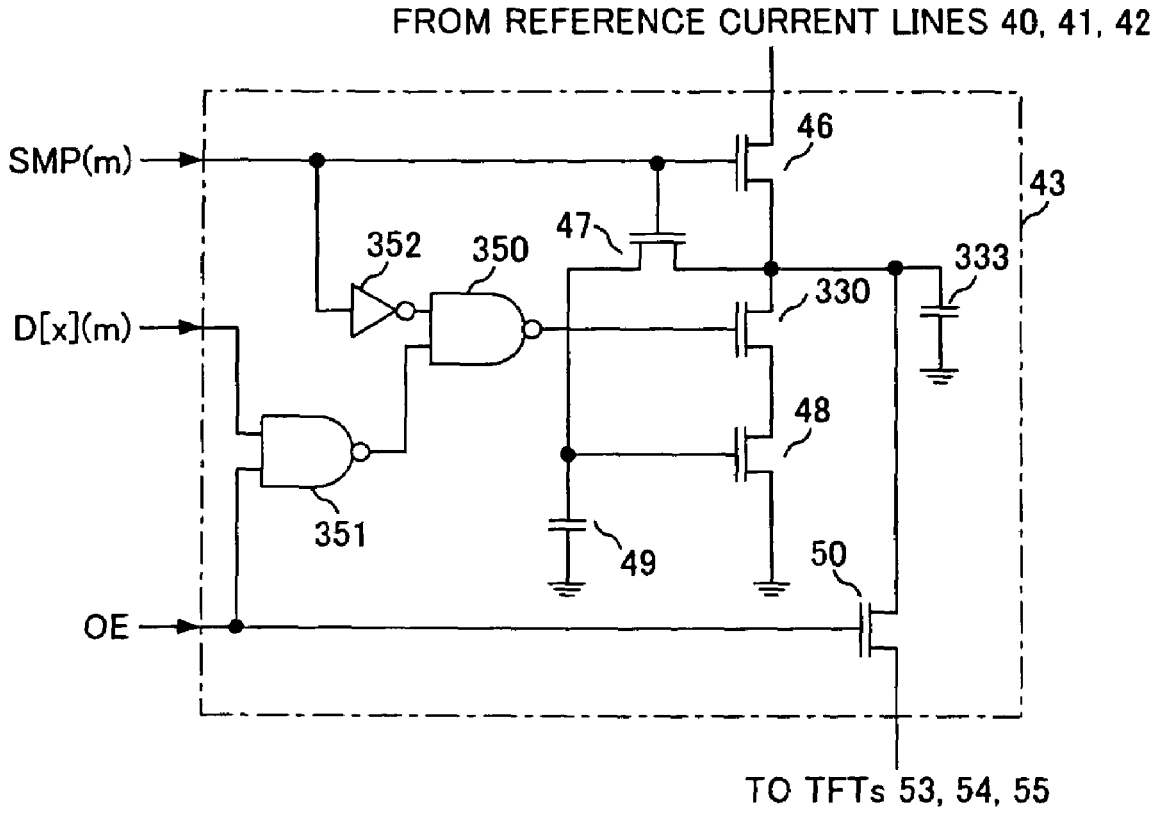
FIG. 23 is a circuit diagram representing a configuration of a bit weighting current source in the display apparatus in accordance with an eighth embodiment of the present invention.

FIG. 23 represents a configuration of the bit weighting current source circuit in accordance with the eighth embodiment of the present invention.

FIG. 23 shows a configuration of the bit weighting current source circuit having only one system of current source, such as the one in accordance with the first embodiment shown in FIG. 2. Bit weighting current source circuit 43 in accordance with the eighth embodiment includes, in addition to the configuration of the bit weighting current source circuit (FIG. 2) in accordance with the first embodiment, an n-type TFT 330, NAND circuits 350, 351 and an inverter (NOT circuit) 352.

NAND circuit 351 outputs a result of a NAND operation between the output enable signal OE and the corresponding bit D[x](m) of the image data. Inverter (NOT circuit) 352 inverts the logic level of the sampling signal SMP(m), and outputs the result. NAND circuit 350 applies the result of the NAND operation (negative logical product) between the outputs of NAND circuit 351 and inverter (NOT circuit) 352 to the gate of n-type TFT 330. In FIG. 23 also, the same portions as those of the bit weighting current source circuit shown in FIG. 2 are denoted by the same reference characters and detailed description thereof will not be repeated.

Accordingly, in the bit weighting current source circuit in accordance with the eighth embodiment, during the bit weighting current output operation, the output enable signal OE is at the active state ("H" level) and the corresponding sampling signal SMP(m) is at the inactive state ("L" level). Therefore, when the corresponding bit D[x](m) of the image data attains to "0", the output of NAND circuit 350 attains to the "L" level, and n-type TFT 330 is rendered non-conductive, whereby the current output path is shut off.

Further, during the reference current writing operation, when the output enable signal OE is at the inactive state ("L" level) and the corresponding sampling signal SMP(m) is inactive ("L" level), the output of NAND circuit 350 attains to the "L" level, n-type TFT 330 is rendered non-conductive, and the current output path is shut off.

As described above, when the n-type TFT functioning as the switching unit is rendered non-conductive and the current is not output during the bit weighting current output operation, or when the reference current is not written to the driving TFT 48 during the reference current writing operation, n-type TFT 330 is rendered non-conductive, shutting off the leakage path of the charges held by capacitor 49 through n-type TFT 47 and driving TFT 48. Therefore, the gate potential of driving TFT 48 does not decrease, and therefore, when the corresponding bit D[x](m) of the image data attains to "1" and the current is to be output to the signal line, a prescribed current can be supplied.

As in the sixth embodiment, if leakage of charges from capacitor 49 can sufficiently be prevented by shutting off n-type TFT 330, provision of capacitor 333 is unnecessary.

Ninth Embodiment

Figure 24:
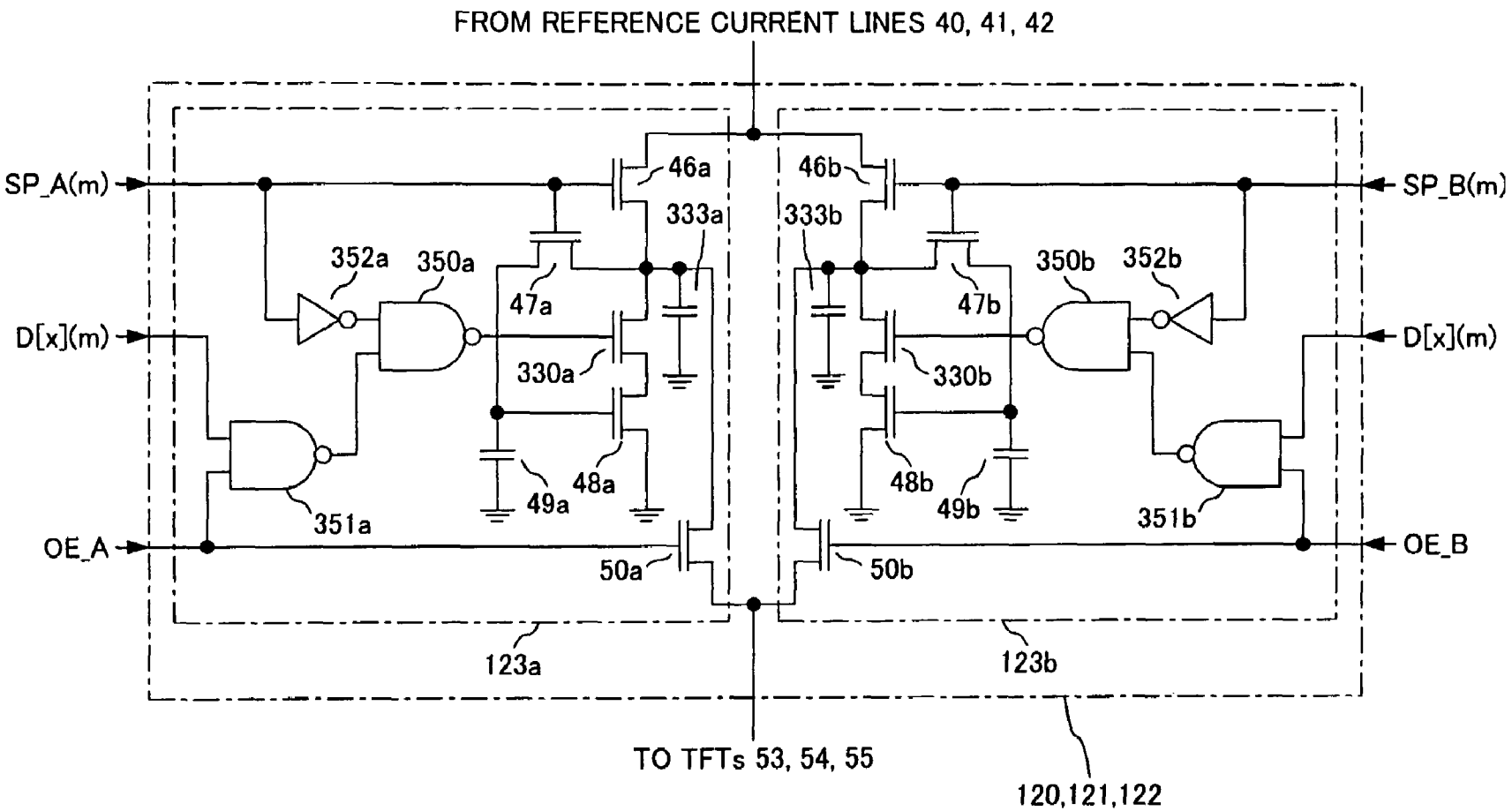
FIG. 24 is a circuit diagram representing a configuration of a bit weighting current source in the display apparatus in accordance with a ninth embodiment of the present invention.

FIG. 24 represents a configuration of the bit weighting current source in accordance with the ninth embodiment of the present invention. FIG. 24 shows an example having two systems of current sources, as in the bit weighting current source circuit of the second embodiment shown in FIG. 8.

Bit weighting current source circuits 120 to 122 in accordance with the ninth embodiment includes, in addition to the configuration of the bit weighting current source circuit (FIG. 10) in accordance with the second embodiment, an n-type TFT 330*a*, NAND circuits 350*a* and 351*a*, and an inverter (NOT circuit) 352*a* in a bit weighting current source 123*a* for system A, and an n-type TFT 330*b*, NAND circuits 350*b* and 351*b*, and an inverter (NOT circuit) 352*b* in a bit weighting current source 123*b* for system B.

In bit weighting current source 123*a* of system A, NAND circuit 351*a* outputs a result of a NAND operation between the output enable signal OE_A and the corresponding bit D[x](m) of the image data. Inverter (NOT circuit) 352*a* inverts the logic level of the sampling signal SP_A(m) and outputs the result. NAND circuit 350*a* applies the result of the NAND operation between the outputs of NAND circuit 351*a* and inverter (NOT circuit) 352*a* to the gate of n-type TFT 330*a*.

Similarly, in bit weighting current source 123*b* of system B, NAND circuit 351*b* outputs a result of a NAND operation between the output enable signal OE_B and the corresponding bit D[x](m) of the image data. Inverter (NOT circuit) 352*b* inverts the logic level of the sampling signal SP_B(m) and outputs the result. NAND circuit 350*b* applies the result of the NAND operation between the outputs of NAND circuit 351*b* and inverter (NOT circuit) 352*b* to the gate of n-type TFT 330*b*.

Accordingly, in the bit weighting current source circuit in accordance with the ninth embodiment, during the bit weighting current output operation of bit weighting current source 123*a* (system A), for example, the output enable signal OE_A is at the active state ("H" level) and the corresponding sampling signal SP_A(m) is at the inactive state ("L" level). Therefore, when the corresponding bit D[x](m) of the image data attains to "0", the output of NAND circuit 350*a* attains to the "L" level, and n-type TFT 330*a* is rendered non-conductive, whereby the current output path is shut off. Similarly, in bit weighing current source 123*b* (system B), during the bit weighting current output operation, when the corresponding bit D[x](m) of the image data attains to "0", n-type TFT 330*b* is rendered non-conductive, whereby the current output path is shut off.

Further, during the reference current writing operation of bit weighting current source 123*a* (system A), the output enable signal OE_A is at the inactive state ("L" level) and when the corresponding sampling signal SP_A(m) is inactive ("L" level), the output of NAND circuit 350*a* attains to the "L" level, n-type TFT 330*a* is rendered non-conductive, and the current output path is shut off.

Similarly, in bit weighting current source 123*b* (system B), during the reference current writing operation, when the corresponding sampling signal SP_B(m) is inactive ("L" level), n-type TFT 330*b* is rendered non-conductive, and the current output path is shut off.

As described above, when the n-type TFT functioning as the switching unit is rendered non-conductive and the current is not output during the bit weighting current output operation, or when the reference current is not written to the driving TFT 48 during the reference current writing operation, n-type TFTs 330*a* and 330*b* are rendered non-conductive, shutting off the leakage path of the charges held by capacitors 49*a* and 49*b* through n-type TFTs 47*a* and 47*b* and driving TFTs 48*a* and 48*b*. Therefore, the gate potentials of driving TFTs 48*a* and 48*b* do not decrease, and therefore, when the corresponding bit D[x](m) of the image data attains to "1" and the current is to be output to the signal line, a prescribed current can be supplied.

As in the seventh embodiment, if leakage of charges from capacitors 49*a* and 49*b* can sufficiently be prevented by shutting off n-type TFTs 330*a* and 330*b*, provision of capacitors 333*a* and 333*b* is unnecessary.

Tenth Embodiment

Figure 25:
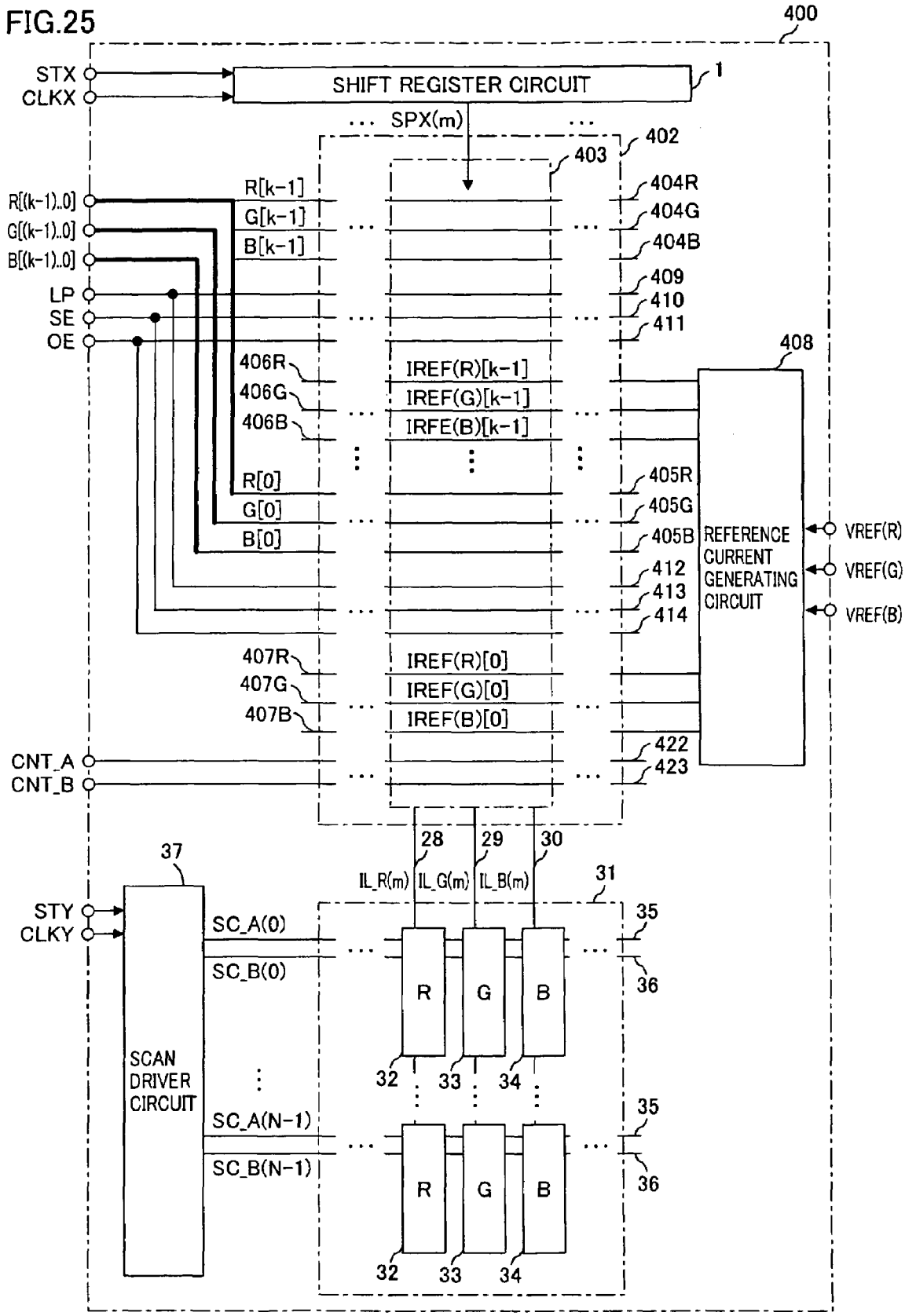
FIG. 25 is a block diagram representing a configuration of a display apparatus in accordance with a tenth embodiment of the present invention.

FIG. 25 is a block diagram representing a configuration of the display apparatus in accordance with the tenth embodiment of the present invention.

In the tenth embodiment, a configuration of a signal line driving circuit will be described, which suppresses the influence of the variation in voltage of the image data line on the supply of signal current to each pixel circuit by the signal line.

Compared with organic EL panel 38 in accordance with the first embodiment, an organic EL panel 400 shown as a representative example of the display apparatus in accordance with the tenth embodiment has a signal line driving circuit of a different configuration. FIG. 25 shows a signal line driving circuit 402 in accordance with the tenth embodiment. Signal line driving circuit 402 is a collection of signal line driving circuits 403 provided for every RGB display column. As will be described in detail later, signal line driving circuits 402 and 403 in accordance with the tenth embodiment include circuit portions that correspond to data latch circuits 2 and timing latch circuits 3 shown in FIG. 1.

In the following, an example will be described in which display is given with image data having k-bits (k: integer not smaller than 2) for each color. FIG. 25 shows, as representatives, most significant bits R[k−1], G[k−1] and B[k−1] among the image data of k-bits and corresponding image data lines 404R, 404G and 404*b*, as well as least significant bits R[0], G[0], B[0] and corresponding image data lines 405R, 405G and 405B.

Reference current generating circuit 408 provided in place of reference current generating circuit 8 shown in FIG. 1 generates reference currents for the bit weighting currents corresponding to respective bits of the image data. As to the reference currents, in FIG. 25, reference currents IREF(R)[k−1], IREF(G)[k−1], IREF(B)[k−1] corresponding to the most significant bits and reference current lines 406R, 406G and 406B transmitting the corresponding currents, as well as the reference currents IREF(R)[0], IREF(G)[0], IREF(B)[0] corresponding to the least significant bits and reference current lines 407R, 407G and 407B transmitting the corresponding currents are shown as representatives.

As in the first embodiment, control signals including the output enable signal OE, sampling enable signal SE and latch pulse LP are input to signal line driving circuit 402. In FIG. 25, among groups of lines transmitting these control signals in signal line driving circuit 402, only lines 409, 410 and 411 transmitting these control signals to the circuit group corresponding to the most significant bit, and lines 412, 413 and 414 transmitting these control signals to the circuit group corresponding to the least significant bit, are shown as representatives. To signal line driving circuit 402, control signals CNT_A and CNT_B, which will be described in detail later, are further input. In signal line driving circuit 402, control signals CNT_A and CNT_B are transmitted through lines 422 and 423, respectively.

In FIG. 25, the same components as in FIG. 1 are denoted by the same reference characters and detailed description thereof will not be repeated.

Figure 26:
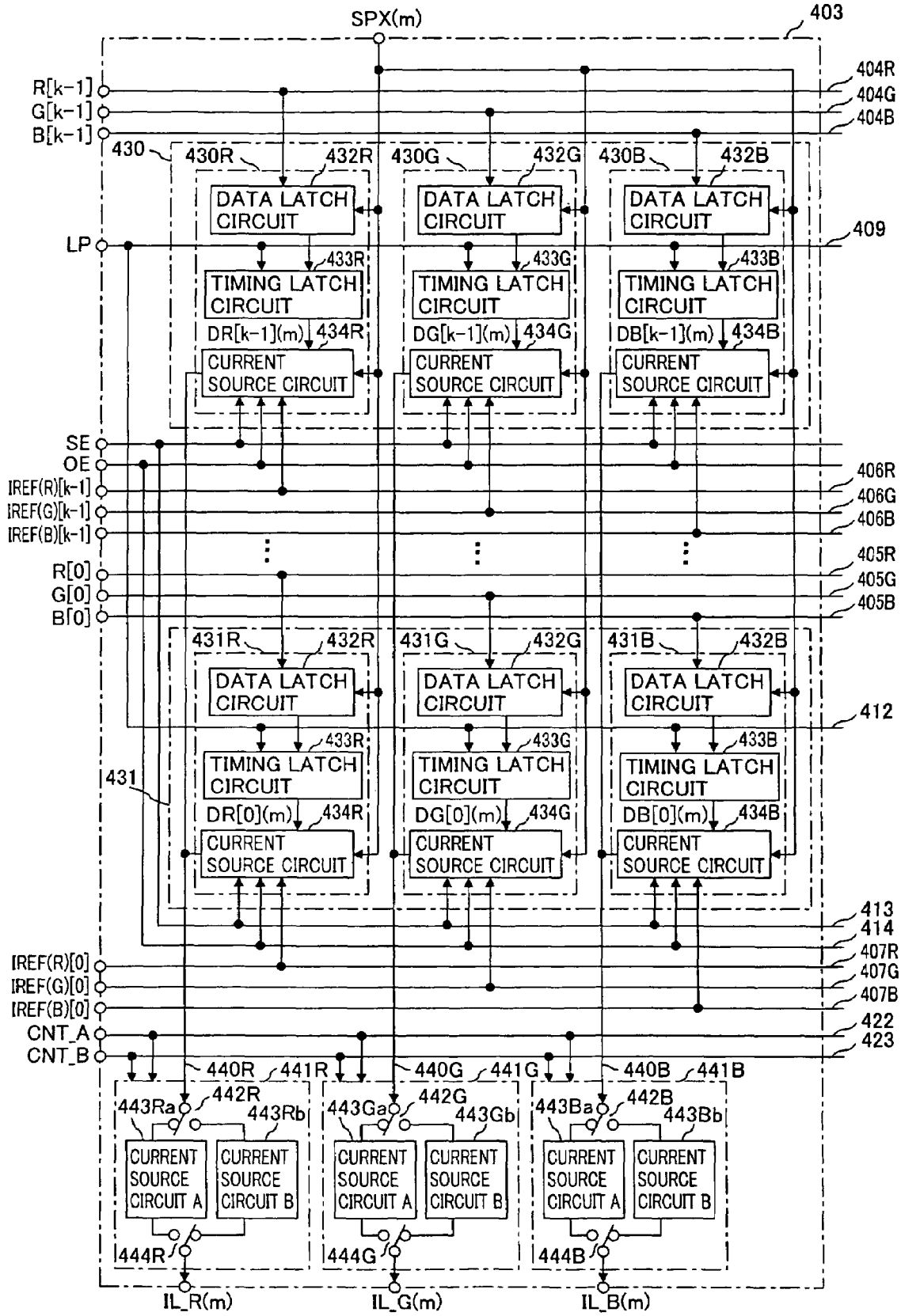
FIG. 26 is a block diagram representing in detail a configuration of a signal line driving circuit in the display apparatus in accordance with the tenth embodiment of the present invention.

FIG. 26 is a block diagram representing in detail the configuration of the signal line driving circuit in accordance with the tenth embodiment. FIG. 26 shows the configuration of a signal line driving circuit 403 corresponding to the m-th column of R, G and B as a representative, and it is understood that signal line driving circuits 403 of the same configuration are arranged for respective columns of R, G and B.

Referring to FIG. 26, the m-th signal line driving circuit 403 includes current converting circuits 430, . . . , 431 corresponding to respective bits of the image data, and current output lines 440R, 440G and 440B and current transmitting circuits 441R, 441G and 441B, corresponding to R, G and B, respectively. To current transmitting circuits 441R, 441G and 441B, control signals CNT_A and CNT_B are transmitted through lines 422 and 423 that are common to the signal line driving circuits 403 of respective columns.

Each current converting circuit includes current converting circuits corresponding to R, G and B, respectively. Among these current converting circuits, FIG. 26 shows current converting circuit 430 corresponding to the most significant bit (R[k−1], G[k−1], B[k−1]) and current converting circuit 431 corresponding to the least significant bit (R[0], G[0], B[0]) as representatives. Current converting circuit 430 includes a current converting unit 430R for R, a current converting unit 430G for G and a current converting unit 430B for B. Current converting circuit 431 includes a current converting unit 431R for R, a current converting unit 431G for G and a current converting unit 431B for B.

Each current converting unit has a data latch circuit 432, a timing latch circuit 433 and a current source circuit 434. Though suffixes R, G and B representing display colors are added to the reference characters of data latch circuits 432, timing latch circuits 433 and current source circuits 434, data latch circuits 432, timing latch circuits 433 and current source circuits 434 each have the same structures.

Image data lines are provided common to the data latch circuits 432 of respective columns. Each data latch circuit 432 latches the corresponding bit of the image data from the corresponding image data line, in response to the shift pulse SPX(m) of the corresponding column. By way of example, data latch circuits 432R, 432G and 432B in current converting circuit 430 shown in FIG. 26 latch the most significant bits R[k−1], G[k−1] and B[k−1] of the image data transmitted over image data lines 404R, 404G and 404B, in response to the shift pulse SPX(m). Data latch circuits 432R, 432G and 432B in current converting circuit 431 latch the least significant bits R[0]G[0] and B[0] of the image data transmitted over image data lines 405R, 405G and 405B, in response to the shift pulse SPX(m).

By successively performing such a process from the starting column to the last column, image data (R, G, B) of one row are latched by respective data latch circuits 432R, 432G and 432B. Each bit of the image data latched by each data latch circuit 432 is latched by each timing latch circuit 433 in response to a common latch pulse LP, and provided as line sequential image data. Specifically, each data latch circuit 432 corresponds to a circuit portion for 1-bit of data latch circuit 2 shown in FIG. 1, and each timing latch circuit 433 corresponds to a circuit portion for 1-bit of timing latch circuit 3 shown in FIG. 1.

The configuration of current source circuit 434 will be described next. Current source circuit 434 corresponds to the portions of bit weighting current sources 9 to 17 and switch circuits 18 to 26 of the display apparatus in accordance with the first embodiment shown in FIG. 1.

Figure 27:
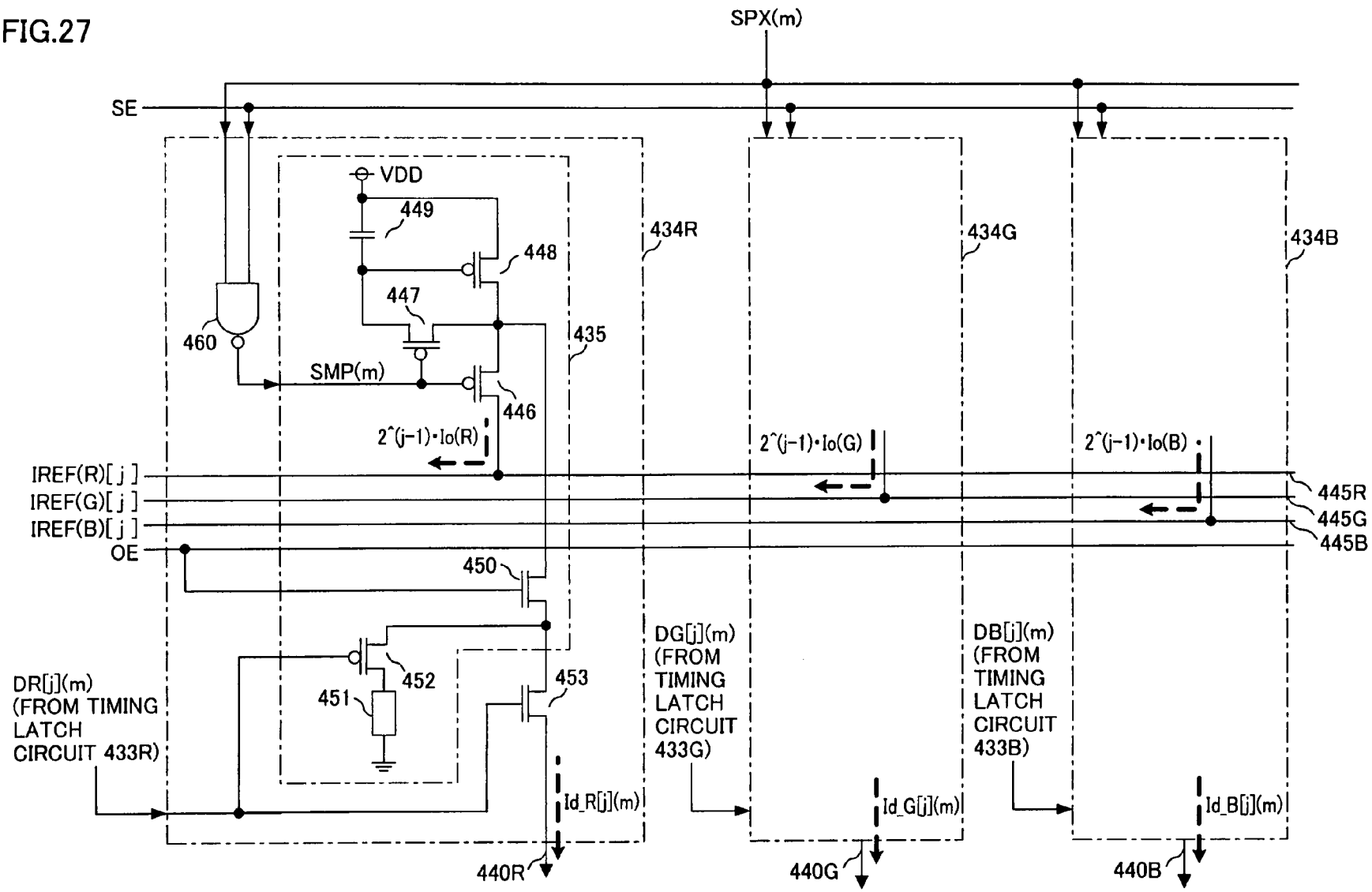
FIG. 27 is a circuit diagram representing a configuration of a bit weighting current source in the display apparatus in accordance with the tenth embodiment of the present invention.

FIG. 27 is a circuit diagram representing a configuration of the bit weighting current source of the display apparatus in accordance with the tenth embodiment of the invention.

FIG. 27 shows, as a representative, current source circuits 434R, 434G and 434B corresponding to the j-th bit (j: integer from 0 to (k−1)) of the image data, in the signal line driving circuit 403 of the m-th colunm of R, G, B. To current source circuits 434R, 434G and 434B, reference currents IREF(R)[j], IREF(G)[j] and IREF(B)[j] are supplied by reference current lines 445R, 445G and 445B. The reference current corresponding to the j-th bit is represented as IREF(R)[j]=2^(j−1)×Io(R), IREF(G)[j]=2^(j−1)×Io(G) and IREF(B)[j]=2^(j−1)×Io(B).

As current source circuits 434R, 434G and 434B have the same configuration, FIG. 27 only shows the circuit configuration of current source circuit 434R as a representative example. Current source circuit 434R includes bit weighting current source circuit 435 and an n-type TFT 453 provided as a switch circuit.

Though bit weighting current source circuit 435 is formed similar to bit weighting current source circuit 43 described with reference to FIG. 2, the output bit weighting current is in opposite direction. Therefore, the configuration of bit weighting current source circuit 435 corresponds to that of bit weighting current source circuit 43 with the n- and p-types of TFTs changed appropriately and the power supply VDD and the ground switched. Bit weighting current source circuit 435 includes p-type TFTs 446 to 448, an n-type TFT 450, a capacitor (capacitance element) 449, a dummy load 451 and a p-type TFT 452. The p-type TFT 446 has its drain connected to reference current line 445R, and its source connected to the drains of p-type TFTs 447 and 448 as well as to the drain of n-type TFT 450. The p-type TFT 447 has its source connected to the gate of p-type TFT 448 and to one end of capacitor 449 for holding the gate voltage thereof The source of p-type TFT 448 and the other end of capacitor 49 are connected to the power supply VDD. Further, n-type TFT 450 has its source connected to the source of p-type TFT 452 and to the drain of n-type TFT 453, and p-type TFT 452 has its drain grounded through dummy load 451.

NAND circuit 460 provided in place of AND circuit 27 shown in FIG. 1 outputs a result of the NAND operation (negative logical product) between the sampling enable signal SE and the shift pulse SPX(m), as a sampling signal SMP(m). Sampling signal SMP(m) is input to gates of p-type TFTs 446 and 447, and controlled such that when it is active, p-type TFTs 446 and 447 are rendered conductive. Therefore, when the sampling signal SMP(m) is active ("L" level), bit weighting reference current IREF(R)[j] is supplied through p-type TFT 446 from reference current line 445R to bit weighting current source circuit 435. In this manner, p-type TFTs 446 and 447 operate as a switch controlling writing of the reference current to bit weighting current source circuit 435 in response to the sampling signal SMP(m).

Further, output enable signal OE is input to the gate of n-type TFT 450, and is controlled such that when it is active ("H" level), n-type TFT 450 is rendered conductive. Therefore, when the output enable signal OE is active, a current pulling path by p-type TFT 48 for driving is formed. In this manner, n-type TFT 450 operates to control an output from bit weighting current source circuit 435, similar to n-type TFT 50 shown in FIG. 2.

Further, to the output end of bit weighting current source circuit 435, the drain of n-type TFT 453 is connected. Further, n-type TFT 453 has its source connected to current output line 440R. To the gate of n-type TFT 453, bit information DR[j](m) of the corresponding image data is input. Similar to bit weighting current source circuit 43, bit weighting current source circuit 435 alternately repeats the reference current writing operation and the bit weighting current output operation.

In the reference current writing operation, the sampling signal SMP(m) is rendered active ("L" level), and the bit weighting reference current IREF(R)[j] supplied from reference current line 445R is caused to flow to the diode-connected p-type TFT 448 through p-type TFT 446. The gate voltage when the reference current IREF(R)[j] flows through p-type TFT 448 is held by capacitor 449. Further, in the reference current writing operation, the output enable signal OE is inactive ("L" level), and n-type TFT 450 is shut off.

In the bit weighting current output operation, the sampling signal SMP(m) is at the inactive level ("H" level), and p-type TFTs 446 and 447 are shut off. On the other hand, the output enable signal OE is active ("H" level), and n-type TFT 450 is rendered conductive. At this time, p-type TFT 448 for driving causes a current corresponding to the gate voltage held by capacitor 449 during the reference current writing operation to flow between the source and the drain. Specifically, p-type TFT 448 for driving is to output a constant current Id_R[j](m) that is approximately equal to the reference current written in the reference current writing operation from its drain. At this time, if the corresponding bit DR[j](m) of the image data from corresponding timing latch circuit 433R is "1", n-type TFT 453 is rendered conductive, and p-type TFT 448 outputs the bit weighting current Id_R[j](m) to current output line 440R through n-type TFTs 450 and 453.

When the corresponding bit DR[j](m) of the image data is "0", n-type TFT 453 is shut off, and the current is not output to current output line 440R. At this time, in order to prevent decrease of the output current to current output line 440R resulting from leakage of charges held by capacitor 449, n-type TFT 452 and dummy load 451 are provided. Therefore, even when the corresponding bit DR[j](m) of the image data is "0", a current flows through p-type TFT 448 for driving, and therefore, gradual increase of the gate potential of p-type TFT 448 caused by the leakage of charges from capacitor 449 can be prevented.

Current source circuits 434G and 434B have the same configuration as current source circuit 434R, and operate in the similar manner as current source circuit 434R in response to the sampling enable signal SE and the output enable signal OE. Specifically, in the bit weighting current output operation, current source circuit 434G outputs to current output line 440G a bit weighting current Id_G[j](m) to current output line 4406 in accordance with the corresponding bit DG[j](m) of the image data, and in the reference current writing operation, a reference current IREF(G)[j] is written from reference current line 445G, to correct the bit weighting current Id_G[j](m). Similarly, in the bit weighting current output operation, current source circuit 434B outputs to current output line 440B a bit weighting current Id_B[j](m) to current output line 440B in accordance with the corresponding bit DB[j](m) of the image data, and in the reference current writing operation, a reference current IREF(B)[j] is written from reference current line 445B, to correct the bit weighting current Id_B[j](m).

In each current source circuit 434R corresponding to each of image data DR[0](m) to DR[k−1](m), n-type TFT 453 has its source connected to current output line 440R. Therefore, an output current Id_R(m), obtained by adding respective bit weighting currents Id_R[j](m) switched and output from respective current source circuits 434R is output to current output line 440R. Output current Id_R(m) is represented as Id_R(m)={2^(k−1)×DR[k−1](m)+ . . . +2×DR[1](m)+DR[0](m)}×Iro.

Similarly, to current output line 440G, an output current Id_G(m), obtained by adding respective bit weighting currents Id_G[j](m) switched and output from respective current source circuits 434G is output. To current output line 440B, an output current Id_B(m), obtained by adding respective bit weighting currents Id_B[j](m) switched and output from respective current source circuits 434B is output. Output current Id_G(m) is represented as Id_G(m)={2^(k−1)×DG[k−1](m)+ . . . +2×DG[1](m)+DG[0](m)}×Igo, and output current Id_B(m) is represented as Id_B(m)={2^(k−1)×DB[k−1](m)+ . . . +2×DB[1](m)+DB[0](m)}×Ibo.

As described above, currents Iro, Igo and Ibo are approximated to reference currents Io(R), Io(G) and Io(B), by the reference current writing operation by respective bit weighting current source circuits 435.

In this manner, current converting circuits 430, . . . 431 output to current output lines 440R, 440G and 440B the output currents Id_R(m), Id_G(m) and Id_B(m) in accordance with the image data. Specifically, as in the configuration shown in FIG. 2, the current converting circuit of signal line driving circuit 403 operates as a current adding type D/A converter that converts an input image data to an analog signal current and outputs the result.

Again referring to FIG. 26, current transmitting circuits 441R, 441G and 441B supply signal currents IL_R(m), IL_G(m) and IL_B(m) that correspond to output currents Id_R(m), Id_G(m) and Id_B(m) output to current output lines 440R, 440G and 440B, respectively, to signal lines 28, 29 and 30. As in the embodiments described above, signal currents IL_R(m), IL_G(m) and IL_B(m) flow in a direction from pixel circuits 32 to 34 to current transmitting circuits 441R, 441G and 441B to be pulled therein.

Current transmitting circuit 441R includes an input switch circuit 442R, two systems (system A/system B) of current source circuits 443Ra, 443Rb, and an output switch circuit 444R. Similarly, current transmitting circuit 441G includes an input switch circuit 442G, two systems (system A/system B) of current source circuits 443Ga, 443 Gb, and an output switch circuit 444G, and current transmitting circuit 441B includes an input switch circuit 442B, two systems (system A/system B) of current source circuits 443Ba, 443Bb, and an output switch circuit 444B.

Figure 28:
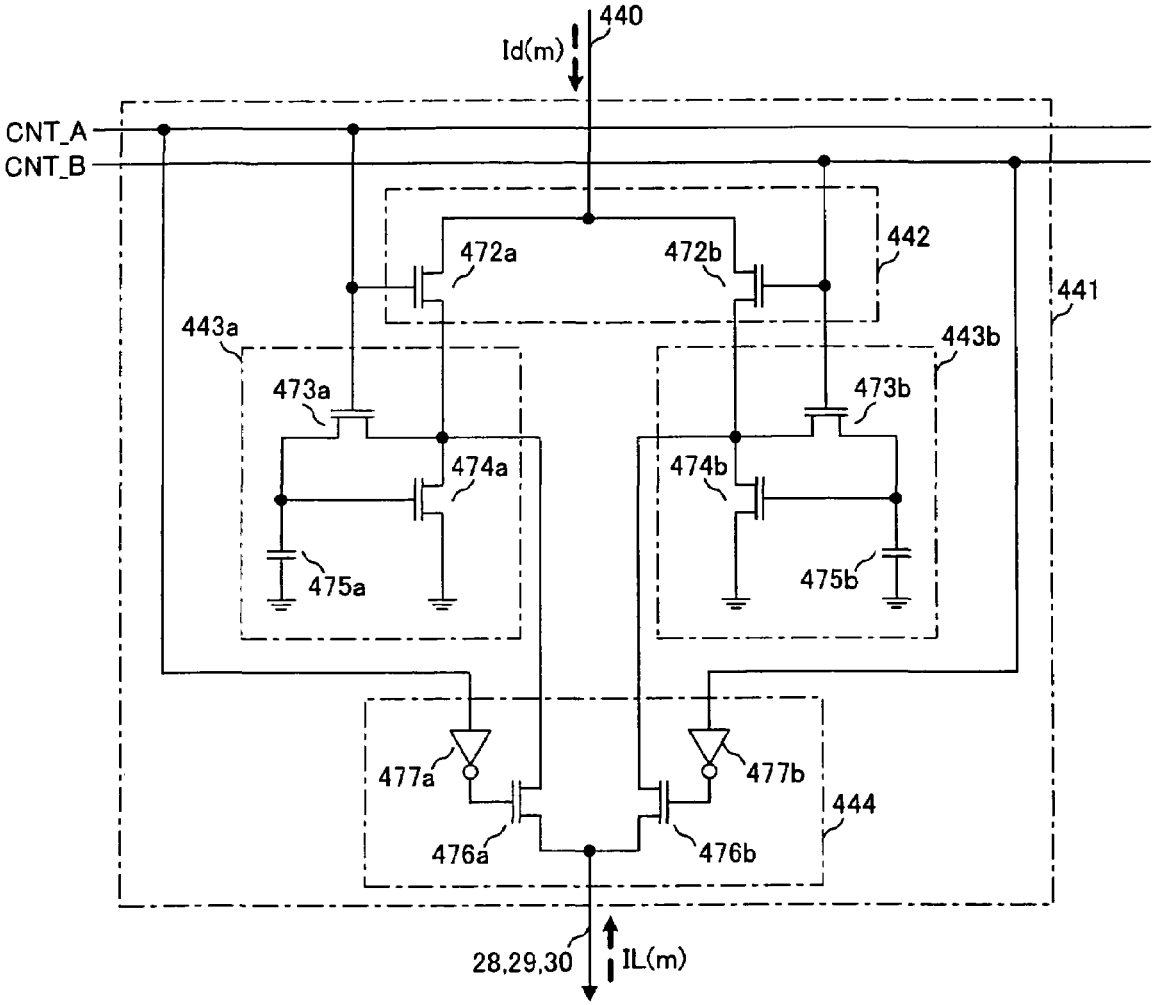
FIG. 28 is a circuit diagram representing a configuration of a current transmitting circuit in the display apparatus in accordance with the tenth embodiment of the present invention.

FIG. 28 is a circuit diagram representing a configuration of the current transmitting circuit. As current transmitting circuits 441R, 441G and 441B have the same configuration, suffixes R, G and B of reference characters are omitted in FIG. 28, and the configuration of the current transmitting circuit for each color will be described generally.

Operations of the two systems of current source circuits 443*a* and 443*b* are controlled in accordance with control signals CNT_A and CNT_B. One of the control signals CNT_A and CNT_B is set alternately to active ("H" level) and the other is set to inactive ("L" level) in a complementary manner.

Input switch circuit 442 has n-type TFTs 472*a* and 472*b*. The n-type TFTs 472*a* and 472*b* have their drains connected to current output line 440 (generally representing current output lines 440R, 440G and 440B). To the gates of n-type TFTs 472*a* and 472*b*, control signals CNT_A and CNT_B are input, respectively.

Current source circuit 443*a* (system A) includes n-type TFTs 473*a*, 474*a* and a capacitor 475*a*. The n-type TFT 473*a* has its drain connected to the source of n-type TFT 472*a* and to the drain of n-type TFT 474*a*, and its source connected to one end of capacitor 475*a* and to the gate of n-type TFT 474*a*. The source of n-type TFT 474*a* and the other end of capacitor 475*a* are grounded. Current source circuit 443*b* (system B) has the same configuration as current source circuit 443*a*, and includes n-type TFTs 473*b*, 474*b* and a capacitor 475*b* that correspond to n-type TFTs 473*a*, 474*a* and capacitor 475*a*, respectively. To the gates of n-type TFTs 473*a* and 473*b*, control signals CNT_A and CNT_B are input, respectively.

Output switch circuit 444 includes n-type TFTs 476*a*, 476*b* and NOT circuits (inverters) 477*a* and 477*b*. The n-type TFT 474*a* has its drain (that is, an output node of current source circuit 443*a* of system A) connected to the source of n-type TFT 476*a*. Similarly, n-type TFT 474*b* has its drain (that is, an output node of current source circuit 443*b* of system B) connected to the source of n-type TFT 476*b*. The n-type TFTs 476*a* and 476*b* have their drains connected to signal lines 28, 29 and 30 supplying currents to pixel matrix circuit 31.

To NOT circuits 477*a* and 477*b*, control signals CNT_A and CNT_B are input, and respective outputs are input to the gates of n-type TFTs 476*a* and 476*b*.

By way of example, when control signal CNT_A is active, input switch circuit 442 connects current output line 440R to the drain of n-type TFT 474*a* in current source circuit 443*a*. Consequently, output current Id(m) output to current output line 440R flows to n-type TFT 474*a*, through n-type TFT 472*a* forming input switch circuit 442. At this time, n-type TFT 473*a* is conductive, and therefore, n-type TFT 474*a* comes to be diode-connected, and the gate voltage of n-type TFT 474*a* when the output current Id(m) flows is held by capacitor 475*a*.

Next, when control signal CNT_A is inactive ("L" level), n-type TFT 472*a* is shut off, flow of output current Id(m) to n-type TFT 474*a* is stopped, n-type TFT 473*a* is also shut off, and n-type TFT 474*a* is to pull the current corresponding to the gate voltage held by capacitor 475*a* from the drain. At this time, the output of NOT circuit 477*a* is at the "H" level, and therefore, n-type TFT 476*a* is rendered conductive, and output switch circuit 444 connects signal lines 28, 29 and 30 to the drain of n-type TFT 474*a* in current source circuit 443*a*. Consequently, the output current Id(m) is reproduced through n-type TFT 476*a* from signal lines 28, 29 and 30, and flows between the drain and source of n-type TFT 474*a*.

In this manner, the output current Id(m) written to current source circuit 443*a* when the control signal CNT_A is active is reproduced when the control signal CNT_A is inactive, and signal current IL(m) is pulled (taken) from signal lines 28, 29 and 30. Similarly, the output current Id(m) written to current source circuit 443*b* when the control signal CNT_B is active is reproduced when the control signal CNT_B is inactive, and signal current IL(m) is pulled from signal lines 28, 29 and 30. Specifically, n-type TFTs 474*a* and 474*b* serve as driving TFTs of current transmitting circuit 441.

In response to the control signals CNT_A and CNT_B, one of current source circuits 443*a* and 443*b* performs the operation of writing the output current Id(m) and the other pulls the signal current IL(m) reproducing the already written output current Id(m) from signal lines 28, 29 and 30 (though the current is in a direction to be pulled, the operation is described as outputting the current, for convenience of description). In other words, the two systems of current source circuits 443*a* and 443*b* repeat the current writing operation and current output operation in a complementary manner.

As described above, in the display apparatus in accordance with the tenth embodiment, the analog signal current corresponding to the image data is once written to the current transmitting circuit 441 and then reproduced, and transmitted as signal line driving currents (signal currents) IL_R(m), IL_G(m) and IL_B(m) to signal lines 28, 29 and 30.

The signal currents IL_R(m), IL_G(m) and IL_B(m) output to signal lines 28, 29 and 30 are written to the pixel circuits of that row which is scanned through first and second scan lines 35, 36 by a scan driver circuit 37, among pixel circuits 32 to 34 of pixel matrix circuit 31 shown in FIG. 25. In the display apparatus in accordance with the tenth embodiment also, each signal current flow in the direction to be pushed out from each of the pixel circuits 32 to 34 to signal line driving circuit 403, and therefore, the configuration of the pixel circuit shown in FIGS. 3A and 3B may be applied.

An operation sequence of the display apparatus (organic EL panel 400) in accordance with the tenth embodiment will be described with reference to FIG. 29. FIG. 29 shows the operation from the latter portion of the j-th frame to a former portion of (j+1)-th frame period. As in the foregoing, the pixel matrix is assumed to have N rows and 3×M rows (M for each of R, G and B).

First, in the j-th frame period, the start pulse STX is input from the controller to shift register circuit 1 at the start of the data latch period of the 0-th row (starting row) to the (N−1)-th row (last row). Further, the shift clock CLKX is input over the entire latch period of each row from the controller to shift register circuit 1, and shift pulses SPX(0), SPX(1), SPX(2), . . . , SPX(M−1) are successively output from shift register circuit 1.

Meanwhile, RGB image data R[k−1..0], G[k−1..0] and B[k−1..0] of the corresponding column are input from the controller to be latched by data latch circuits 432R, 432G and 432B in response to shift pulse SPX (generally representing shift pulses SPX(0) to SPX(M−1)). After the image data of all columns×one row are latched in the data latch period of each row, latch pulse LP is input to timing latch circuits 433R, 433G and 433B, and line sequential image data of one row corresponding to respective columns are output from timing latch circuits 433R, 433G and 433B.

The line sequential image data (R, G, B) are converted to analog currents by current converting circuits 430, . . . , 431, once input to current transmitting circuits 441R, 441G and 441B through current output lines 440R, 440G and 440B, thereafter reproduced by current transmitting circuits 441R, 441G and 441B and output as signal currents to signal lines 28, 29 and 30. Here, there is a lag of one horizontal period between the data latch period in which the input image data are latched by data latch circuits 432R, 432G and 432B and the period in which current converting circuits 430, . . . , 431 output the corresponding signal currents. In the period including the scanning period of the 0-th row (starting row) to the (N−1)-th row, the output enable signal OE is set to the "H" level, so that the bit weighting current source of each signal line driving circuit 403 performs the bit weighting current output operation.

By way of example, the signal currents of the starting row (0-th row) are written to current source circuits 443Ra, 443Ga and 443Ba of system A, and output as signal line currents to signal lines 28, 29 and 30 in the next horizontal period. Then, the signal currents of the first row are written to current source circuits 443Rb, 443Gb and 443Bb of system B, and output as signal line currents to signal lines 28, 29 and 30 in the next horizontal period. The control signals CNT_A and CNT_B are toggled at every horizontal period to have opposite polarities, so that the current transmitting circuits of system A and system B perform the current writing operation and the current output operation in a complementary manner. In this manner, there is a lag of two horizontal periods between the data latch period and the period in which the signal currents of the corresponding row are output to the signal lines.

Here, in the organic EL panel 400 of the display apparatus in accordance with the tenth embodiment, the signal lines are arranged parallel to each other and vertical to the pixel matrix. On the other hand, current converting circuits 430, . . . , 431, the number of stages of which corresponds to the number of bits of the image data, are arranged parallel to each other and orthogonal to signal lines 28, 29 and 30, and output nodes are connected to current output lines 440R, 440G and 440B that are arranged in the same direction as the signal lines. Image data are transmitted to current converting circuits 430, . . . , 431 of respective columns, by image data lines 404R, 404G, 404B, . . . , 405R, 405G and 405B, arranged in the lateral direction, common to respective lines.

Between the signal lines 28, 29, 30 and image data lines, which are generally provided in directions intersecting with each other, signal coupling occurs. Accordingly, when the signal current is written to the pixel circuit, the image data of the next row (next line) is being input successively through the data line, and therefore, the potential of the signal lines is influenced by the image data. The signal line potential is determined by the signal current that is written from the signal line to the pixel circuit. Specifically, as described with reference to FIGS. 3A and 3B, in the pixel circuit, the signal currents from signal lines 28, 29 and 30 flow through the p-type TFT(p-type TFT 60 in FIGS. 3A and p-type TFT 61 in FIG. 3B) that is in a diode-connected state, at the time of writing signal current. The potential of the signal line corresponds to the drain voltage of the p-type TFT that is in the diode-connected state when the current is caused to flow.

It is noted, however, that scan lines larger in number than the rows (in this example, as two scan lines 35 and 36 are used for each line, twice the number of rows) cross the signal lines 28, 29 and 30 for scanning the pixel circuit, and therefore, load capacitance is mainly formed by the capacitances at the crossing portions. In order to settle the signal line potential, the load capacitance must be charged by the signal current. If the operation of writing the signal current to the pixel circuit is terminated while the potential is not yet settled, display luminance may vary as the image of the next row is displayed, or uneven luminance may results.

When writing to the pixel circuit is terminated before the signal line potential is settled because of interference caused by the coupling of signal lines 28, 29 and 30 from the image data line as described above, the signal current of the correct level reflecting the image data cannot be written, resulting in a current writing error.

In the tenth embodiment, the signal current in accordance with the image data is once written to the current transmitting circuit, reproduced, and output to signal lines 28, 29 and 30. Signal lines 28, 29 and 30 extended to the pixel circuits are arranged not to cross the image data lines 404R, 404G, 404B, . . . , 405R, 405G and 405B. Therefore, the signal current can be written to the pixel circuits while the signal line potential is not influenced by the voltage variation of the image data line as the image data is transmitted.

It is noted that current output lines 440R, 440G and 440B cross image data lines 404R, 404G, 404B, . . . , 405R, 405G and 405B, so that when the current is written from the current converting circuit to the current transmitting circuit, there is an influence of voltage variation on the image data. The current output lines 440R, 440G and 440B, however, are shorter than signal lines 28, 29 and 30, and the number of lines crossing therewith is smaller. Therefore, line capacitance is small, and even when the potential of the current output lines varies because of the influence from the image data lines, the potential can sufficiently be settled to the normal potential in the horizontal blanking period from the end of latching of the image data until the start of latching in the next horizontal period.

To scan driver circuit 37, the start pulse STY is input near the scanning period of the 0-th row, and over the entire scanning period, the shift clock CLKY is input. Based on the start pulse STY and shift clock CLKY, shift pulses SPY(0), SPY(1), . . . , SPY(N−1) are successively generated by scan driver circuit 37 in respective scanning periods. Based on the thus generated shift pulse SPY (generally representing the shift pulses SPY(0), SPY(1), . . . , SPY(N−1)), driving pulses SC_A(0), SC_B(0), . . . SC_A(N−1), SC_B(N−1) of the first and second scan lines 35, 36 corresponding to respective rows are successively generated, and the first and second scan lines 35 and 36 of respective rows of the pixel matrix are scanned at prescribed timings.

In this manner, the signal currents obtained by converting the image data to analog currents, supplied by signal line driving circuit 402 to the signal lines of respective columns are successively written to respective pixel circuits. As already described, in each pixel circuit, a current based on the signal current supplied from the signal line is caused to flow to the EL light emitting diode, and organic EL light emitting diode 65 emits light.

Between the scanning periods of each frame, there is a scanning blanking period similar to that shown in FIG. 4, and after the end of scanning of the (N−1)-th row (last row), the sampling enable signal SE is rendered active ("H" level). In response, NAND circuit 460 provides a NAND (negative logical product) between the corresponding shift pulse SPX and the sampling enable signal SE for each column, and the sampling signal SMP of the corresponding column is rendered active ("L" level). Consequently, in signal line driving circuit 403, reference currents are written from reference current lines 406R, 406G, 406B, . . . , 407R, 407G, 407B to bit weighting current source circuits of the corresponding columns. In this manner, the sampling signal SMP is successively made active at every unit column of R, G and B, and the reference currents are written.

Here, in a prescribed period of the scanning blanking period, the shift pulse SPX is generated by shift register circuit 1 and the sampling enable signal SE is rendered active, whereby the reference currents are supplied a prescribed number of times, that is, several to several tens of times, to the current source circuits in the current converting circuits to correct the bit weighting currents. In this manner, shift register circuit 1 is operated even in the scanning blanking period, and the sampling signal for performing correction using the reference current is generated from the shift pulse. As already described with reference to FIG. 4, the number of generation and active period of sampling signal SMP may be adjusted appropriately, considering the time necessary for the reference current writing operation.

Figure 30:
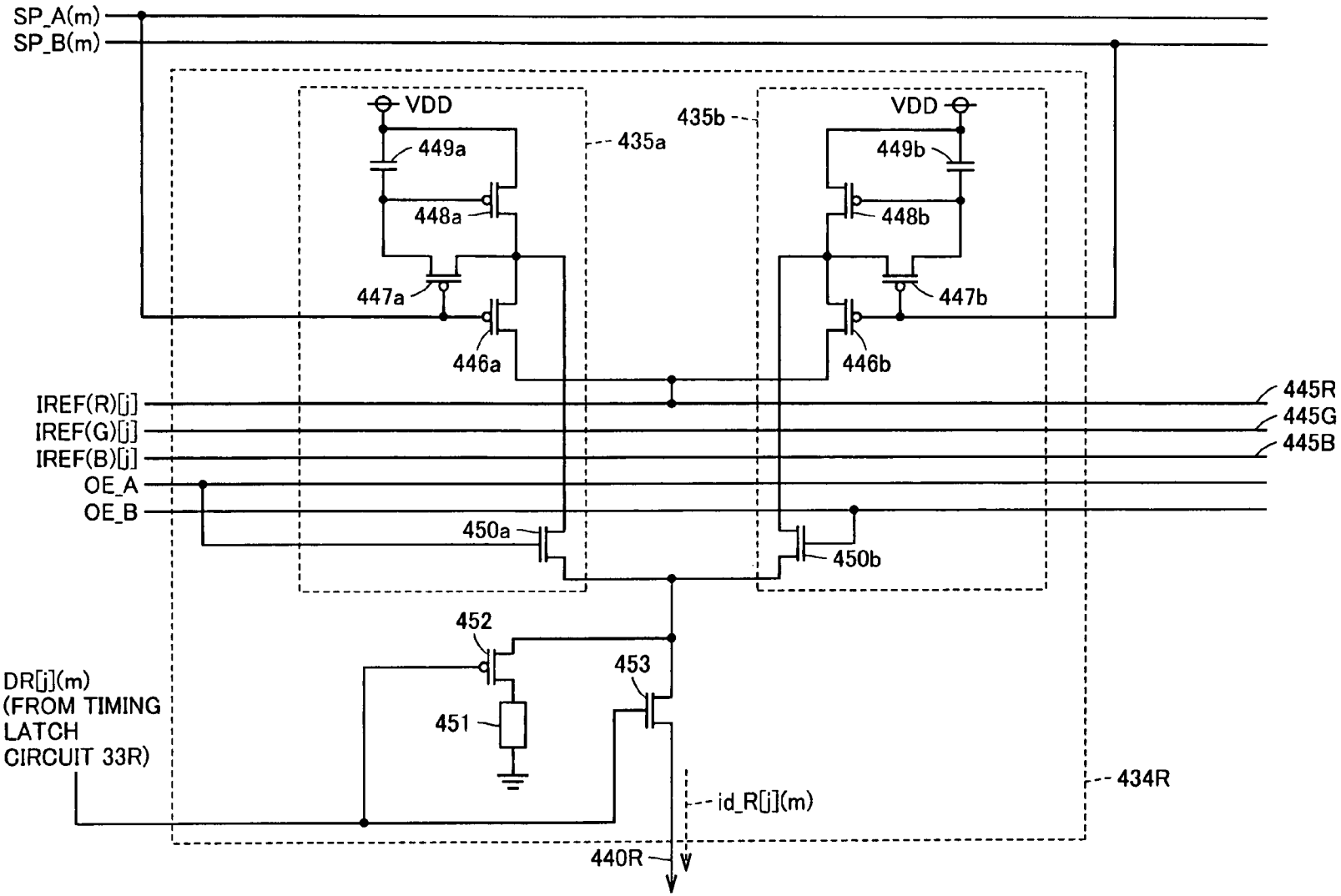
FIG. 30 is a circuit diagram representing another configuration of a bit weighting current source in the display apparatus in accordance with the tenth embodiment of the present invention.

Alternatively, as described with reference to the configuration of the second embodiment, the current source circuits 434R, 434G and 434B for switching the outputs of bit weighting current in accordance with the image data may be adapted to have two systems of current sources, as shown in FIG. 30.

FIG. 30 is a circuit diagram representing another exemplary configuration of the bit weighting current source of the display apparatus in accordance with the tenth embodiment of the present invention. Similar to FIG. 27, FIG. 30 shows a configuration of current source circuit 434R as a representative, and each current source circuit for each color and each bit has the same configuration.

Referring to FIG. 30, current source circuit 434R in accordance with another exemplary configuration includes two systems (system A/system B) of bit weighting current source circuits 435*a* and 435*b*, a dummy load 451 and a p-type TFT 452, and an n-type TFT 453 provided as a switch circuit.

Bit weighting current source circuit 435*a* includes p-type TFTs 446*a* to 448*a*, an n-type TFT 450*a* and a capacitor (capacitance element) 449*a*, and bit weighting current source circuit 435*b* includes p-type TFTs 446*b* to 448*b*, an n-type TFT 450*b* and a capacitor (capacitance element) 449*b*. Each of p-type TFTs 446*a* to 448*a*, n-type TFT 450*a* and capacitor (capacitance element) 449*a* and p-type TFTs 446*b* to 448*b*, n-type TFT 450*b* and capacitor (capacitance element) 449*b* is arranged in the similar manner as p-type TFTs 446 to 448, n-type TFT 450 and capacitor (capacitance element) 449 of bit weighting current source circuit 435 shown in FIG. 27, and therefore, detailed description will not be repeated. It is noted, however, that the sampling signal SP_A(m) is input to the gates of p-type TFTs 446*a* and 447*a*, and the sampling signal SP_B(m) is input to the gates of p-type TFTs 446*b* and 447*b*. To the gates of n-type TFTs 450*a* and 450*b*, the output enable signals OE_A and OE_B are input, respectively.

The n-type TFTs 450*a* and 450*b* have their sources connected to each other, and further connected to the drain of n-type TFT 453 and to the source of p-type TFT 452. The source of n-type TFT 453 is connected to current output line 440R. Specifically, dummy load 451, p-type TFT 452 and n-type TFT 453 arranged in the similar manner as FIG. 27 are shared by bit weighting current source circuits 435*a* and 435*b*.

By such a configuration, as in the second embodiment, the reference current writing operation and the current output operation are repeated alternately in a complementary manner, by using two systems of bit weighting current source circuits 435*a* and 435*b*. The overall operation of the display apparatus (organic EL panel) with such a configuration, particularly the operation from latching of the image data to the current output operation to current output lines 440R, 440G and 440B may be the same as the operation sequence in accordance with the second embodiment shown in FIG. 9, and therefore, detailed description will not be repeated.

By providing the current source circuit having the configuration shown in FIG. 30 described above in each current converting circuit, it becomes possible to allocate sufficient time for the reference current writing operation to the bit weighting current source circuit. As a result, it becomes possible to output a stable bit weighting current, and hence, variation of the signal line driving current can further be suppressed.

Next, reference current generating circuit 408 will be described. Reference current generating circuit 408 generates respective reference currents in a direction opposite to that generated by reference current generating circuit 8 described above. In the following, it is assumed that reference current generating circuit 408 in the display apparatus in accordance with the tenth embodiment generates a reference current by the same mechanism as that of reference current generating circuit 8 in accordance with the third embodiment described with reference to FIGS. 11 to 13. It is noted that the reference current may be generated by the same mechanism as that of reference current generating circuit 8 in accordance with the first and second embodiments.

Figure 31:
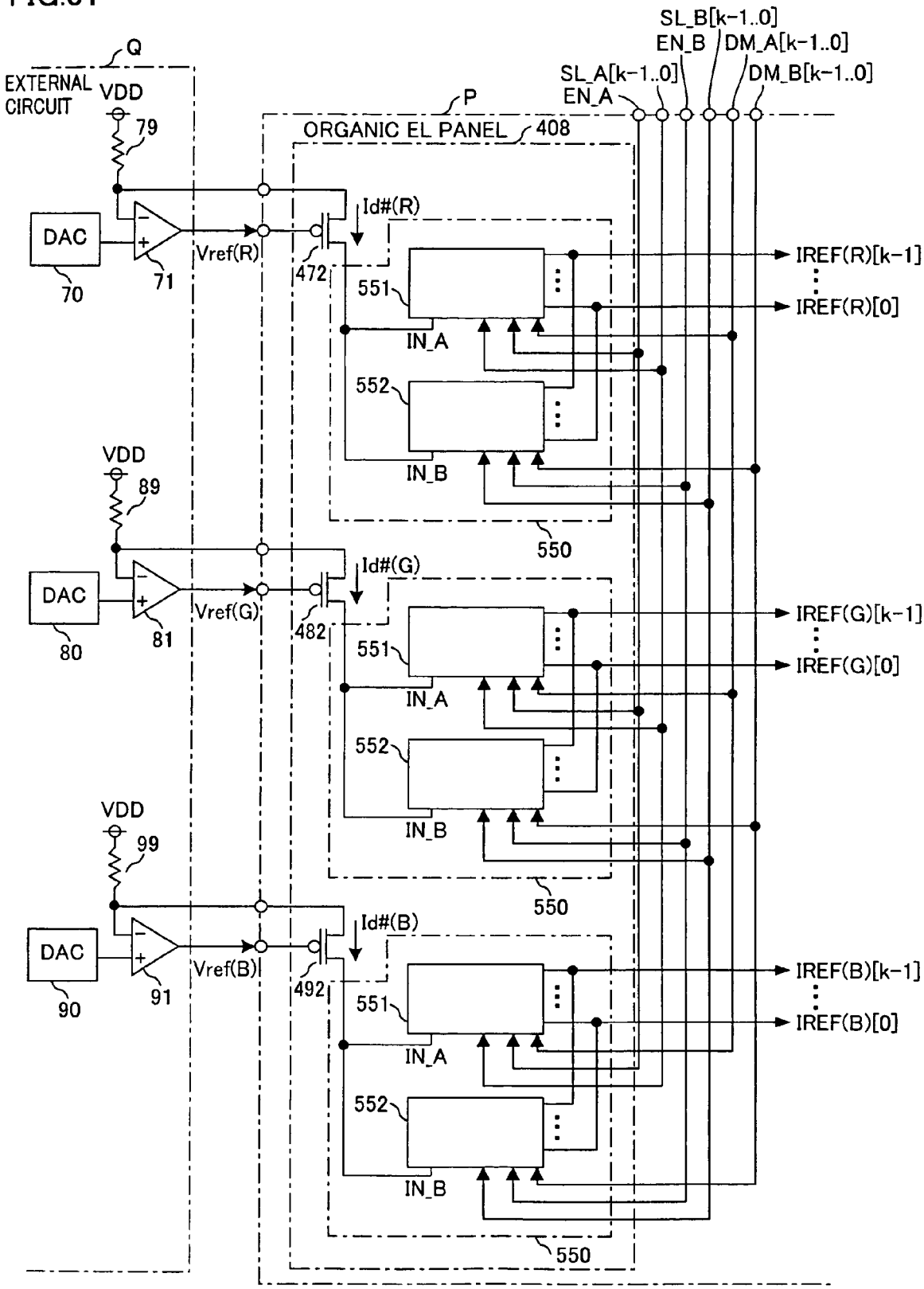
FIG. 31 is a circuit diagram representing configurations of a reference current generating circuit and an external circuit for generating the reference current, in the display apparatus in accordance with the tenth embodiment of the present invention.

FIG. 31 is a circuit diagram representing configurations of reference current generating circuit 408 and of an external circuit for generating the reference current, and reference character P on the right side of FIG. 31 denotes the side of the organic EL panel and Q denotes the side of the external circuit.

By way of example, bit weighting currents for R, that is, IREF(R)[k−1] to IREF(R)[0] are generated in the following manner. A D/A converting circuit (DAC) 70 provided outside the organic EL panel is controlled by a controller, and generates a staircase wave reference voltage Vref(R) having steps of prescribed voltages. The staircase wave reference voltage Vref(R) generated by D/A converting circuit 70 is input to a non-inversion input of differential amplifier 71. An output of differential amplifier 71 is input to the organic EL panel, and input to the gate of p-type TFT 472. The p-type TFT 472 has its source connected to power supply VDD through a current setting resistance 79 provided outside the organic EL panel. The p-type TFT 472 has its source further connected to the inversion input of differential amplifier 71. By such a configuration, differential amplifier 71, p-type TFT 472 and current setting resistance 79 form a constant current source. The drain current Id#(R) of p-type TFT 472 is given by Id#(R)=(VDD−Vref(R))/Rext(R).

The output current Id#(R) of the constant current source described above is input to current source circuit 550 having two systems (system A/system B) of current sources 551 and 552.

Figure 32:
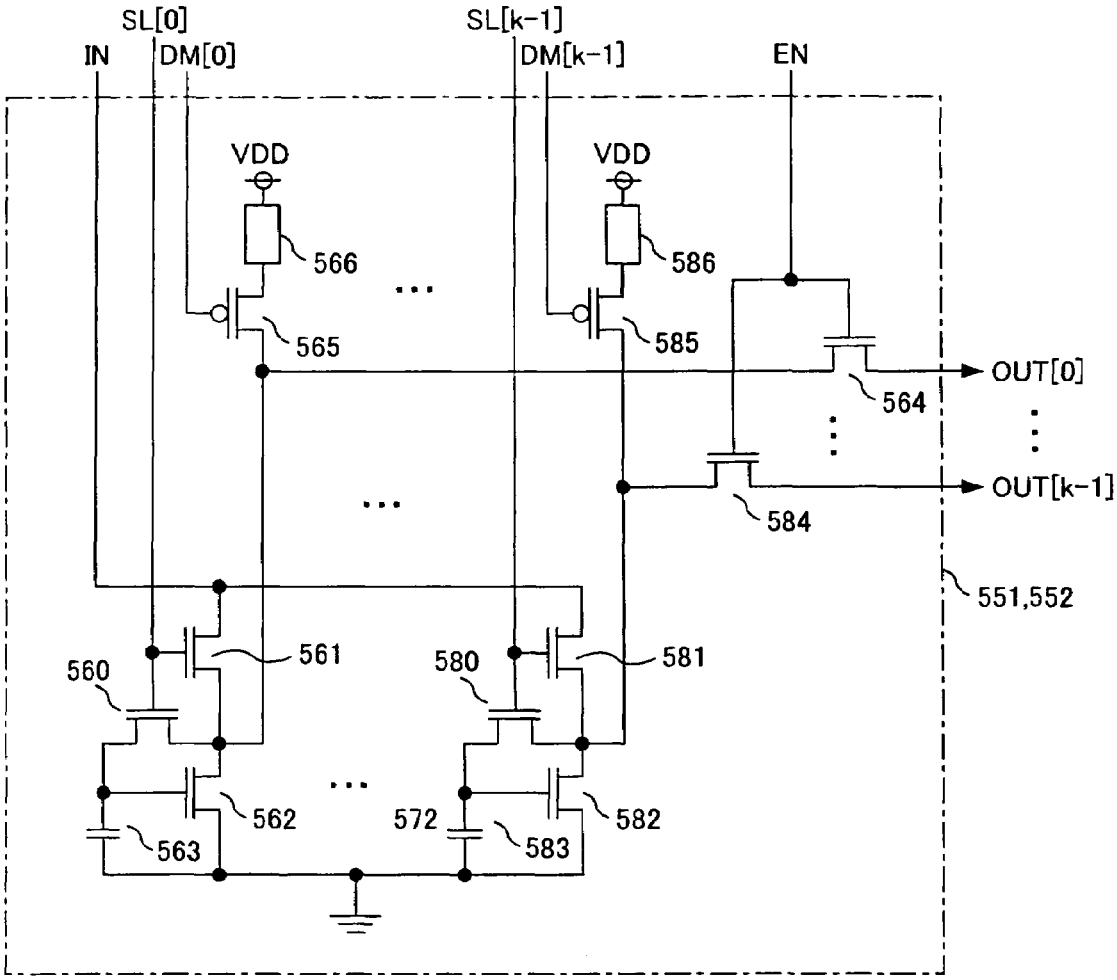
FIG. 32 is a circuit diagram representing the configuration of the current source shown in FIG. 31.

The two systems (system A/system B) of current sources 551 and 552 are formed as shown in FIG. 32. In FIG. 32, signals are denoted by general names with suffixes A and B omitted. Each of the current sources 551 and 552 includes n-type TFTs 560 to 562 and a capacitor 563 operating as a current source outputting the bit weighting reference current for the least significant bit, and n-type TFTs 580 to 582 and a capacitor 583 operating as a current source outputting the bit weighting reference current for the most significant bit. Though not shown in the figure, current sources outputting the reference currents for the middle bit of the same configuration are also provided.

Current sources 551 and 552 each have an input end IN connected to the drain of each of n-type TFTs 561, . . . , 581, and select signals SL[0], . . . , SL[k−1] are connected to the gates of n-type TFTs 560, . . . , 580 and n-type TFTs 561, . . . , 581, respectively.

The n-type TFTS 562, . . . , 582 for outputting the reference currents have their drains connected to the sources of n-type TFTs 561, . . . , 581 and to the drains of n-type TFTs 560, . . . , 580, respectively. Further, n-type TFTs 562, . . . , 582 have their gates connected to the sources of n-type TFTs 560, . . . , 580 and to the holding capacitors 563, . . . , 583, respectively. Further, the sources of n-type TFTs 562, . . . , 582 and the other end of each of capacitors 563, . . . , 583 are grounded.

Each of current sources 551 and 552 further has an n-type TFT 564, a p-type TFT 565 and a dummy load 566 provided for the least significant bit, and an n-type TFT 584, a p-type TFT 585 and a dummy load 586 provided for the most significant bit. The n-type TFTs 564 and 584 are each provided to shut off the output of the current source outputting the bit weighting reference current. Though not shown in the figure, the n-type TFT, p-type TFT and dummy load are similarly provided for the current source outputting the bit weighting reference current for the middle bit. Therefore, current sources 551 and 552 correspond to configurations of current sources 151 and 152 shown in FIG. 12, with n-type and p-type of TFTs appropriately changed and the power supply VDD replaced by the ground power supply.

Figure 33:
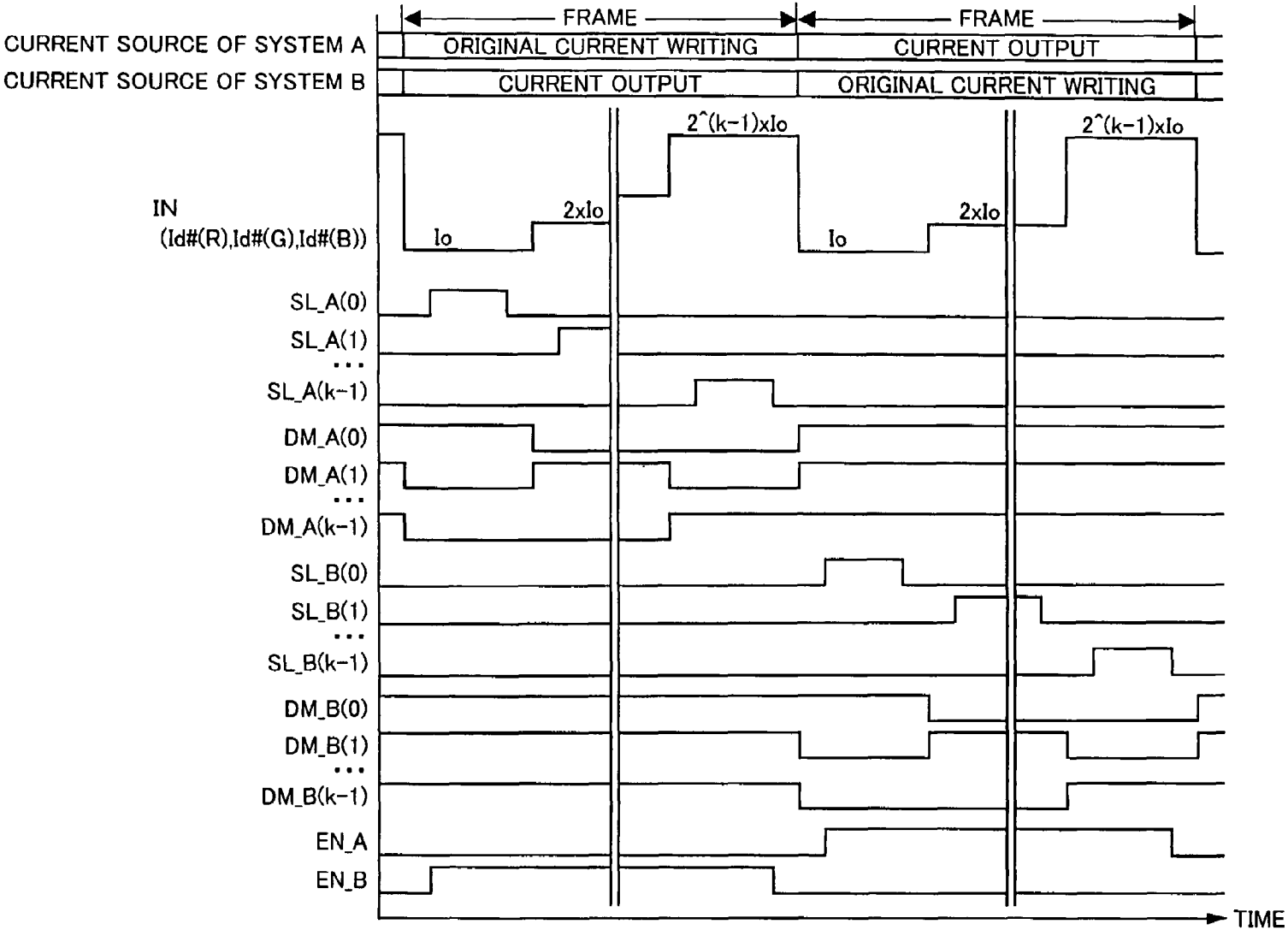
FIG. 33 is a waveform diagram representing an operation sequence of reference current generation circuit in the display apparatus in accordance with the tenth embodiment of the present invention.

FIG. 33 shows an operation sequence of reference current generating circuit 408. Current source 551 of system A and current source 552 of system B alternately repeat the original current writing operation and the current output operation, for example, frame by frame.

As D/A converting circuit (DAC) 70 is controlled by the controller, the original current Id#(R) is applied as an input current IN to input end IN of current sources 551 and 552 of system A and system B, in the form of a staircase wave current having k steps that correspond to respective bit weighting currents Io, 2×Io, . . . , 2^(k−1)×Io. Corresponding to the periods of respective steps of input current IN, SL_A(0), SL_A(1), . . . , SL_A(k−1) successively attain to the active state ("H" level).

First, when the select signal SL_A(0) attains to the active state, in current source 551 of system A, n-type TFTs 560 and 561 shown in FIG. 32 are rendered conductive, n-type TFT 562 comes to be diode-connected, and input current IN flows between the source and drain of n-type TFT 562. The gate voltage at this time is held by capacitor 563. Similarly, select signals SL_A(1), . . . , SL_A(k−1) successively become active.

In the next frame, select signals SL_A(0), SL_A(1), . . . , SL_A(k−1) are rendered inactive ("L" level), and the output enable signal EN_A is rendered active ("H" level). In response, in current source 551 of system A, the current corresponding to the gate voltage held in the previous frame by capacitors 563, . . . , 583 flows between the source and drain of n-type TFTs 562, . . . , 582, in response to conduction of n-type TFTs 564, . . . , 584. Consequently, OUT[0] to OUT[k−1] are output through n-type TFTs 564, . . . , 584, respectively, to the reference current line from current source 551.

Here, in the original current writing operation of a frame, when select signals SL_A(0), SL_A(1), . . . , SL_A(k−1) become inactive, dummy load control signals DM_A(0), DM_A(1), . . . , DM_A(k−1) are rendered active ("L" level). In response, dummy loads 566, . . . , 586 are connected to the drains of n-type TFTs 562, . . . , 582, through p-type TFTs 565, . . . , 585. Dummy loads 566, . . . , 586 each have the other end connected to the power supply VDD. Therefore, even in the period in which select signals SL_A(0), SL_A(1), . . . , SL_A(k−1) are inactive, it is possible to cause a current to flow through n-type TFTs 562, . . . , 582 for driving the reference current, through dummy loads 566, . . . , 586. Therefore, it is possible to prevent leakage of the charges held by the capacitors with the drain potential of n-type TFTs for driving the reference current decreased, whereby the reference current level at the time of outputting the reference current can be stabilized, and the time necessary for charging the capacitor in the next original current writing operation can be reduced.

Current source 552 of system B also operates in the similar manner, and repeats the original current writing operation and the reference current output operation frame by frame. In this manner, as in the configuration in accordance with the third embodiment, the reference current is supplied alternately by current source 551 of system A or current source 552 of system B.

As shown in FIG. 31, the current source circuits 550 of the succeeding stage provided corresponding to R, G and B, respectively, have the same configuration. It is noted, however, that differential amplifiers 81 and 91, p-type TFTs 482 and 492, and current setting resistances 89 and 99 are further provided to from independent constant current sources for R, G and B, to enable independent adjustment of the ratio and magnitude of the reference currents for R, G and B.

As described above, in the display apparatus in accordance with the tenth embodiment, as in the display apparatus in accordance with the first embodiment, the output current of a bit weighting current source circuit is corrected by writing a bit weighted reference current, and the bit weighting currents output from the bit weighting current source circuit are switched and added in accordance with the bit data of the digital image, to be supplied to the signal line. Consequently, even when TFT characteristics vary widely, variation in the signal line driving current among columns (signal lines) can be suppressed, and therefore, unevenness in emission luminance can be suppressed. Further, the number of signal lines can be reduced to one per one column, and therefore, application to a high resolution display with narrow pixel pitch becomes possible.

Further, in the display apparatus in accordance with the tenth embodiment, the signal line arranged to supply a signal current to the pixel circuit does not directly cross the image data line. Therefore, the signal current can be written to the pixel circuit, while transmission of the image data does not affect the potential of the signal line.

Further, as the signal line does not directly cross the image data line, line capacitance of the signal line is reduced. As a result, the settling time for the signal line potential to attain a desired value corresponding to the signal current level in accordance with the image data can be reduced. Particularly, when the display changes from white to black (for example, when lateral stripes of black on a white background are to be displayed), it is necessary that the signal line potential changes from the potential corresponding to the current for a white image to the potential corresponding to the current for writing a black image. The current for writing the black image, however, is small, and therefore, it takes time to charge the line potential of the signal line and to settle to the desired potential of the signal line. If the signal line potential should not be settled within a prescribed writing time, an edge becomes blurred at the transition from white to black (when scanning proceeds from top to bottom, white lingers on the lower side). In the display apparatus in accordance with the tenth embodiment, the line capacitance of the signal line can be reduced, and therefore, edge blurring at the transition of display from white to black can be suppressed.

Eleventh Embodiment

In the eleventh embodiment, a configuration will be described, which corresponds to the display apparatus in accordance with the tenth embodiment with the circuit scale of the signal line driving circuit reduced.

Figure 34:
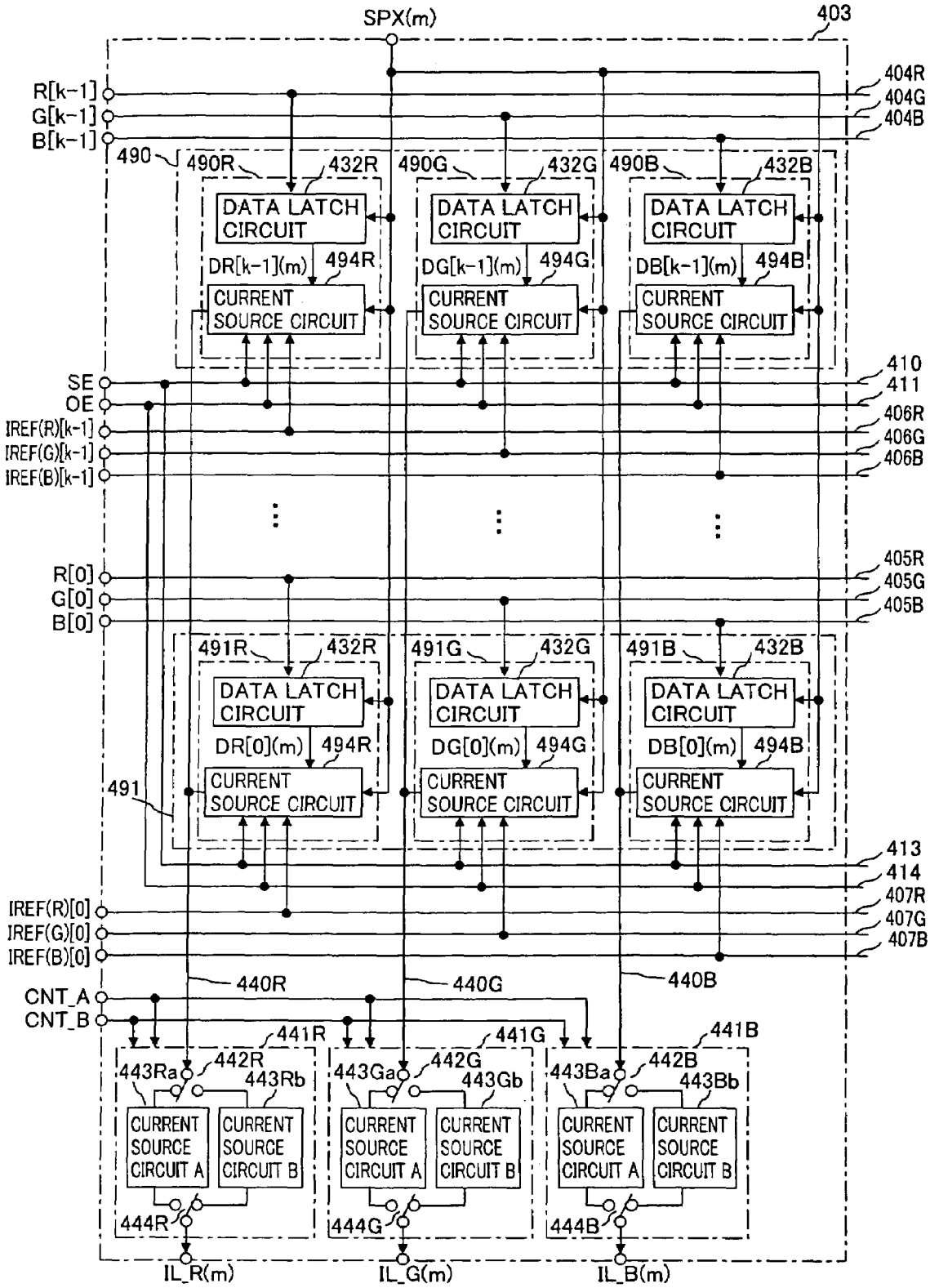
FIG. 34 is a block diagram representing in detail a configuration of a signal line driving circuit in the display apparatus in accordance with an eleventh embodiment of the present invention.

FIG. 34 is a block diagram showing in detail the configuration of the signal line driving circuit in the display apparatus in accordance with the eleventh embodiment. Referring to FIG. 34, as in FIG. 26, a configuration of a signal line driving circuit 403 corresponding to the m-th RGB column is shown as a representative. Signal line driving circuit 403 having the same configuration is arranged for each RGB column.

Referring to FIG. 34, in the signal line driving circuit in accordance with the eleventh embodiment, different from the signal line driving circuit shown in FIG. 26, arrangement of timing latch circuits 433R, 433G and 433B is omitted and current source circuits 494R, 494G and 494B are arranged in place of current source circuits 434R, 434G and 434B, for respective bits of the image data. Other than these portions, the configuration is the same as that of the signal line driving circuit shown in FIG. 26, and therefore, detailed description will not be repeated.

Figure 35:
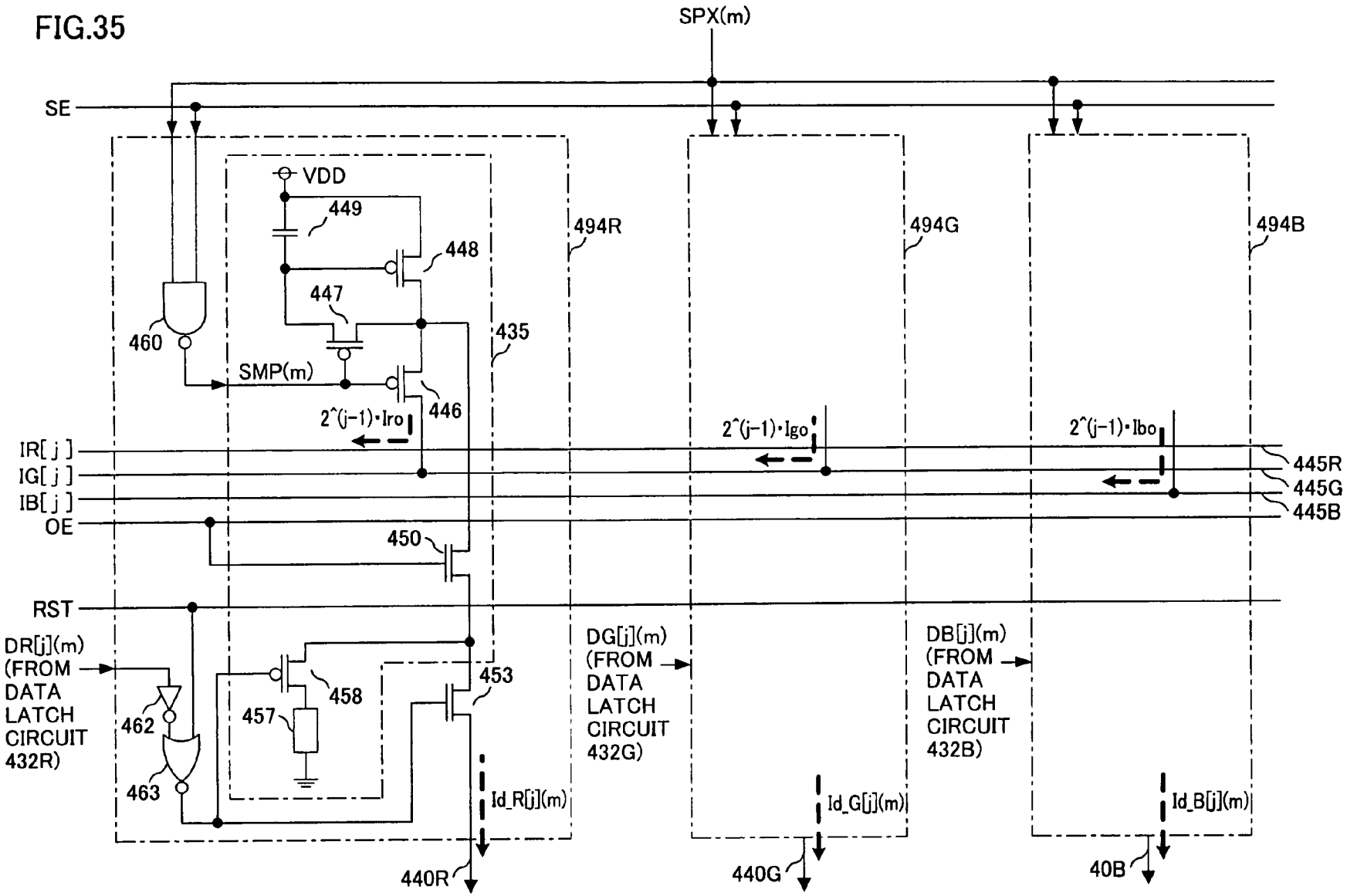
FIG. 35 is a circuit diagram representing a configuration of a bit weighting current source in the display apparatus in accordance with the eleventh embodiment of the present invention.

FIG. 35 is a circuit diagram representing a configuration of the current source circuit of the display apparatus in accordance with the eleventh embodiment. In FIG. 35, as in FIG. 27, current source circuits 494R, 494G and 494B corresponding to the j-th bit (j: integer from 0 to (k−1)) of the image data in signal line driving circuit 403 for the m-th RGB column are shown. As current source circuits 494R, 494G and 494B have the same configuration, only the circuit configuration of current source circuit 494R is shown in FIG. 35 as a representative.

Referring to FIG. 35, current source circuit 494R in accordance with the eleventh embodiment includes, in addition to the components of current source circuit 434R in accordance with the tenth embodiment, an NOT circuit 462 and an NOR circuit 463. NOT circuit 462 inverts the level of the corresponding bit DR[j](m) of the image data and outputs the result. NOR circuit 463 outputs, to the gate of n-type TFT 453 the result of an NOR operation (negative logical product) between the output of NOT circuit 462 and a data reset signal RST.

When the data reset signal RST is active ("H" level), the output of NOR circuit 463 is always at the "L" level regardless of the logic level of the corresponding bit DR[j](m) from the corresponding data latch circuit 432R, and therefore, p-type TFT 458 is rendered conductive and n-type TFT 453 is rendered non-conductive. Consequently, even when current source circuit 494R is in the current output mode operation, connection between current output line 440R and bit weighting current source 435 is shut off and a current is caused to flow from driving TFT 448 to dummy load 457 to prevent leakage of charges held by capacitor 449 and to suppress variation in the gate voltage of driving TFT 448, when the data reset signal RST is active.

When the data reset signal RST is inactive ("L" level), the output of NOR circuit 463 has the same logic level as the corresponding bit DR[j](m). Therefore, the operation of current source circuit 494R is the same as that of the current source circuit 434R shown in FIG. 27.

Figure 36:
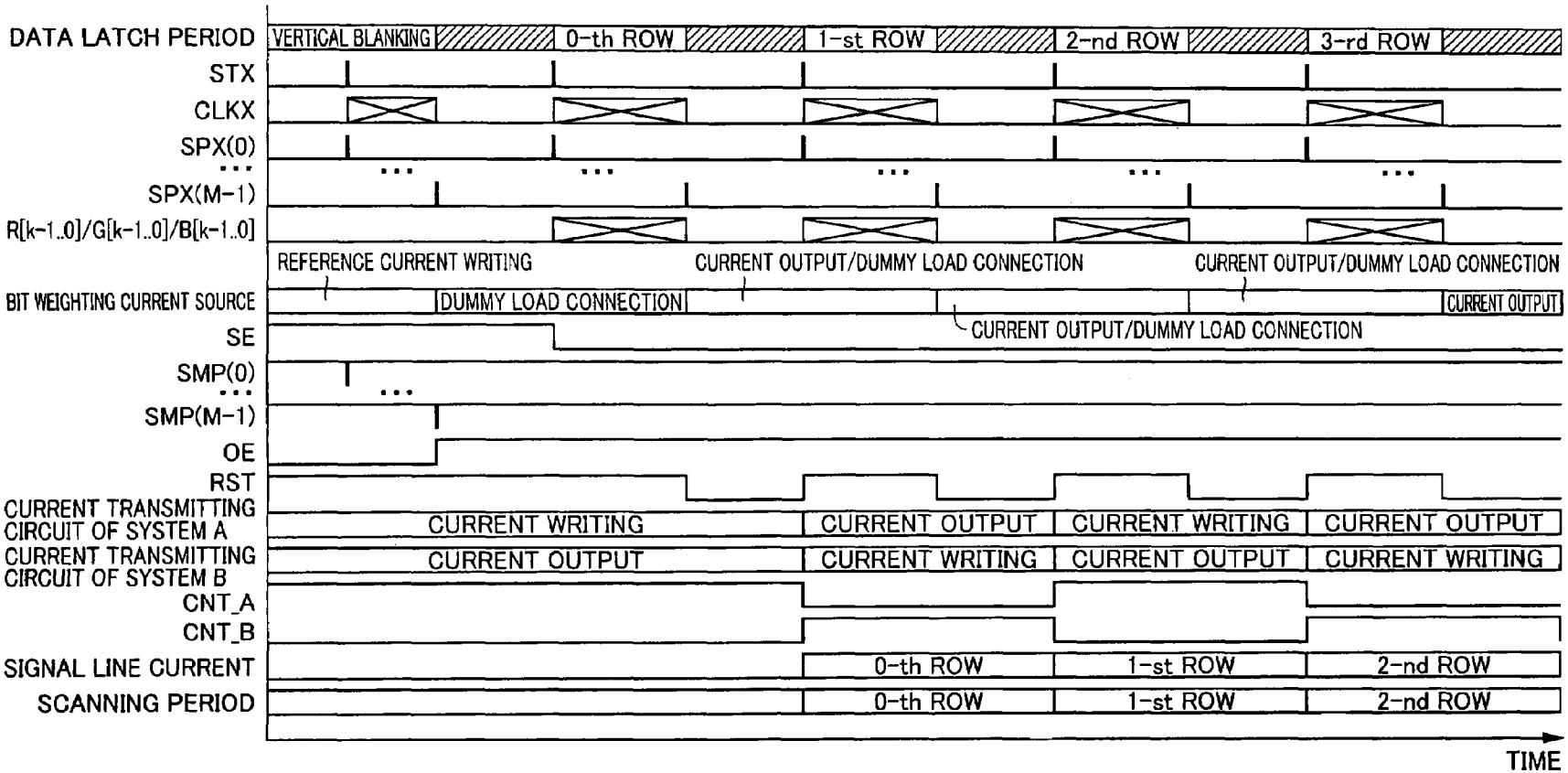
FIG. 36 is a waveform diagram representing an operation sequence of the display apparatus in accordance with the eleventh embodiment of the present invention.
Figure 37:
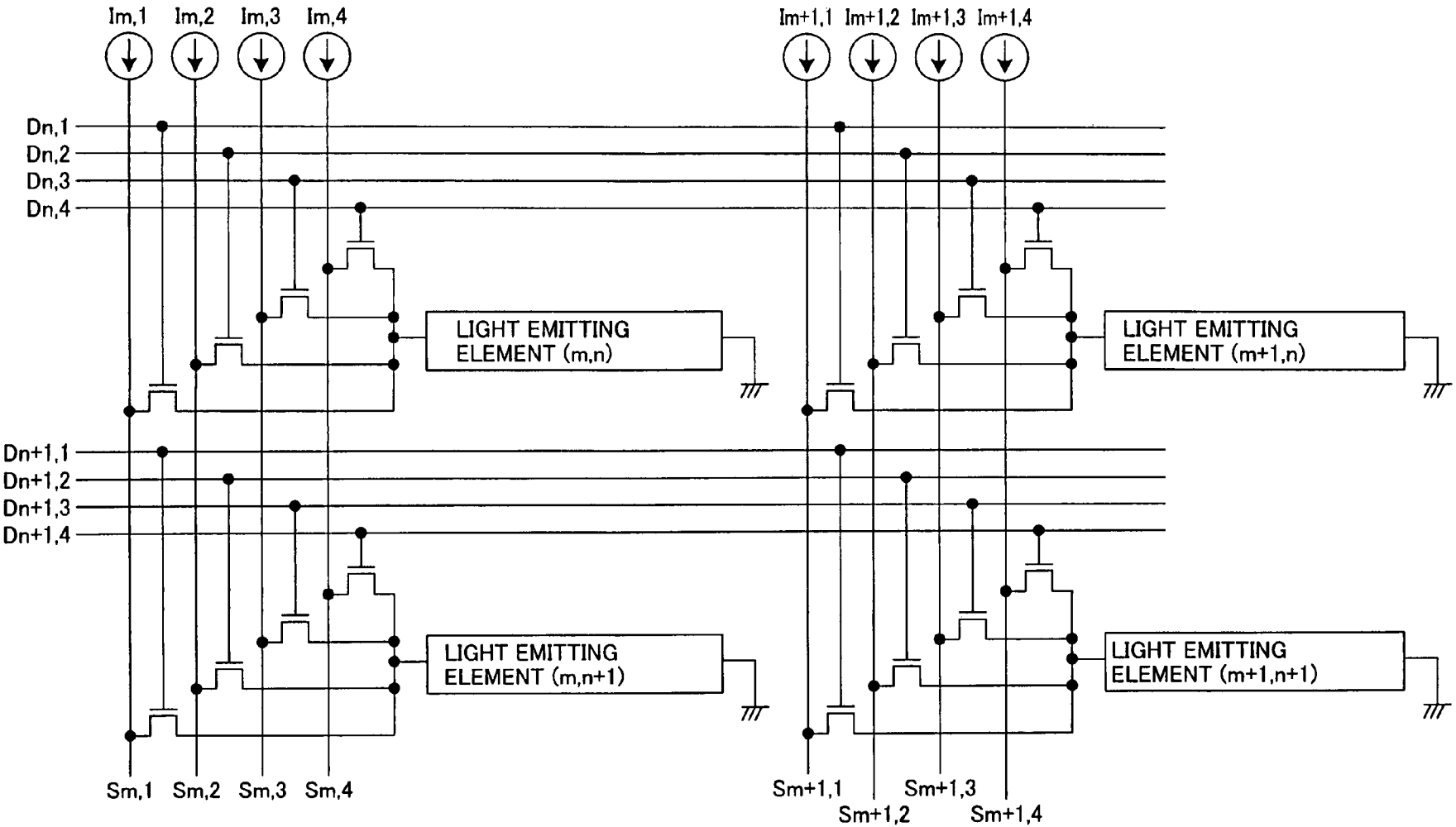
FIG.37 PRIOR ART
FIG. 37 is a circuit diagram representing a configuration for supplying current to a light emitting element in a conventional display apparatus.

The operation sequence of the display apparatus in accordance with the eleventh embodiment will be described with reference to FIG. 36. FIG. 36 shows a former portion of the j-th frame, and the pixel matrix is assumed to have N rows and 3×M columns (M columns for each of R, G and B).

As in the tenth embodiment, in the j-th frame period, to shift register circuit 1, the start pulse STX is input from the controller at the start of the data latch period of the 0-th row (starting row) to the (N−1)-th row (last row). Further, the shift clock CLKX is input from the controller to the shift register circuit 1 in the entire latch period of respective rows, and shift pulses SPX(0), SPX(1), SPX(2), . . . SPX(M−1) are successively output from shift register circuit 1.

Meanwhile, RGB image data R[k−1..0], G[k−1..0] and B[k−1..0] of the column of interest are input from the controller to be latched by data latch circuits 2 in response to the shift pulse SPX (generally denoting shift pulses SPX(0) to SPX(M−1)).

As in the embodiments described above, writing of the reference current to current source circuit 494 (generally representing current source circuits 494R, 494G and 494B) takes place in the vertical blanking period. After the end of writing the reference current, the output enable signal OE is rendered active ("H" level), and p-type TFT 448 for driving in current source circuit 494 enters the current output mode. active, so as to force the dummy load to be connected to the output node (drain) of p-type TFT 448 for driving.

In a period after the latching of data of one row is complete and before the start of latching the data of the next row, the data reset signal RST is rendered inactive ("L" level). Thus, n-type TFT 453 provided as a switch circuit is rendered conductive in accordance with the latched data, and the bit weighting current is output to current output line 440. Specifically, current output from the current converting circuit to the current output line is performed utilizing the horizontal blanking period (hatched portion of the data latch period shown in FIG. 36).

By way of example, the signal current of the starting row (0-th row) is written to current source circuit 443*a* of system A in each current transmitting circuit 441 in the horizontal blanking period between the 0-th row and the 1-st row, and written as the signal line current to signal lines 28, 29 and 30 in the next horizontal period. Next, the signal current of the 1-st row is written to current source circuit 443*b* of system B in each current transmitting circuit 441, and written as the signal current to signal lines 28, 29 and 30 in the next horizontal period.

The control signals CNT_A and CNT_B are toggled at every horizontal period to have opposite polarities, so that the current source circuits of system A and system B in each current transmitting circuit 441 perform the current writing operation and the current output operation in a complementary manner. As described above, there is a lag of two horizontal periods between the data latch period and the period in which the signal currents of the corresponding row are output to the signal lines 28, 29 and 30 in the tenth embodiment, while in the eleventh embodiment, the lag corresponds to one horizontal period.

To scan driver circuit 37, the start pulse STY is input near the scanning period of the 0-th row, and over the entire scanning period, the shift clock CLKY is input. Based on the start pulse STY and shift clock CLKY, shift pulses SPY(0), SPY(1), . . . , SPY(N−1) are successively generated in scan driver circuit 37 in respective scanning periods. Based on the thus generated shift pulse SPY (generally representing the shift pulses SPY(0), SPY(1), . . . , SPY(N−1)), driving pulses SC_A(0), SC_B(0), . . . SC_A(N−1), SC_B(N−1) of the first and second scan lines 35, 36 corresponding to respective rows are successively generated, and the first and second scan lines 35 and 36 of respective rows of the pixel matrix are scanned at prescribed timings.

In this manner, the signal currents obtained by converting the image data to analog currents, supplied by signal line driving circuit 402 to the signal lines of respective columns are successively written to respective pixel circuits. As already described, in each pixel circuit, a current based on the signal current supplied from the signal line is caused to flow to the EL light emitting diode, and organic EL light emitting diode 65 emits light.

As described above, in the eleventh embodiment, in addition to the effects of the tenth embodiment, the circuit scale can be reduced, as the latches of the second stage (timing latch circuits 433R, 433G, 433B) can be omitted. As the timing latch circuit is required to be the same in number as the bit number for each signal line, there is a considerable effect of reducing circuit scale by the omission thereof.

In the first to eleventh embodiments, by independently adjusting output voltages Vref (R), Vref (G) and Vref (B) of D/A converting circuits 70, 80 and 90 using a controller, the ratio and magnitude of reference currents for R, G and B are made adjustable. If it is unnecessary to adjust the white balance or luminance, a prescribed fixed voltage may be applied to the non-inversion input of differential amplifiers 71, 81 and 91, in place of the D/A converter.

Of the current sources for generating the original current, the D/A converting circuit, differential amplifier and current setting resistance are provided outside the organic EL panel. The reason for this is that when these components are formed by TFTs within the panel, it becomes difficult to ensure accuracy of the reference current, because of the variation in TFT characteristics. These components may be implemented by TFTs within the panel, when deviation in the reference current resulting from the variation in TFT characteristics poses no problem.

Though examples in which writing to the pixel circuit is performed by pulling in the signal current from the pixel circuit through the signal line have been described in the first to eleventh embodiments, it may be possible that the signal current flows in a direction that the current is pushed out from the signal line to the pixel circuit. In such a case, the invention may be applied, by way of example, by switching the connection of the bit weighting current source to the ground and to the power supply VDD, changing n-type TFTs 46 to 48 to p-type TFTs, and by connecting dummy load 51 not to the power supply VDD but to the ground power supply, in the first embodiment. The same applies to the second and other embodiments.

Further, it is unnecessary to say that the conductivity types of TFTs such as TFTs 53 to 55 used as the switching elements may appropriately be changed.

Further, though the light emitting element has been described as an organic EL light emitting element, the present invention is applicable even when the other light emitting element such as an LED (light emitting diode) of which emission luminance changes dependent on the current is used.

In each current source circuit of the display apparatus in accordance with the tenth and eleventh embodiments, a technique for improving accuracy of the driving current of the driving TFT similar to that of the fifth to ninth embodiments may be adopted.

INDUSTRIAL APPLICABILITY

The display apparatus of the present invention is applicable to display panels of home use appliances such as television receivers as well as portable terminals such as portable telephones.

The invention claimed is:

1. A display apparatus, comprising:

a pixel matrix circuit configured to supply a current to a light emitting element of each pixel;

a signal line configured to supply a signal current in accordance with digital image data to said pixel matrix circuit;

a reference current generating unit configured to output a bit weighted reference current in correspondence with each bit of said digital image data;

a bit weighting current generating unit corresponding to said each bit of said digital image data, said bit weighting current generating unit configured to output a bit weighting current corresponding to said reference current and to correct said bit weighting current by writing the corresponding said reference current; and a switching unit corresponding to said bit weighting current generating unit, said switching unit configured to switch said bit weighting current output from the corresponding said bit weighting current generating unit in accordance with a data level of a corresponding bit, and to add each current switched by said switching unit to form said signal current and to output said signal current to said signal line, wherein said bit weighting current generating unit includes:

a first field effect transistor configured to output a current, a second field effect transistor configured to connect the gate and drain of said first field effect transistor when said reference current is written, and a capacitance element connected to the gate of said first field effect transistor, and said second field effect transistor is configured to conduct when said reference current is written so that a gate voltage corresponding to a current flowing through said first field effect transistor is held in said capacitance element, said second field effect transistor is configured to shut off when said bit weighting current is output, and said first field effect transistor is configured to output a current corresponding to the gate voltage held by said capacitance element when said bit weighting current is output.

2. The display apparatus according to claim 1, wherein said bit weighting current generating unit further includes a dummy load electrically connected to a node to which said bit weighting current is output, and said bit weighting current generating unit is configured to supply a current to said dummy load when a current is not supplied from a corresponding said switching means to said signal line.

3. The display apparatus according to claim 1, wherein said bit weighting current generating unit further includes a third field effect transistor cascade-connected to a drain side of said first field effect transistor, and said first field effect transistor is configured to apply a prescribed voltage to the gate of said third field effect transistor so that said third field effect transistor operates in a saturation region.

4. The display apparatus according to claim 1, wherein said bit weighting current generating unit further includes a third field effect transistor cascade-connected to a drain side of said first field effect transistor, and said third field effect transistor is configured to be shut off when a current is not output from corresponding said switching unit to said signal line in said bit weighting current output operation.

5. The display apparatus according to claim 1, wherein said bit weighting current generating unit further includes a capacitance element connected to the drain of said first field effect transistor and said capacitance element is configured to hold a voltage of said drain.

6. The display apparatus according to claim 1, further comprising:

a latch unit configured to latch an input of said digital image data of one display line successively in response to a latch pulse; and a latch pulse generating unit for successively generating said latch pulse, wherein said latch pulse generating unit is configured to generate said latch pulse and said bit weighting current generating unit is configured to write a corresponding said reference current for correcting said bit weighting current, based on said latch pulse, in a blanking period in a data latch period in which digital images of one frame are latched by said latching unit and in a blanking period of a period in which said bit weighting current generating unit supplies a current to said signal line.

7. The display apparatus according to claim 6, wherein said latch pulse generating unit is configured to operate at a time of activation; and said bit weighting current generating unit is configured to write a corresponding said reference current based on generated said latch pulse and, thereafter, said latch unit is configured to latch said digital data to provide a display based on generated said latch pulse.

8. The display apparatus according to claim 1, further comprising:

a voltage varying unit configured to generate a variable reference voltage; and a constant current source configured to convert said reference voltage to a current, wherein said reference current generating unit includes a current source circuit configured to generate said reference current from the current output from said constant current source.

9. The display apparatus according to claim 8, wherein said current source circuit includes a current mirror circuit configured to convert the current output from said constant current source to said reference current corresponding to each bit of said image data, and said current mirror circuit has a plurality of field effect transistors of which a size ratio is different in accordance with the bit weighting.

10. The display apparatus according to claim 1, wherein said bit weighting current generating unit includes two systems of bit weighting current sources; and said display apparatus further comprises a control unit configured to control each of said two systems of bit weighting current sources, such that a writing operation of said reference current and an output operation of said bit weighting current are repeated alternately in a complementary manner.

11. The display apparatus according to claim 1, further comprising:

a staircase wave current source configured to generate a staircase wave current having said weighted reference current values as current values of respective steps of the staircase, wherein said reference current generating unit includes a current source to which the current of a corresponding step of said staircase wave current is written, and said reference current generating unit is configured to reproduce the written current and output the reproduced current as said reference current.

12. The display apparatus according to claim 1, wherein said reference current generating unit is configured to supply said reference current as a staircase wave current having bit weighted current values, and said bit weighting current generating unit is configured to have said staircase wave current written to it as a reference current at a timing for each corresponding bit of said digital image data.

13. A display apparatus, comprising:

a pixel matrix circuit configured to supply a current to a light emitting element of each pixel;

a plurality of first signal lines configured to supply a signal current in accordance with a digital image data to said pixel matrix circuit;

an image data line configured to transmit said digital image data; and a signal line driving portion configured to generate said signal current corresponding to said digital image data over said plurality of first signal lines, wherein said signal line driving portion includes a plurality of second signal lines corresponding to and independent from said plurality of first signal lines, a plurality of current converting circuits corresponding to said plurality of second signal lines, each of the plurality of current converting circuits is configured to generate a current corresponding to an image signal received by said image data line to a corresponding one of the plurality of said second signal lines, and a plurality of current transmitting circuits provided between said plurality of first and second signal lines, respectively;

each of said plurality of current transmitting circuits is configured to generate, on a corresponding one of said plurality of first signal lines, a current obtained by reproducing a current passing through a corresponding one of said plurality of second signal lines as said signal current; and said image data line is arranged to avoid a region crossing said plurality of first signal lines.

14. The display apparatus according to claim 13, wherein each of said plurality of current converting circuits includes a second plurality of current converting units corresponding to a plurality of bits forming said digital image data;

each of said second plurality of current converting units includes a first latch circuit configured to take and hold data of a corresponding bit among said plurality of bits, at a first prescribed timing determined for each of said plurality of current converting circuits from said image data line, a second latch circuit configured to receive from said first latch circuit the data of said corresponding bit held by said first latch circuit and configured to hold the data, at a second prescribed timing later than said first prescribed timing, determined common to said plurality of current converting circuits, and a current source circuit configured to generate, on a corresponding one of said plurality of second signal lines, corresponding to one of said plurality of bit weighting currents set corresponding to said plurality of bits; and said current source circuit is configured to execute or stop generation of a corresponding said bit weighting current, in accordance with the data of said corresponding bit held by said second latch circuit.

15. The display apparatus according to claim 13, wherein each of said plurality of current converting circuits includes a second plurality of current converting units corresponding to a plurality of bits forming said digital image data;

each of said second plurality of current converting units includes a latch circuit configured to take and hold data of a corresponding bit among said plurality of bits, at a first prescribed timing determined for each of said plurality of current converting circuits from said image data line, and a current source circuit configured to generate, on a corresponding said second signal line, corresponding to one of a plurality of bit weighting currents set in correspondence with said plurality of bits; and said current source circuit has a reset circuit configured to execute or stop generation of corresponding said bit weighting current in accordance with the data of said corresponding bit held in said latch circuit, and said current source circuit is configured to forcefully stop generation of said bit weighting current until a second prescribed timing determined common to said plurality of current converting portions, wherein said second prescribed timing is later than said first prescribed timing, in a same horizontal period.

16. The display apparatus according to claim 13, further comprising:

a reference current generating circuit configured to generate a plurality of reference currents representing reference levels of a plurality of bit weighting currents set corresponding to said plurality of bits, respectively, wherein each of said plurality of current converting circuits includes a plurality of current source circuits provided corresponding to the plurality of bits forming said digital image data, and each of said plurality of current source circuits includes a bit weighting current source configured to execute a reference current writing operation of receiving corresponding said reference current from said reference current generating circuit and holding an electrical state dependent on a corresponding said reference current, and a current output operation of generating said bit weighting current source in accordance with said electrical state held in said reference current writing operation; and a switch circuit configured to switch, in accordance with a corresponding bit among said plurality of bits, transmission of said bit weighting current to a corresponding said second signal line from said bit weighting current source, in said current output operation by said bit weighting current source.

17. The display apparatus according to claim 16, wherein said bit weighting current source includes a first field effect transistor having its source and drain connected to a prescribed voltage and to a first node, respectively, a second field effect transistor disposed between a node to which said reference current is supplied and said first node, said second field effect transistor is configured to be turned on in said reference current writing operation and turned off in said current output operation, a third field effect transistor disposed to connect the gate and drain of said first field effect transistor in said reference current writing operation, and a capacitance element connected to hold a gate-to-source voltage of said first field effect transistor; and said switch circuit includes a fourth field effect transistor provided between corresponding said second signal line and said first node, and said switch circuit is configured to be turned on or off dependent on said corresponding bit in said current output operation.

18. The display apparatus according to claim 13, wherein each of said plurality of current transmission circuits has first and second current source circuits; and each of said first and second current source circuits is configured to alternately execute a current writing operation in which an electrical state corresponding to a current flowing through a corresponding one of said plurality of second signal lines is held, and a current output operation supplying a current corresponding to said electrical state held in said current writing operation to a corresponding one of said plurality of first signal lines.

19. The display apparatus according to claim 18, wherein each of said first and second current source circuits includes a first field effect transistor having its source and drain connected to a prescribed voltage and to a first node, respectively, and its gate connected to a second node, a second field effect transistor connecting the gate and drain of said first field effect transistor in said current writing operation, and a capacitance element connected to said second node to hold a source-to-drain voltage of said first field effect transistor; and each of said plurality of current transmitting circuits includes an input switch circuit connecting a corresponding one of said plurality of second signal lines to said first node of one of said first and second current source circuits that is configured to perform said current writing operation, and an output switch circuit connecting a corresponding one of said plurality of first signal lines to said first node of another one of said first and second current source circuits that is configured to perform said current output operation.

* * * * *

UNITED STATES PATENT AND TRADEMARK OFFICE

CERTIFICATE OF CORRECTION

PATENT NO. : 7,570,244 B2
APPLICATION NO. : 10/513755
DATED : August 4, 2009
INVENTOR(S) : Agari et al.

It is certified that error appears in the above-identified patent and that said Letters Patent is hereby corrected as shown below:

On the title page, Item (73), the Assignee's information is incorrect. Item (73) should read:

-- (73) Assignee: Mitsubishi Denki Kabushiki Kaisha,
Tokyo (JP) --

Signed and Sealed this

Fifteenth Day of September, 2009

David J. Kappos

David J. Kappos
*Director of the United States Patent and Trademark Office*